US010131171B2

(12) United States Patent
Sumikawa et al.

(10) Patent No.: US 10,131,171 B2
(45) Date of Patent: Nov. 20, 2018

(54) TRANSFER MATERIAL, PRINTED MATERIAL, MANUFACTURING APPARATUS FOR PRINTED MATERIAL, AND MANUFACTURING METHOD FOR PRINTED MATERIAL

(71) Applicant: CANON FINETECH INC., Misato-shi (JP)

(72) Inventors: Yusuke Sumikawa, Kashiwa (JP); Takahiro Tsutsui, Matsudo (JP); Hiromitsu Hirabayashi, Yokohama (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/413,766

(22) Filed: Jan. 24, 2017

(65) Prior Publication Data

US 2017/0210123 A1 Jul. 27, 2017

(30) Foreign Application Priority Data

Jan. 27, 2016 (JP) ..... 2016-013711

(51) Int. Cl.

| | |
|---|---|
| ***B41M 5/035*** | (2006.01) |
| ***B41M 5/382*** | (2006.01) |
| ***B41J 2/005*** | (2006.01) |
| ***B41M 5/52*** | (2006.01) |

(Continued)

(52) U.S. Cl.

CPC ..... *B41M 5/38278* (2013.01); *B41J 2/0057* (2013.01); *B41M 5/035* (2013.01); *B41M 5/52* (2013.01); *B41M 5/502* (2013.01); *B41M 7/0027* (2013.01); *B41M 2205/10* (2013.01)

(58) Field of Classification Search

CPC ..... B41M 5/035; B41M 5/38278

See application file for complete search history.

(56) References Cited

U.S. PATENT DOCUMENTS

| | | | |
|---|---|---|---|
| 4,880,465 | A | 11/1989 | Loria et al. |
| 6,022,440 | A | 2/2000 | Nordeen et al. |
| 6,284,349 | B1 | 9/2001 | Hatada et al. |

(Continued)

FOREIGN PATENT DOCUMENTS

| | | | |
|---|---|---|---|
| EP | 1 266 766 | A1 | 12/2002 |
| JP | H09-240196 | A | 9/1997 |

(Continued)

OTHER PUBLICATIONS

Jun. 23, 2017 European Search Report in European Patent Appln. No. 17152758.3.

(Continued)

*Primary Examiner* — Kristal Feggins
*Assistant Examiner* — Kendrick Liu
(74) *Attorney, Agent, or Firm* — Fitzpatrick, Cella, Harper & Scinto

(57) ABSTRACT

A transfer material is provided that can be more firmly attached to an image substrate without deteriorating printing characteristics concerning image bleeding, printing resolution, and the like. An ink receiving layer is of a gap-absorbing type. An adhesive layer includes discretely disposed adhesive pieces provided on a surface of the ink receiving layer so as to leave exposed portions on the surface of the ink receiving layer.

7 Claims, 27 Drawing Sheets

(51) Int. Cl.
*B41M 5/50* (2006.01)
*B41M 7/00* (2006.01)

(56) References Cited

U.S. PATENT DOCUMENTS

| | | | | |
|---|---|---|---|---|
| 6,548,149 | B1 * | 4/2003 | Liu | B32B 27/20 156/235 |
| 6,878,423 | B2 | 4/2005 | Nakanishi | |
| 2003/0181331 | A1 * | 9/2003 | Ieshige | B41M 5/345 503/201 |
| 2006/0281847 | A1 | 12/2006 | Furutachi et al. | |
| 2008/0302470 | A1 * | 12/2008 | Sumita | B41M 5/506 156/241 |
| 2009/0033730 | A1 * | 2/2009 | Shino | B41M 5/00 347/102 |
| 2010/0238252 | A1 * | 9/2010 | Dinescu | B41M 5/0256 347/217 |
| 2015/0042737 | A1 | 2/2015 | Tsutsui et al. | |
| 2016/0288468 | A1 | 10/2016 | Tsutsui et al. | |
| 2017/0157910 | A1 | 6/2017 | Sumikawa et al. | |

FOREIGN PATENT DOCUMENTS

| | | | |
|---|---|---|---|
| JP | H11-129613 | A | 5/1999 |
| JP | H11-140365 | A | 5/1999 |
| JP | 2000-239585 | A | 9/2000 |
| JP | 2001-205918 | A | 7/2001 |
| JP | 2001-234093 | A | 8/2001 |
| JP | 2002-370497 | A | 12/2002 |
| JP | 2003-251920 | A | 9/2003 |
| JP | 2004-202841 | A | 7/2004 |
| JP | 3562754 | B2 | 9/2004 |
| JP | 2008-284710 | A | 11/2008 |
| JP | 2013-039791 | A | 2/2013 |
| JP | 2013-136156 | A | 7/2013 |

OTHER PUBLICATIONS

Esin Gulari, et al., "Photon correlation spectroscopy of particle distributions", J. Chem. Phys. Apr. 15, 1979, vol. 70, Issue 8, pp. 3965-3972, Stony Brook, New York.

Nov. 21, 2017 Japanese Office Action in Japanese Patent Appln. No. 2016-013711.

* cited by examiner

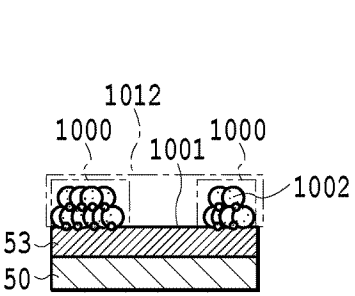
FIG.19A
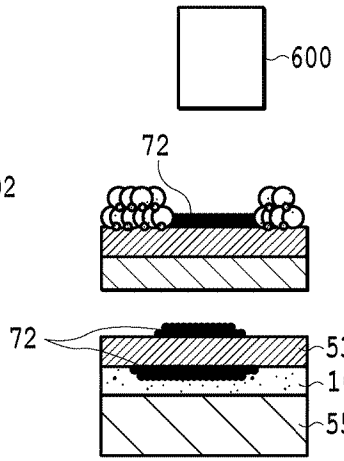
FIG.19B
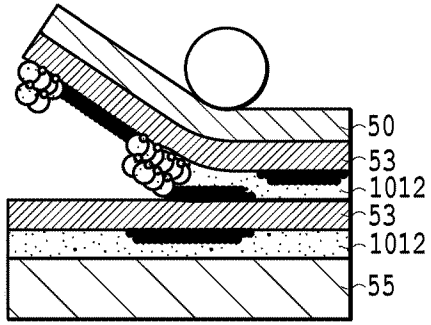
FIG.19C
FIG.19D
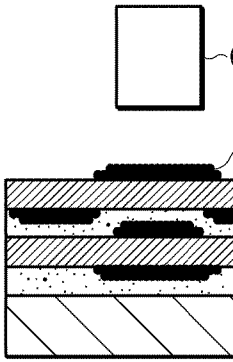
FIG.19E
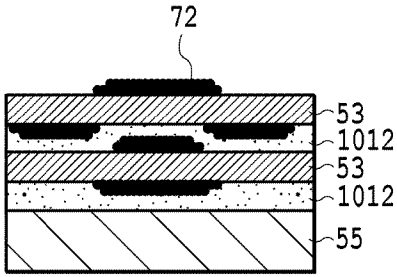
FIG.19F

TRANSFER MATERIAL, PRINTED MATERIAL, MANUFACTURING APPARATUS FOR PRINTED MATERIAL, AND MANUFACTURING METHOD FOR PRINTED MATERIAL

BACKGROUND OF THE INVENTION

Field of the Invention

Transfer materials are stuck to an image substrate, for example, after printed using an ink jet printing system, so as to be used for labels, ID cards, packaging materials, building materials, and other various applications.

Description of the Related Art

In the ink jet printing system, an ink receiving layer of a transfer material needs to absorb a large amount of ink in order to achieve a sufficient image density. Examples of the ink receiving layer include a swelling absorbing type mainly formed of water-soluble resin and containing ink in a network structure of a water-soluble polymer and a gap absorbing type that contains ink in a fine gap structure. The gap-absorbing ink receiving layer is preferably used because a large amount of ink can be absorbed into air gaps in the ink receiving layer. However, when an ink receiving layer surface is appropriately attached to an image substrate after ink jet printing, while ink absorbability is maintained so as to absorb a large amount of ink, specific problems may occur which are attributed to the ink receiving layer that can absorb a large amount of ink.

For example, the ink receiving layer surface may be attached to the image substrate by bonding particles together with resin to bring a gap-absorbing ink receiving layer with air gaps formed therein into which the ink is absorbed into close contact with the image substrate and heating the resultant laminate to a temperature higher than a glass transition temperature Tg (dissolution temperature) of the resin, which serves as a binder. In this case, the problems (1) and (2) may occur.

The ink receiving layer surface is insufficiently smooth, and the amount of resin serving as a binder for particles is insufficient to cover the entire ink receiving layer surface, making adhesion to the ink receiving layer difficult.

The resin serving as a binder for particles has a weak affinity to the material of the image substrate depending on the combination of the resin and the material, making adhesion difficult.

First, the problem (1) will be described. The gap-absorbing ink receiving layer has spaces resulting from bonding of particles with the resin and serving as air gaps into which the ink is absorbed, and can thus absorb a large amount of ink into the air gaps. However, a countless number of recesses and protrusions formed of exposed particles are present on a surface of the ink receiving layer. In a common configuration of the gap-absorbing ink receiving layer, the number of resin components functioning as a binder is substantially smaller than the number of particles, and thus, a large number of air gaps are formed to provide sufficient ink absorbability, resulting in enhanced ink absorbability during ink jet printing. After ink jet printing, the ink receiving layer may be attached to the image substrate by being brought into close contact with the image substrate and heated so that the resin components functioning as a binder is dissolved at a temperature higher than Tg (dissolution temperature) and flow and come into contact with the image substrate. A countless number of recesses and protrusions formed of exposed inorganic particulates are present on the surface of the ink receiving layer formed by adding together approximately 90% inorganic particulates and approximately 10% water-soluble resin functioning as a binder that binds the inorganic particulates together. When the surface of the ink receiving layer is attached to the image substrate, even though the water-soluble resin is heated to a temperature equal to or higher than the glass transition temperature and dissolved and flows, only a small amount of flowing water-soluble resin comes into contact with the image substrate. Thus, it may be difficult to sufficiently fill, with the dissolved water-soluble resin, the space between the surface of the ink receiving layer with the countless number of recesses and protrusions formed of non-adhesive inorganic particulates and the image substrate surface, resulting in inappropriate adhesion. Increasing the amount of water-soluble resin allows adhesion to be strengthened. However, the air gaps between the inorganic particulates are likely to be filled, degrading the ink absorbability during ink jet printing to preclude appropriate image printing characteristics from being achieved.

Now, the problem (2) will be described. To allow the ink receiving layer to appropriately adhere to the image substrate, materials having an affinity to each other need to be selected for the image substrate and the resin components of the ink receiving layer. When the resin components and the image substrate are dissolved by heat at the time of adhesion, the affinity between the resin components and the image substrate is enhanced. The resin components are firmly attached to the image substrate by an intermolecular force between the component material of the resin components and the component material of the image substrate. However, in many cases, the material of the image substrate and the resin components of the ink receiving layer may have a low affinity to each other depending on the combination of the resin components and the material of the image substrate. Thus, when the gap-absorbing ink receiving layer is attached to the image substrate, the ink receiving layer fails to be attached to the image substrate depending on the combination of the ink receiving layer and the material of the image substrate, and the material of the image substrate for attachment is limited.

Thus, if the ink receiving layer and the image substrate fail to adhere to each other, a highly adhesive primer layer needs to be provided between the ink receiving layer and the image substrate. Thus, the ink receiving layer and the image substrate need to be attached to each other via the primer layer. However, providing the primer layer needs a separate step of forming the primer layer after image printing. Thus, disadvantageously, a relevant apparatus has an increased size, and a transfer speed is reduced and thus limited because the primer layer is generally formed by thermal transfer.

Consequently, a technique has been proposed in which an image printed using an ink jet printing system is attached to the image substrate (transfer target material) without the use of a primer.

For example, Japanese Patent Laid-Open No. H09-240196 (1997) describes a transfer image forming sheet material including a porous adhesive layer and an ink receiving layer formed under the adhesive layer. The ink receiving layer receives and fixes the ink from an ink jet printing apparatus via the porous adhesive layer, and is configured to absorb the ink transmitted through the porous adhesive layer.

Japanese Patent Laid-Open No. 2013-39791 describes a transfer film including an ink permeation layer having air gaps through which the ink infiltrates and an ink receiving layer allowing reception of the ink having passed through the ink permeation layer. The ink permeation layer is charged to have the same polarity as that of the ink so as to promote permeation of the ink through the air gaps, and the ink receiving layer is charged to have the polarity opposite to the polarity of a color material in the ink. The ink is absorbed into the ink receiving layer through the ink permeation layer.

In Japanese Patent Laid-Open No. H09-240196 (1997), a swelling absorbing ink receiving layer is used. Upon absorbing the ink, the swelling absorbing ink receiving layer partly swells and becomes non-smooth. When an ink receiving layer having a surface that is non-smooth and that is uneven is attached to an image substrate, the unevenness of the surface weakens the adhesion between a transfer film and the image substrate, possibly making the adhesion between the image substrate and the ink receiving layer difficult. To reduce the adverse effect of the unevenness of the surface of the swollen ink receiving layer, the adhesive layer may be made thicker. However, an increased thickness of the adhesive layer leads to the need for a long time to allow the ink to pass through the ink permeation layer. Then, the ink stays in the adhesive layer for an increased length of time, spreading ink dots that form an image to make the image likely to bleed. To smooth the uneven surface of the swollen ink receiving layer, the ink receiving layer may be sufficiently dried before being attached to the image substrate. However, a long time is needed to sufficiently dry the ink receiving layer, disadvantageously limiting the transfer speed. A separate dryer may be provided to promote drying of the swollen ink receiving layer to smoothen the uneven surface. However, this disadvantageously leads to an increased size of the apparatus.

Furthermore, the porous adhesive layer has the property of allowing permeation of the ink by capillary action and thus absorbs the ink at high speed. On the other hand, the swelling absorbing ink receiving layer mainly formed of water-soluble resin and containing the ink in the network structure of a water-soluble polymer needs a long time to absorb the ink. That is, an ink absorption speed of the porous adhesive layer is much higher than an ink absorption speed of the swelling absorbing ink receiving layer. Thus, ink droplets having landed on the porous adhesive layer are quickly transmitted through the adhesive layer to reach an interface between the adhesive layer and the ink receiving layer. However, since the swelling absorbing ink receiving layer absorbs the ink at low speed, the ink may stagnate in the adhesive layer on the ink receiving layer surface. As a result, the ink dots that form an image spread, leading to the likelihood of image bleeding and a decrease in resolution.

Moreover, the swelling absorbing ink receiving layer absorbs the ink at low speed and thus fails to instantaneously absorb a large amount of ink. Thus, a large amount of unabsorbed ink having failed to be absorbed by the ink receiving layer remains in the adhesive layer after ink jet printing. If, in this state, an attempt is made to attach the adhesive layer onto image substrate by bringing the adhesive layer into close contact with the image substrate, the unabsorbed ink flows back to the surface of the porous adhesive layer to cover the area between the adhesive layer and the image substrate, leading to inappropriate adhesion. Furthermore, moisture remaining inside the porous adhesive layer may rapidly vaporize during thermal transfer to form voids, resulting in inappropriate adhesion. When the ink is sufficiently dried so as not to hinder adhesiveness, the speed of ink jet printing may be significantly reduced. Maintaining the appropriate printing speed needs a special drying unit used after ink jet drying, resulting in an increase in the size of the apparatus and complication of the apparatus.

In Japanese Patent Laid-Open No. 2013-39791, the adhesive ink permeation layer has air gaps through which the ink permeates, and ink jet printing is performed on the ink permeation layer side to allow the ink having passed through the ink permeation layer to be contained and absorbed into the gaps between ink receiving particles in the ink receiving layer. However, in the air gaps in the ink permeation layer, the ink may aggregate, and thus, it is difficult to allow all of the ink having landed on the ink permeation layer to uniformly pass through. Thus, the ink remaining in the air gaps in the ink permeation layer in an isolated manner may flow back to the surface of the ink permeation layer during ink attachment, leading to inappropriate adhesion.

Thus, in Japanese Patent Laid-Open No. 2013-39791, the ink permeation layer is charged to have the same polarity as that of the ink so as to prevent aggregation of the ink in the air gaps in the ink permeation layer, whereas the ink receiving layer is charged to have the polarity opposite to the polarity of the ink so as to allow the ink to be absorbed into the ink receiving layer instead of remaining in the ink permeation layer. However, a relatively high electric force is needed to shift all of the ink, absorbed into the air gaps in the ink permeation layer by a strong capillary force, to the ink receiving layer side based on the difference in charging polarity. During a process in which the ink infiltrates through the gaps in the ink permeation layer, a portion of the ink separated and isolated from the remaining portion of the ink by some of the air gaps remains stagnant in the air gaps. Consequently, preventing the ink from remaining in the ink permeation layer is difficult.

Thus, in Japanese Patent Laid-Open No. 2013-39791, an ink permeation liquid that allows permeation of the ink to be promoted is ejected using the ink jet printing system to push the ink from the ink permeation layer to the ink receiving layer. However, a separate mechanism that ejects the ink permeation liquid needs to be provided, disadvantageously leading to an increased size of the apparatus. Thus, this method lacks practicality.

As described above, image bleeding or a decrease in printing resolution may occur in a configuration in which an adhesive ink permeation layer is provided all over the surface of the transfer material so as to absorb the ink into the ink receiving layer through the ink permeation layer. Moreover, the ink may remain on the surface of the ink permeation layer or inside the ink permeation layer to cause inappropriate adhesion. Thus, achieving both appropriate ink jet printing characteristics and appropriate adhesiveness is difficult.

SUMMARY OF THE INVENTION

The present invention provides a transfer material that can be more firmly attached to an image substrate without deteriorating printing characteristics concerning image bleeding, printing resolution, and the like. The present invention allows an ink receiving layer to adhere to an image substrate after ink jet printing without limitation of a material for the image substrate, and eliminates the need for a primer.

The transfer material in the present invention is configured to make color materials unlikely to remain on a surface of an adhesive and to quickly absorb ink into the ink receiving layer. To achieve this, an ink absorption speed of the ink receiving layer is set higher than an ink absorption speed of the adhesive to enable the ink on the adhesive surface to be quickly dragged and absorbed into the ink receiving layer.

That is, when a portion of the ink comes into contact with the surface of the ink receiving layer, which absorbs the ink at a higher absorption speed than the adhesive, the ink present on the surface of the adhesive or inside the adhesive can be quickly dragged into the ink receiving layer. The ink absorbed through the surface of the ink receiving layer sequentially infiltrates into the ink receiving layer, and is absorbed while spreading in a film thickness direction and a horizontal direction in accordance with permeability anisotropy of the ink receiving layer. The ink receiving layer is designed and produced to have such permeability anisotropy as enables appropriate control of spread of ink dots that are the basis of ink jet printing images. That is, when large ink dots are needed, the permeability in the horizontal direction is set higher than the permeability in the film thickness direction. In contrast, when small ink dots are needed and the amount of ink that can be absorbed is to be increased, the permeability in the film thickness direction may be set higher than the permeability in the horizontal direction, and the ink receiving layer may be made thick. To allow isotropic permeation to occur with the permeability anisotropy disabled to enable the ink receiving layer to be effectively and efficiently produced, the permeability of the ink receiving layer as a whole is preferably controlled so as to allow the ink dots to spread in a desired manner, and the film thickness and the like may be adjusted in accordance with the desired amount of ink that can be absorbed.

When the ink absorption speed of the ink receiving layer is set higher than the ink absorption speed of the adhesive as described above, the ink may be hindered from remaining on the surface of the adhesive to maintain adhesion. The spread of the ink in the ink receiving layer is appropriately controlled to allow image bleeding and a decrease in printing resolution to be hindered to provide a transfer material with excellent image printing characteristics.

In the present invention, when an adhesive layer is formed on the surface of the ink receiving layer, which serves as an ink jet printing surface, an adhesive is provided at certain portions of the ink receiving layer rather than being provided all over the surface of the ink receiving layer, thus leaving the other portions of the surface of the ink receiving layer directly exposed. Consequently, a portion of the applied ink is brought into direct contact with the surface of the ink receiving layer, which absorbs the ink at high absorption speed, thus allowing the ink to be absorbed into the ink receiving layer while bypassing the adhesive. As a result, the ink is unlikely to remain on the surface of the adhesive, which absorbs the ink at low absorption speed, or inside the adhesive. For the ink for ink jet printing, surface tension and viscosity are appropriately controlled. Thus, when a portion of the ink having come into contact with any of the directly exposed portions of the ink receiving layer after passage in a bypassing manner starts to be absorbed into the ink receiving layer, which absorbs the ink at high absorption speed, the remaining portion of the ink that is continuous with the above-described portion is sequentially drawn into the ink receiving layer after passage in a bypassing manner without interruption. That is, when the ink having landed on the surface of the adhesive is continuous with the portion of the ink having come into contact with the directly exposed portion of the ink receiving layer after passage in a bypassing manner, the ink is sequentially absorbed into the ink receiving layer, which absorbs the ink at high absorption speed, and is unlikely to remain on the surface of the adhesive or inside the adhesive. The ink absorbed through the directly exposed surface of the ink receiving layer infiltrates through the ink receiving layer in accordance with the appropriately designed and controlled permeability anisotropy of the ink receiving layer, thus forming desired ink dots. In the ink receiving layer, the ink infiltrates and spreads in accordance with the permeability of the ink receiving layer. Thus, ink dots are formed even at the bottom of the adhesive, providing appropriate ink jet printing characteristics with the adverse effect of the adhesive layer minimized.

In the present invention, to allow the ink receiving layer to quickly absorb the ink, a transfer material with a gap-absorbing ink receiving layer formed on a substrate and with an adhesive layer formed on a surface of the ink receiving layer is provided in which the adhesive in the adhesive layer is discretely provided on the surface of the ink receiving layer, leaving certain portions of the surface of the ink receiving layer directly exposed. Thus, a portion of the ink having landed on the adhesive layer comes into instantaneous contact with the surface of the gap-absorbing ink receiving layer, which absorbs the ink at high absorption speed, while bypassing the adhesive, and is autonomously absorbed through the directly exposed surface of the ink receiving layer in a dragging manner. Therefore, appropriate ink dots can be formed in an area of the ink receiving layer including the bottom of the adhesive, and the ink is unlikely to remain on the surface of the adhesive or inside the adhesive, hindering inappropriate adhesion. As a result, both appropriate printing characteristics and appropriate adhesion can be achieved. In particular, an ink receiving layer with air gaps formed therein by bonding inorganic particulates together with a binder of water-soluble resin can maintain a gap structure even after the transfer material is attached to the image substrate. Thus, even when the adhesive and the binder are melted, the absorbed ink can be held inside the ink receiving layer. Even when vapor is generated, the vapor can be sealed inside the ink receiving layer, further strengthening the adhesion. The adhesive contained in the adhesive layer can be selected as needed with the material of the ink receiving layer and the adhesion to the image substrate focused on and without being limited by the characteristics of the ink. Therefore, after ink jet printing, the transfer material can be attached to various image substrates via the discretely disposed adhesive pieces.

In the present invention, the ink absorption speed of the ink receiving layer is set higher than the ink absorption speed of the adhesive to allow the ink on the adhesive surface or inside the adhesive to be absorbed into the ink receiving layer at the moment when a portion of the ink having landed on the adhesive layer comes into contact with the ink receiving layer. As a result, possible image bleeding is prevented, color materials are unlikely to remain on the surface, and both the appropriate image printing characteristics and the appropriate adhesion can be achieved.

Further features of the present invention will become apparent from the following description of exemplary embodiments (with reference to the attached drawings).

BRIEF DESCRIPTION OF THE DRAWINGS

FIGS. 19A to 19F are process diagrams illustrating yet another example of the manufacturing method for a printed material;

DESCRIPTION OF THE EMBODIMENTS

Embodiments of the present invention will be described below based on the drawings.

[1] Transfer Material

In the present invention, in a transfer material in which an ink receiving layer is formed on a substrate and an adhesive layer is formed on a surface of the ink receiving layer, the ink receiving layer is of a gap-absorbing type, and the adhesive layer is discretely formed on the surface of the ink receiving layer so as to leave certain portions of the surface of the ink receiving layer directly exposed. Such a configuration allows ink to be quickly absorbed into the ink receiving layer. An "island-and-sea structure" or an "island-and-sea-like adhesive layer" as used herein refers to the configuration of the adhesive layer in which adhesive pieces are discretely formed on the surface of the ink receiving layer so as to leave certain portions of the surface of the ink receiving layer directly exposed. A set of pieces of adhesive discretely formed in the adhesive layer may be referred to as an "adhesive portion" or an "island portion". A directly exposed portion of the surface of the ink receiving layer may be referred to as an "exposed portion (of the ink receiving layer)". A bypass portion of the adhesive layer that has no adhesive may be referred to as a "sea portion" or a "bypass portion". Therefore, the bottom of the sea portion (bypass portion) corresponds to an exposed portion of the ink receiving layer.

[1-1] Structure of the Adhesive Layer (Island-and-Sea Structure)

Figure 1:
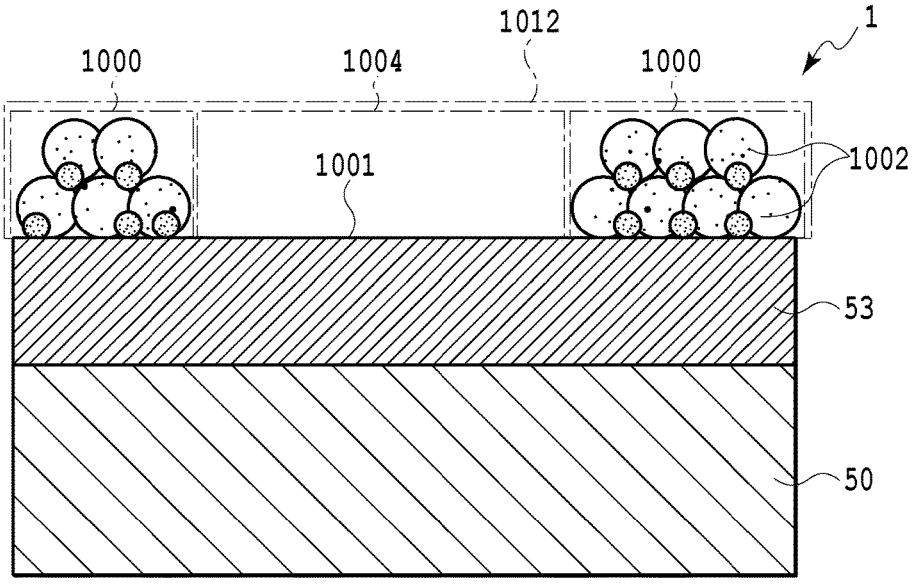
FIG. 1 is a sectional view of a transfer material in the present invention.

In a transfer material 1 in the present embodiment, a gap-absorbing ink receiving layer 53 is disposed on a surface of a substrate 50, and an adhesive layer 1012 of an adhesive 1002 is disposed on the surface of the ink receiving layer 53 as depicted in FIG. 1. The adhesive 1002 does not substantially absorb ink, or absorbs the ink but only at low absorption speed. On the other hand, the gap-absorbing ink receiving layer 53 appropriately absorbs ink at high speed. The adhesive 1002 is discretely formed on the surface of the ink receiving layer 53 such that the adhesive layer 1012 includes island portions 1000 serving as adhesive portions that are aggregates of adhesive pieces 1002 and sea portions 1014 serving as bypass portions with no adhesive 1002.

The ink having landed on the adhesive layer side, which serves as a printing surface of the transfer material, impacts the adhesive portions (island portions) and bypass portions (sea portions) of the adhesive layer. An ink droplet coming into partial contact with any of the bypass portions contacts the corresponding exposed portion of the ink receiving layer, which absorbs the ink at high absorption speed, and is thus quickly absorbed and drawn into the ink receiving layer without being absorbed into the adhesive layer. On the other hand, for an ink droplet having landed near the center of any of the adhesive portions of the adhesive layer, a portion of the droplet may fail to come into contact the corresponding exposed portion of the ink receiving layer. However, this ink droplet spreads due to the impact of the landing, and before absorption into the adhesive portion, a portion of the ink droplet that is deformed by the landing impact can come into contact with the exposed portion of the ink receiving layer.

Figure 2A:
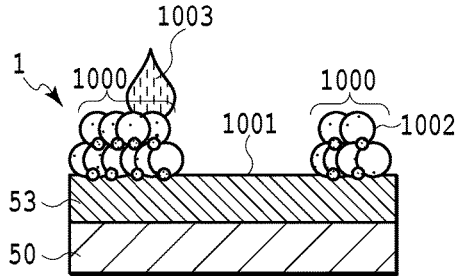
FIGS. 2A to 2F are diagrams illustrating an ink absorption mechanism of the transfer material in the present invention.
Figure 2B:
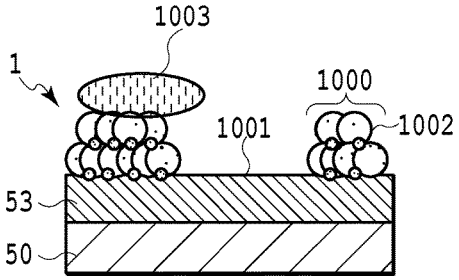
Figure 2C:
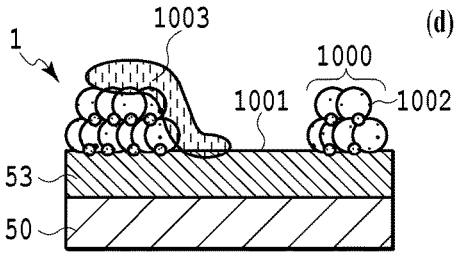
Figure 2D:
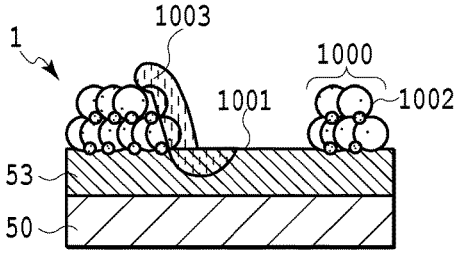
Figure 2E:
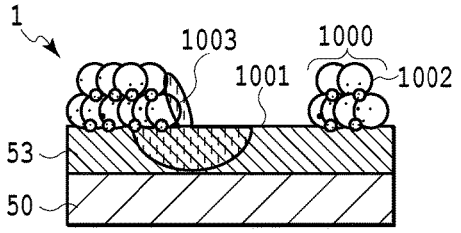
Figure 2F:
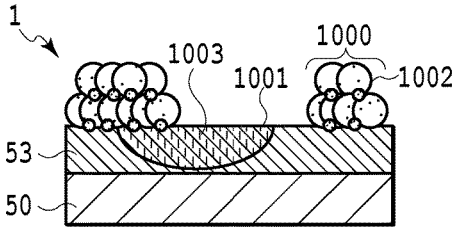

FIGS. 2A to 2F are diagrams illustrating a mechanism in which an ink droplet having landed near the center of any of the adhesive portions 1000 of the adhesive layer 1012 is absorbed. In ink jet printing, the ink having landed on the printing surface is known to spread over a range that is larger than the diameter of a droplet of the ink. As depicted in FIG. 2A and FIG. 2B, ink 1003 spreads upon landing on any of the adhesive portions 1000 of the adhesive layer 1012 hangs out from the adhesive portion 1000. As depicted in FIG. 2C, the extending portion of the ink 1003 passes through the space between the adhesive portions 1000 (bypass portion 1014) and hangs into the corresponding exposed portion 1001 of the ink receiving layer 53. A portion of the hanging ink can come into direct contact with the exposed portion 1001 of the ink receiving layer 53 without passing through the adhesive portion 1000. For ink for ink jet printing, surface tension and viscosity are appropriately controlled. Thus, as depicted in FIG. 2D, FIG. 2E, and FIG. 2F, when a portion of the ink that is in contact with the exposed portion 1001 starts to be absorbed into the ink receiving layer 53, which absorbs the ink at high absorption speed, the remaining portion of the ink that are continuous with the absorbed portion is drawn into the ink receiving layer 53 without interruption. In other words, the remaining portion of the ink that is continuous with the portion of the ink that is in contact with the exposed portion 1001 sequentially passes through the outside of the adhesive portion 1000 in a bypassing manner and is drawn into the ink receiving layer 53. The ink thus absorbed into the ink receiving layer sequentially infiltrates through the ink receiving layer 53.

As described above, the ink 1003 landing on the surface of any of the adhesive portions 1000 spreads upon the landing and is then sequentially absorbed into the ink receiving layer 53, which absorbs the ink at high absorption speed, after a portion of the ink 1003 comes into contact with the exposed portion 1001. The ink 1003 is autonomously and quickly absorbed, in a dragging manner, into the exposed portion 1001 of the gap-absorbing ink receiving layer 53, which absorbs the ink at high absorption speed, while being not substantially absorbed into the adhesive portion 1000. Consequently, the ink is unlikely to remain on the surface of the adhesive layer 1012 or inside the adhesive portion 1000.

The present inventor's examinations indicate that, when a portion of the ink remains on the surface of the adhesive portion or inside the adhesive portion, if the adhesive is melted during thermal transfer described below, the remaining ink may float out on the surface and turn into a film at an interface between the image substrate and the adhesive, leading to inappropriate adhesion. When a portion of the ink remains on the surface of the adhesive portion or inside the adhesive portion, if the adhesive is melted during thermal transfer, some components of the remaining ink may vaporize to form a vapor layer or the like between the image substrate and the adhesive, leading to inappropriate adhesion. In the transfer material in the present embodiment, as described above, substantially no ink remains on the surface of the adhesive portion or inside the adhesive portion. Consequently, during transfer after ink jet printing, an adhesion error is unlikely to occur, and appropriate adhesion can be achieved.

In the transfer material 1 in the present embodiment, the structure of the ink receiving layer 53 is preferably controlled so as to prevent adhesion from being hindered by a large amount of ink autonomously absorbed into the ink receiving layer 53. That is, the structure of the ink receiving layer 53 is controlled so as to avoid a situation where, during transfer, a gap structure of the ink receiving layer 53 is destroyed to cause a liquid component of the ink to seep through the surface of the ink receiving layer 53 and turn into a film or where liquid component of the ink is explosively boiled to form an air layer at an adhesive surface between the ink receiving layer 53 and the image substrate. As described above, the structure of the ink receiving layer 53 is preferably controlled so as to prevent the gap structure of the ink receiving layer from being destroyed during transfer, inhibiting hindrance of the adhesion between the ink receiving layer 53 and the image substrate. In particular, in an ink receiving layer with air gaps formed by bonding inorganic particulates together with a binder of water-soluble resin, the gap structure can be held after adhesion. Even when the adhesive and the binder are melted, the ink receiving layer as described above can hold the absorbed ink inside, and when vapor is generated, can seal the vapor inside. Consequently, the ink receiving layer particularly appropriately achieves adhesion and is thus preferable. Similarly, a gap-absorbing ink receiving layer may be used which has air gaps formed by bonding together, instead of the inorganic particulates, resin particles having a melting temperature Tg higher than a transfer temperature using a binder resin because these resin particles are less likely to be melted and deformed during thermocompression bonding. When the gap structure is maintained after thermocompression bonding, even if the liquid component of the ink is explosively boiled in the individual air gaps to generate vapor, the vapor can be sealed in each of the air gaps. Thus, no air layer is formed on the adhesive surface, and appropriate adhesion can be achieved. When the gap structure is maintained during transfer, a situation can be prevented where the air gaps are collapsed under pressure or melted on heating to cause a main solvent such as water or nonvolatile solvent to seep through the surface, leading to appropriate adhesion.

Permeability anisotropy of the ink receiving layer is designed to allow appropriate control of the spread of ink dots that are the basis of ink jet printing. That is, when large ink dots are needed, the permeability in a horizontal direction (the direction along the surface of the ink receiving layer) is set higher than the permeability in a film thickness direction. In contrast, when small ink dots are needed and the amount of ink that can be absorbed is to be increased, the permeability in the film thickness direction may be set higher than the permeability in the horizontal direction, and the ink receiving layer may be made thick. To allow the ink receiving layer to be effectively and efficiently produced, a configuration may be provided in which isotropic permeation occurs with the permeability anisotropy disabled. In this case, the permeability of the ink receiving layer as a whole is preferably controlled so as to allow the ink dots to spread in a desired manner, and the film thickness and the like may be adjusted in accordance with the desired amount of ink that can be absorbed.

Figure 3B:
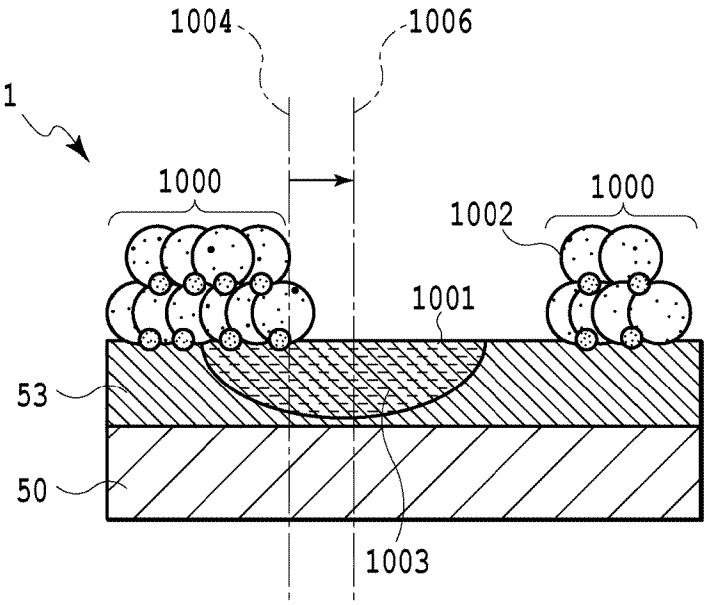
FIG. 3A and FIG. 3B are diagrams illustrating ink absorption in a gap-absorbing ink receiving layer.
Figure 3A:
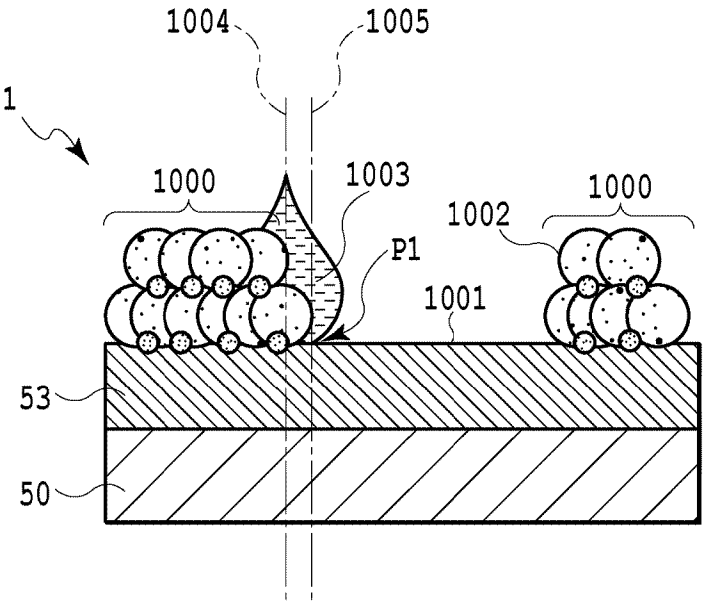

For printing of a dense image on the transfer material, filling substantially all the area of the ink receiving layer with an ink color material (an area factor of approximately 100%) is important. In the transfer material in which the adhesive of the adhesive layer is discretely formed on the surface of the ink receiving layer as in the present invention, the adhesive, which does not substantially absorb the ink, is discretely present on the surface of the ink receiving layer. Thus, permeation of the ink through the surface of a portion of the ink receiving layer on which the adhesive is present is limited. To allow substantially all the area of the ink receiving layer to be filled with the ink color material, the permeability anisotropy of the ink receiving layer 53 is preferably controlled as depicted in FIG. 3A and FIG. 3B. That is, the permeability anisotropy is controlled so as to allow the ink 1003 to permeate the ink receiving layer 53 in the horizontal direction around an ink contact point P1 where the ink 1003 is in contact with the exposed portion 1001 of the ink receiving layer 53, to fill a part of the ink receiving layer 53 located under the adhesive pieces 1002 with the ink color material. In short, the permeability anisotropy is preferably controlled such that the ink infiltrates through the ink receiving layer 53 in the horizontal direction to fill a part of the ink receiving layer 53 located under the adhesive pieces 1002 and the adhesive portion 1000 with the ink color material. In some cases, permeation speed may vary between the thickness direction of the ink receiving layer and the horizontal direction. The permeation speed in the horizontal direction and the permeation speed in the horizontal speed may be adjusted in accordance with the permeability anisotropy. Therefore, the transfer material 1 in the present embodiment allows appropriate image printing characteristics to be achieved even when the adhesive layer 1012 is formed on the surface on which an image is printed by ink jet printing. In FIG. 3A, a line 1004 is an axis passing through a landing point of the ink droplet, and a line 1005 is an axis passing through the ink contact point P1. In FIG. 3B, a line 1006 is an axis passing through the center of the ink dot.

[1-2] Area of the Exposed Portions of the Ink Receiving Layer

In the present invention, for the area of the exposed portions of the ink receiving layer, the ratio (area ratio) of the area of the exposed portions to the area of the entire surface of the ink receiving layer may be adjusted so as to adjust an area factor to approximately 100% with the viscosity, the surface tension, the permeability anisotropy, and the like of the ink taken into account. For example, as is known, when the ink isotropically permeates the ink receiving layer, the spread rate of aqueous ink that can be stably ejected using the ink jet printing system is approximately doubled, and the diameter of an ink droplet is approximately doubled upon permeating the ink receiving layer after landing thereon. The diameter of the ink droplets having permeated the ink receiving layer increases through the ink receiving layer by approximately 25% in the horizontal direction. Thus, given the area ratio of the exposed portions of the ink receiving layer is 50% or more, setting the area factor to approximately 100% provides dense images with no void. When the ink permeability in the horizontal direction is higher than the ink permeability in the thickness direction, the area ratio of the exposed portions of the ink receiving layer may be less than 50%. When the ink permeability in the horizontal direction is lower than the ink permeability in the thickness direction, the area ratio of the exposed portions of the ink receiving layer may be more than 50%.

When the color material of the ink is a pigment and is separated into solids and liquids on the surface of the ink receiving layer and is thus likely to remain on the surface while being unlikely to permeate the ink receiving layer, the area of the exposed portions of the ink receiving layer may be adjusted to be further increased with the area factor taken into account. Alternatively, the air gaps in the ink receiving layer may be increased in size to facilitate permeation of the color material through the ink receiving layer.

To perform ink jet printing so as to adjust the area factor to approximately 100%, setting the thickness of the ink receiving layer such that the ink receiving layer has an absorption capacity enough to completely absorb the ink having landed on the ink receiving layer. When the gap-absorbing ink receiving layer has an ink absorption time of the order of approximately seconds, since the rate of ink vaporized is approximately several percents, vaporization of the ink does not substantially affect absorption of the ink into the ink receiving layer. With only the absorption of the ink through the air gaps in the ink receiving layer taken into account, monochrome printing is assumed to be performed within the ranges of the ink and the ink receiving layer assumed to be used, with the gap-absorbing ink receiving layer having an absorptance of 80%. In this case, to allow one ink droplet of 2 pl or 4 pl to land on the ink receiving layer and to be completely absorbed, the thickness I of the ink receiving layer may be set sufficiently larger than approximately one third of the diameter D of the assumed ink droplet. For multicolor printing, ink for two or three colors needs to be received, and thus, the thickness I of the ink receiving layer may be further increased to approximately two-thirds of the diameter D of the assumed ink droplet or may be set larger than the diameter D of the ink droplet.

[1-3] Structure of the Adhesive Layer (Adhesive)

In the structure in which the adhesive layer is formed on the ink receiving layer and in which the adhesive pieces of the adhesive layer are discretely provided, the area of the exposed portions of the ink receiving layer and the area of the adhesive portions of the adhesive layer which are contacted by the front layer of the ink receiving layer are preferably set as follows. That is, preferably, the area of the exposed portions of the ink receiving layer, which absorbs the ink, is maximized, whereas the area of the adhesive portions, which do not substantially absorb the ink or which absorb the ink but only at low absorption speed, is minimized. When the area of the adhesive portions which adhere to the front layer of the ink receiving layer is minimized, the area of the exposed portions of the ink receiving layer is maximized, allowing a large amount of ink to be quickly absorbed.

Figure 4A:
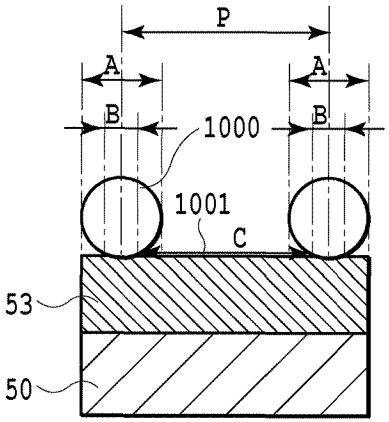
FIGS. 4A to 4E are diagrams illustrating a relation between the shape of adhesive pieces and an exposed portion of the ink receiving layer.
Figure 4B:
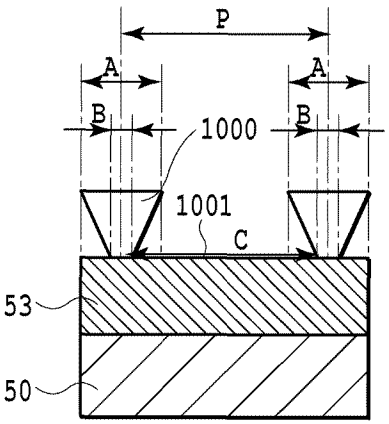
Figure 4C:
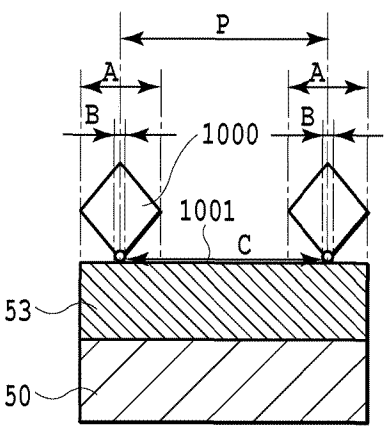
Figure 5:
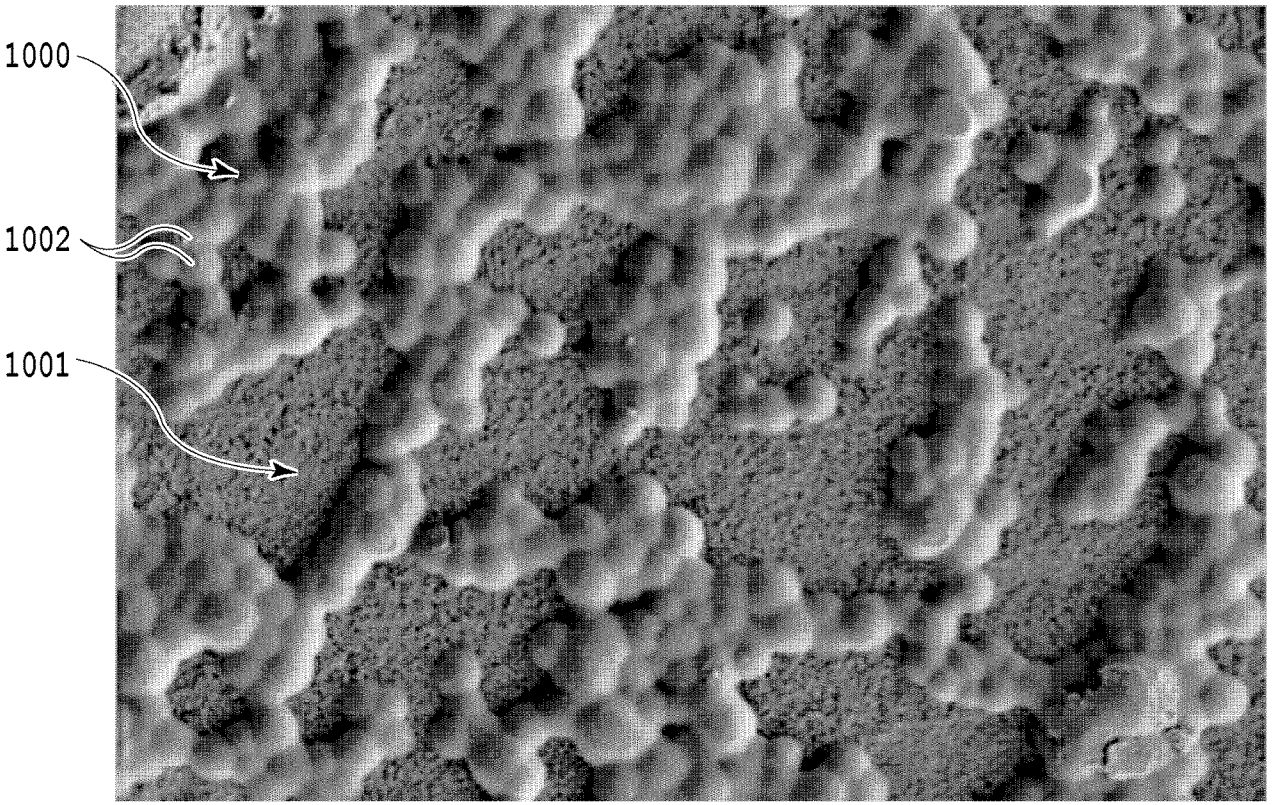
FIG. 5 is an SEM image of a transfer material surface on which ink jet printing has not been performed yet.

For example, as depicted in FIG. 4A, FIG. 4B, and FIG. 4C, when the area of a portion of the adhesive 1002 that contacts the front layer of the gap-absorbing ink receiving layer 53 is denoted by B, and the area of the adhesive 1002 as directly seen when the transfer material is viewed from the printing surface side is denoted by A, the area B is set smaller than the area A. The area A corresponds to the projection area of the adhesive 1002 as projected in the thickness direction of the adhesive layer 1012. FIG. 4A, FIG. 4B, and FIG. 4C depict examples in which particles of the adhesive 1002 are shaped like a circle, a triangle, and a rhombus, respectively, in section. FIG. 5 depicts an SEM image of the surface of the transfer material in which the adhesive layer is formed of adhesives 1002 having circular cross section particles. Setting the area B smaller than the area A allows the adhesion to be strengthened while maximizing an area C of the exposed portion 1001 of the ink receiving layer 53 so as to allow a large amount of ink to be quickly absorbed. The exposed portion 1001 of the ink receiving layer 53 corresponds to all of that area of the surface of the ink receiving layer 53 which does not directly contact the adhesive 1002. The exposed portion 1001 includes an area of the ink receiving layer 53 that does not contact the adhesive 1002 but that is covered with the adhesive 1002. Therefore, the exposed portion 1001 also includes an area of the ink receiving layer 53 over and away from which the particulate adhesive 1002 is positioned.

In the transfer material in which the area B is set smaller than the area A, during ink jet printing, the ink having landed on the adhesive layer is more likely to flow down to a portion of the ink receiving layer 53 located under the adhesive 1002. That is, when the area B of the portion of the adhesive 1002 that contacts the front layer of the ink receiving layer 53 is minimized, after ink jet printing, the ink having landed on the adhesive layer flows down even to that area of the exposed portion 1001 of the ink receiving layer 53 over and away from which the adhesive 1002 is positioned. The ink having flowed to the exposed portion 1001 of the ink receiving layer 53 permeates the bottom of the adhesive 1002 while spreading around the ink contact point P1 where the ink has come into contact with the exposed portion 1001 of the ink receiving layer 53, in accordance with the permeability anisotropy of the ink receiving layer 53. The ink droplet thus spreads in the horizontal direction to enable the entire area of the ink receiving layer 53 corresponding to the ink droplet to be covered with the ink. This inhibits possible to provide images with no void and makes the image density unlikely to decrease, enhancing image printing characteristics. In particular, when the ink is pigment ink and the color material of the ink is separated into solids and liquids on the surface of the ink receiving layer 53 and is thus likely to remain on the surface of the ink receiving layer 53, the exposed portion 1001 is effectively enlarged to an area over and away from which the adhesive 1002 is positioned. The structure of the exposed portion 1001 may be adjusted with the adhesion and the area factor taken into account. The air gaps in the ink receiving layer 53 may be enlarged to allow the color material to easily permeate the ink receiving layer 53. For example, if the color material of the ink is a pigment, when the area of the portion of the adhesive 1002 that contacts the front layer of the ink receiving layer 53 is reduced, after ink jet printing, the ink flows down even to that area of the exposed portion 1001 of the ink receiving layer 53 over and away from which the adhesive 1002 is positioned. This enables an increase in the area factor and thus allow enhancement of the image density.

On the other hand, in the structure in which the adhesives of the adhesive layer are discretely disposed on the ink receiving layer, the area of a surface of the adhesive that contacts the image substrate is preferably maximized in order to enhance the adhesion between the ink receiving layer and the image substrate. To allow the color material to easily flow down to the bottom of the adhesive and to strengthen the adhesion, the area B of the portion of the adhesive that contacts the ink receiving layer may be set smaller than the area A of the adhesive 1002 as directly seen when the transfer material is viewed from the printing surface side. That is, setting the area A larger than the area B allows the adhesion to be strengthened without degrading ink absorptivity. Given the thickness of the adhesive is increased or the area of the portion of the adhesive that contacts the surface of the ink receiving layer is increased in order to strengthen the adhesion, a portion of the ink having landed on the adhesive layer during ink jet printing is precluded from coming into instantaneous contact with the ink receiving layer. Thus, the ink absorption speed may decrease.

[1-4] Shape of the Adhesive

Figure 4D:
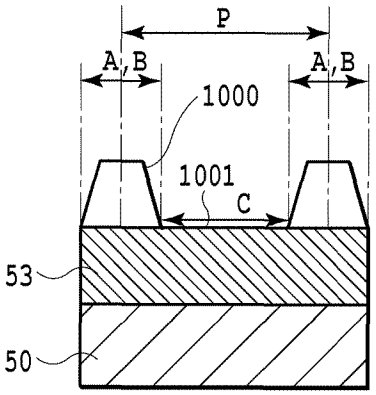
Figure 4E:
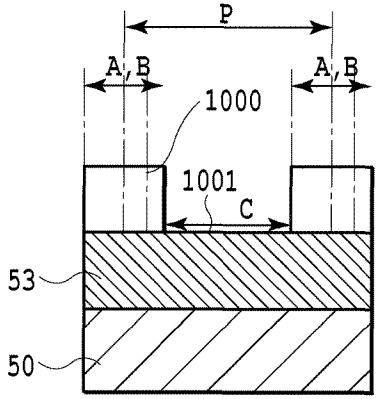

The shape of the adhesive portion is determined by the shape of the adhesives contained in the adhesive portion. Thus, the shape of the adhesive may be selected to allow the color material of the ink to flow down to the portion of the ink receiving layer located under the adhesive portion. As described above, to allow the ink to be appropriately absorbed, the area B of the portion of the adhesive that contacts the front layer of the gap-absorbing ink receiving layer is preferably minimized. To achieve this, adhesive pieces may be used which are based on particle shapes as depicted in FIG. 4A, FIG. 4B, and FIG. 4C or which are based on a polygonal shape. The use of such adhesive pieces allows the ink absorptivity to be maximized while maximizing the area of the exposed portions of the gap-absorbing ink receiving layer, with appropriate adhesion maintained. The adhesives preferably have a particle shape that allows the adhesives to be more effectively and efficiently produced without the need for a special orientation process. Examples of the adhesives based on such a particle shape include resin particles and resin emulsions containing resin particles uniformly dispersed in a solvent such as water. Like such a particle shape, a high-order polyhedron is preferably used. However, for adhesives based on a polyhedral shape as depicted in FIG. 4D and FIG. 4E, the area A is precluded from being larger than the area B, and the area of the exposed portions of the gap-absorbing ink receiving layer is precluded from being maximized. In such a case, a special orientation operation for controlling arrangement of the adhesives is needed.

[1-5] Area Ratio of the Adhesive Layer

To allow the ink to be appropriately absorbed, the horizontal size of the island-like adhesive portions contained in the adhesive layer is preferably controlled with the range of variation in the diameter of the assumed ink droplet taken into account such that the ink inevitably hangs sufficiently out from the adhesive layer and into the exposed portion of the ink receiving layer. To extend the ink having landed on the adhesive out from the adhesive, it is important to controllably set the diameter (landing diameter) of an ink droplet having landed on the adhesive smaller than the horizontal diameter of the adhesive and the adhesive portion, with the range of the diameter of the assumed ink droplet taken into account. As described below, the size of each adhesive portion may be set smaller than the landing diameter of the assumed ink droplet, the adhesive portions may be sufficiently discretely arranged like islands, and the ratio (area ratio) of the area of the adhesive layer as directly viewed from the printing surface side to the total surface area of the ink receiving layer may be set to 50% or less. Importantly, with the viscosity and surface tension of the assumed ink taken into account, the ink having landed on the adhesive portion is spread out from the adhesive portion and into the corresponding exposed portion of the ink receiving layer. When the ink having landed on the adhesive portion inevitably hangs out from the adhesive portion and into the corresponding exposed portion of the ink receiving layer, a portion of the ink comes into contact with the exposed portion of the ink receiving layer and is dragged into the gap-absorbing ink receiving layer, which absorbs the ink at high ink absorption speed. Consequently, the ink is autonomously and appropriately absorbed into the ink receiving layer and is unlikely to remain on the surface of the adhesive layer and inside the adhesive layer.

Figure 8:
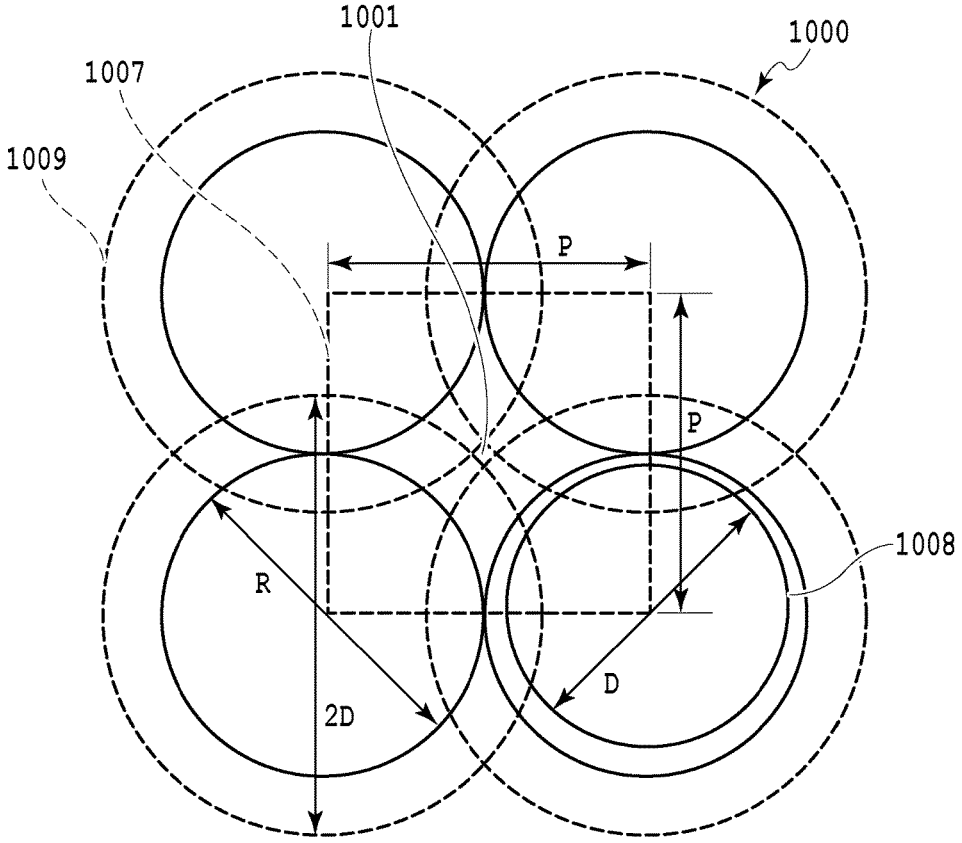
FIG. 8 is a diagram illustrating an area ratio of adhesive portions of an adhesive layer.
Figure 9:
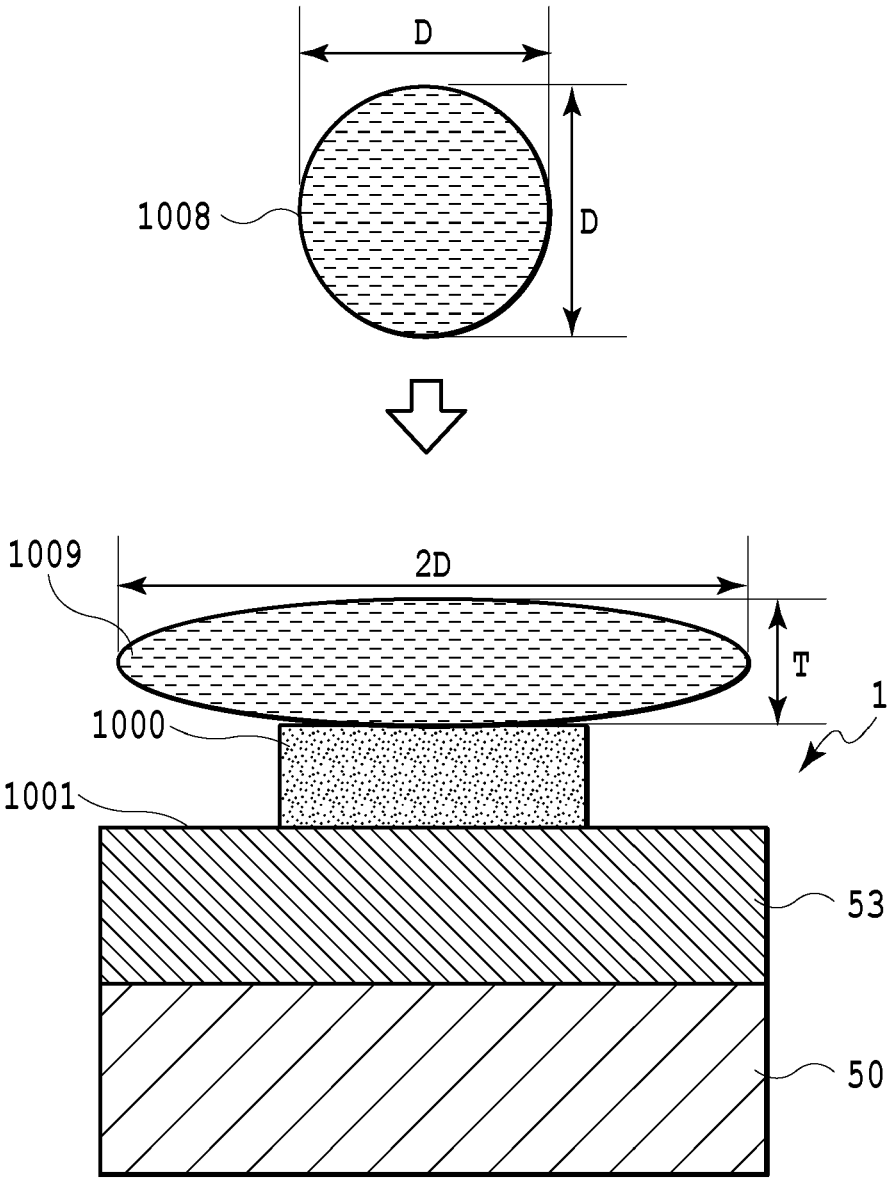
FIG. 9 is a diagram of ink having landed on the adhesive layer.
Figure 10B:
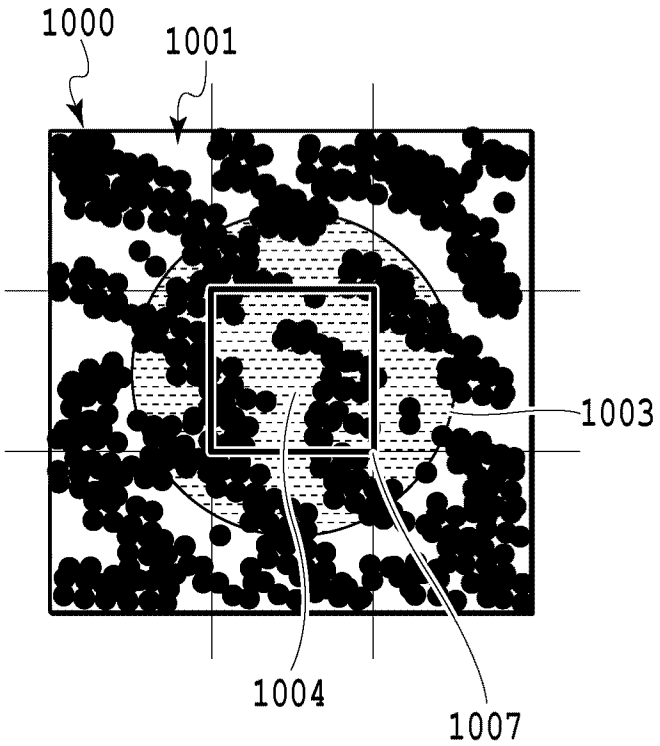
FIG. 10A and FIG. 10B are diagrams illustrating a probability density of exposed portions of the ink receiving layer.
Figure 10A:
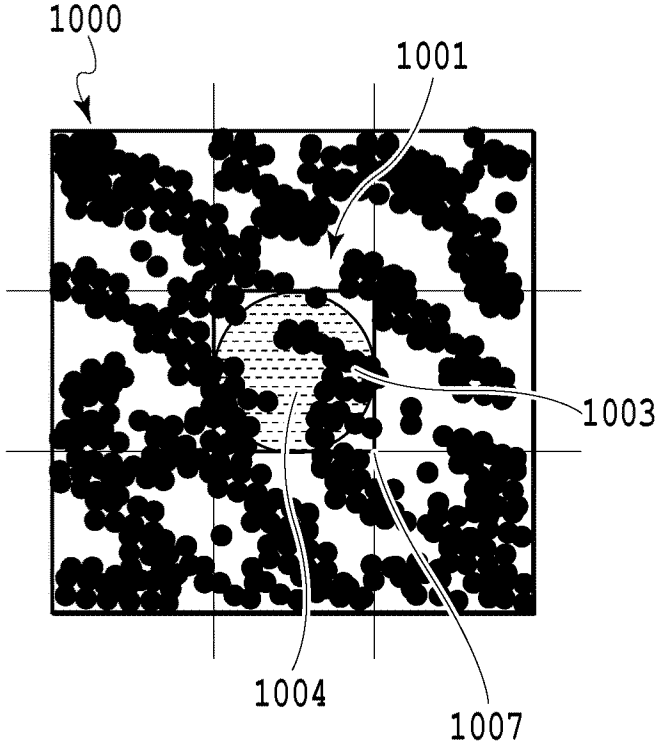

FIGS. 8 to 10 are diagrams illustrating the area ratio of the adhesive layers. FIG. 8 is a diagram depicting the adhesive portions 1000 as viewed from the printing surface side. In FIG. 8, a case is assumed where a plurality of the particulate adhesive pieces 1002 are aggregated into a cylindrical form to form the adhesive portion 1000 and where the ratio (area ratio) of the area of the adhesive portions as directly seen from the printing surface side to the total surface area of the ink receiving layer is set to 50%. When the area ratio of the adhesive portions is 50% or less, the virtual diameter R of the adhesive portion 1000 is smaller than approximately 0.8 times as large as the length of one side P of one pixel in an assumed print image.

In FIG. 8, a case is assumed where aqueous ink is used which can be stably ejected using an ink jet printing apparatus and where ink droplets from the ink jet printing apparatus land on the adhesive layer material and spread. In spite of the effects of an ejection speed for ink droplets, the viscosity of the ink, and the surface tension of the ink, the diameter of the ink droplet 1009 having landed on the adhesive layer is approximately twice as large as the diameter of the ink droplet 1008 not having landed on the adhesive layer. As depicted in FIG. 9, the thickness T of the ink droplet 1009 having landed on the adhesive layer is approximately one-sixths of the diameter D of the ink droplet 1008 not having landed on the adhesive layer.

Thus, the diameter of the ink droplet having landed on the adhesive layer is approximately twice as large as the diameter D of the ink droplet not having landed on the adhesive layer. Therefore, to determine an area factor that allows the entire printing surface to be covered with the ink, the diameter D of the ink droplet 1008 may be set larger than approximately 0.7 times as large as the length of the length of one side P of one pixel in the print image.

As depicted in FIG. 8, when the adhesive portions 1000 are discretely arranged so as to have an area ratio of 50% or less, the diameter R of the virtual cylinder of the adhesive portion 1000 is substantially the same as or smaller than the diameter D of the ink droplet. As described above, since the impact of landing causes the ink droplet to spread by factor of approximately two in the horizontal direction, the ink droplet can sufficiently hang out from the adhesive portion and into the corresponding exposed portion of the ink receiving layer.

As described above, when the area ratio of the adhesive portions is set to 50% or less, the size of each of the adhesive portions discretely arranged like islands is smaller than the landing diameter of the ink droplet having landed on the adhesive portion. In spite of the effects of the viscosity and the surface tension of the ink, a portion of the ink can inevitably be spread out from the adhesive portion and into the corresponding exposed portion of the ink receiving layer. When the portion of the ink comes into contact with the exposed portion of the ink receiving layer, the ink is autonomously absorbed, in a dragging manner, into the exposed portion of the gap-absorbing ink receiving layer, which absorbs the ink at high absorption speed. Therefore, the ink can be appropriately absorbed, and can be made unlikely to remain on the surface of the adhesive or inside the adhesive.

[1-6] Thickness of the Adhesive Layer

To allow the ink having landed on the adhesive portion to be autonomously absorbed into the corresponding exposed portion of the ink receiving layer in a dragging manner, the thickness of the adhesive layer is preferably controlled so as to prevent the ink from being broken off when a portion of the ink having spread after landing hangs out from the adhesive portion and into the exposed portion of the ink receiving layer. That is, preferably, with the viscosity and the surface tension of the ink taken into account, the thickness of the adhesive layer is controlled so as to prevent break-off of the ink on the adhesive layer and the ink in contact with the exposed portion of the ink receiving layer.

Figure 11A:
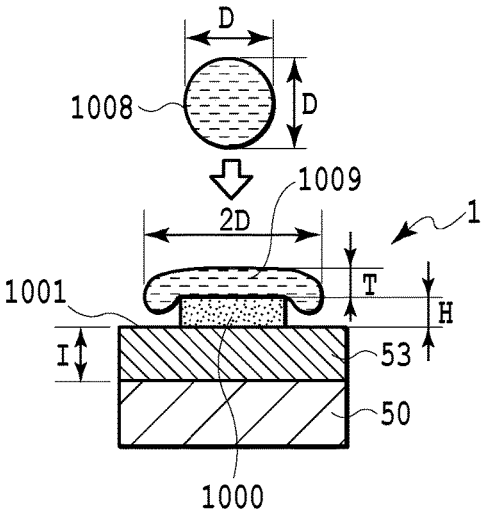
FIGS. 11A to 11F are diagrams illustrating the thickness of the adhesive portion.
Figure 11B:
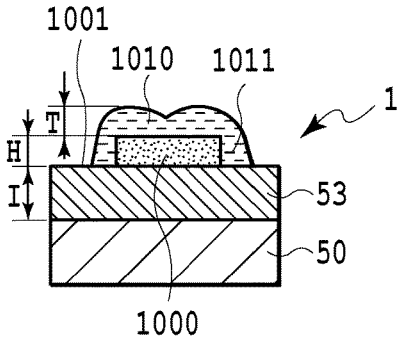
Figure 11C:
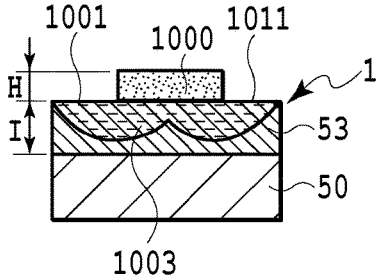

In FIGS. 11A to 11F, a case is assumed where the ink 1008 has landed on the adhesive portion 1000 formed by aggregating the adhesive pieces 1002 together in a cylindrical form, and the ink 1008 spreads in a cylindrical form. In this case, to prevent break-off of the ink on the adhesive portion 1000 and the ink in contact with the exposed portion 1001 of the ink receiving layer 53, the thickness H of the adhesive portion 1000 may be set smaller than the thickness T of the ink droplet 1009 having landed on the adhesive portion 1000, though the thicknesses also depend on the viscosity and the surface tension of the ink. Thickness H corresponds to the thickness of the adhesive layer and is thus also referred to as the thickness H of the adhesive layer. As depicted in FIG. 11A, FIG. 11B, and FIG. 11C, when the thickness H of the adhesive layer is set smaller than the thickness T of the ink droplet 1009, the ink droplet 1009 is absorbed into the ink receiving layer 53 without being broken off. As described above, given aqueous ink, which can be stably ejected, has landed and spread in a cylindrical form, the thickness T of the ink having landed is approximately one-sixths of the diameter D of the ink droplet not having landed, due to the impact of the landing, though the thickness T and the diameter D depend on the ejection speed for ink droplets, the viscosity of the ink, the surface tension of the ink, and the like. Therefore, to prevent the ink on the adhesive portion 1000 and the ink in contact with the exposed portion 1001 from being broken off, the thickness H of the adhesive portion 1000 may be prevented from exceeding the double of the thickness T of the ink droplet deformed upon landing, with elongation of the ink based on the surface tension and viscosity of the ink taken into account. Consequently, after the ink lands on the adhesive and hangs out from the adhesive and before the ink further elongates and is broken off, a portion of the ink can come into contact with the surface of the ink receiving layer. As described above, when the adhesive pieces are sufficiently discretely arranged so as to have an area ratio of 50% or less, the diameter R of a virtual cylinder of the adhesive is smaller than a value 0.8 times as large as the length P of an assumed pixel. If a cylinder of the ink formed by the impact of landing of an ink droplet spreads to a diameter double the diameter D of the ink droplet, leading to an area factor of 100% or more, then the diameter of the cylinder of the ink is larger than a value 1.4 times as large as the length P of the assumed pixel. That is, the diameter of the ink having spread after landing is substantially double the diameter of the virtual cylinder of the adhesive. The ink having spread to a diameter approximately double the diameter D hangs out from the virtual cylinder of the adhesive formed to a diameter substantially equal to the diameter D. The amount of the hang-out is such that the diameter corresponds to half of the diameter D and that the thickness T corresponds to approximately one-sixths of the diameter D. Thus, when the thickness H of the adhesive is set smaller than approximately one-third of the diameter D, a portion of the ink hanging out from the adhesive can come into quick contact with the exposed portion of the ink receiving layer of the sea portion, which exhibits high ink absorption characteristics.

On the other hand, importantly, the thickness of the ink receiving layer is set to provide an absorption capacity sufficient to completely absorb the ink having landed on the adhesive. Given the time needed for the gap-absorbing ink receiving layer to absorb the ink is of the order of approximately seconds, the rate of ink vaporized is only approximately several percents, and this does not substantially affect the ink absorption. Now, only the absorption of the ink through the air gaps in the ink receiving layer is taken into account, and monochrome printing is performed with the absorptance of the gap-absorbing ink receiving layer set to 80%. In this case, to allow one 2 pl or 4 pl ink droplet to land on the adhesive and to be completely absorbed, the thickness I of the ink receiving layer may be set larger than approximately one-third of the diameter D of the assumed ink droplet.

Based on the relation between the thickness H of the adhesive layer and the diameter D of the ink droplet and the relation between the thickness I of the ink receiving layer and the diameter D of the ink droplet, the thickness of the adhesive layer and the thickness I of the ink receiving layer have the following relation for monochrome printing. To allow the ink to be completely absorbed, the thickness I of the ink receiving layer may be set sufficiently larger than approximately one-third of the diameter D of the ink droplet, and the thickness H of the adhesive portion may be set smaller than approximately one-third of the diameter D. Then, a portion of the ink having landed on the adhesive can reach the ink receiving layer without being broken off. Therefore, the thickness H of the adhesive portion may be set smaller than the thickness I of the ink receiving layer.

Thus, in monochrome printing, when the thickness H of the adhesive portion is set smaller than the thickness I of the ink receiving layer according to the size D of the assumed ink droplet, the thickness H of the adhesive portion can be made smaller than the thickness T of the ink droplet having landed on the adhesive portion. Consequently, in spite of the effects of the viscosity and the surface tension of the ink, appropriate ink absorptivity can be achieved by preventing the ink on the adhesive portion and the ink in contact with the exposed portion of the ink receiving layer from being broken off when the ink having spread after landing hangs out from the adhesive portion. Since the ink is less likely to remain on the surface of the adhesive portion and inside the adhesive portion, the adhesion can be strengthened. For multicolor printing, the ink receiving layer needs to be thicker according to the number of ink colors. The restriction on the thickness of the adhesive for preventing individual ink droplets from being broken off remains unchanged. Consequently, the thickness H of the adhesive needs to be sufficiently small compared to the thickness I of the ink receiving layer. When the gap-absorbing ink receiving layer is assumed to have an ink absorptance of 80% and ink in two or three colors is assumed to be received, the thickness I of the ink receiving layer may be set smaller than approximately half or one-third of the thickness I of the ink receiving layer.

Figure 11D:
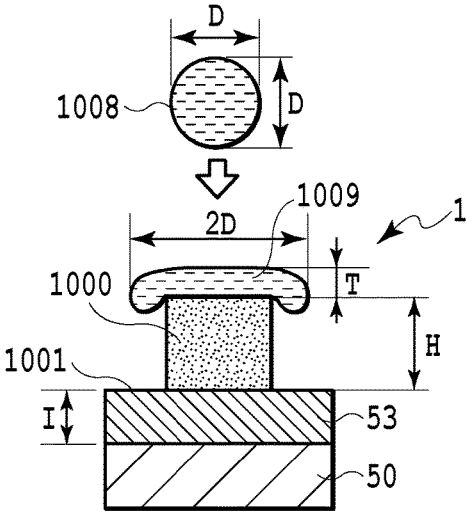
Figure 11E:
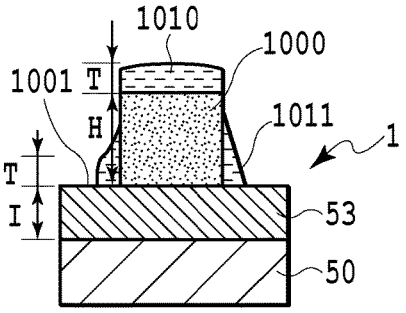
Figure 11F:
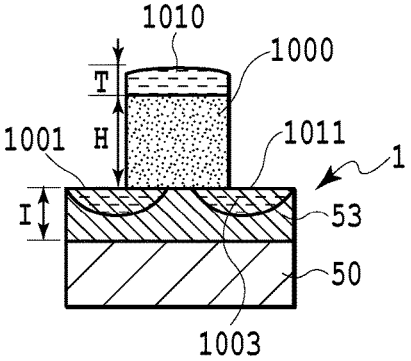

As depicted in FIG. 11D, FIG. 11E, and FIG. 11F, when the thickness H of the adhesive layer is larger than the double of the thickness T of the ink droplet, the ink may be broken off at a boundary between the adhesive layer and the exposed portion of the ink receiving layer. Thus, the ink on the surface of the adhesive layer fails to be dragged into the exposed portion of the ink receiving layer, and the ink may remain on the surface of the adhesive layer, resulting in inappropriate adhesion.

When the ink color material is a pigment, the ink may be separated into solids and liquids after ink jet printing, with the color material remaining on the surface of the ink receiving layer. In such a case, the thickness of the adhesive may be adjusted so as to allow the color material remaining on the surface of the ink receiving layer to be covered with the adhesive during attachment. As described above, setting a predetermined porosity for the ink receiving layer allows the ink receiving layer to receive all of the ink in a single color or in a plurality of colors. When the gap-absorbing ink receiving layer has an absorptance of 80%, the thickness I of the ink receiving layer is set sufficiently larger than one-third of the diameter D of the ink droplet for monochrome printing, and the thickness I of the ink receiving layer is set equal to two-thirds of or larger than the diameter D of the ink droplet for multicolor printing.

Furthermore, a case is assumed where the ink is formed of pigment and separated into solids and liquids on the surface of the ink receiving layer, with all of the solids and the liquids remaining on the surface of the ink receiving layer. Aqueous ink that can be stably ejected using the ink jet printing system normally has a concentration of solids such as pigment of 10% or less. Thus, the volume of the solids remaining on the surface of the ink receiving layer as a result of solid-liquid separation is approximately 8% of the volume of the ink. If the exposed portion of the ink receiving layer, corresponding to the sea portion, can receive the ink such that the remaining color material is located below the height H of the adhesive portion, corresponding to the island portion, the remaining color material is unlikely to be a factor that affects the adhesion. When the height of the island portion (the height H of the adhesive) is slightly larger than six-hundredths of the thickness I of the ink receiving layer, all of the color material in a single color can be contained in the exposed portion of the ink receiving layer. As a result, the color material is prevented from extending up above the height of the adhesive, and the color material remaining on the front layer of the ink receiving layer is prevented from acting as a factor that affects the adhesion. Therefore, appropriate adhesion can be achieved. In actuality, a part of the surface of the ink receiving layer is covered with the adhesive, slightly increasing the thickness of the solids remaining on the surface of the ink receiving layer. Thus, preferably, the height of the adhesive may be set larger than seven-hundredths of the thickness I of the ink receiving layer. In color printing, given the ink is in two or three colors, the thickness H of the ink receiving layer needs to be increased, and the thickness of the adhesive needs to be increased at substantially the same rate as that at which the thickness H is increased because of an increased amount of solids remaining on the surface of the ink receiving layer. In such a case, the height H of the adhesive may be set larger than seven-hundredths of the thickness of the ink receiving layer.

The adhesion can further be strengthened by covering the color material remaining on the front layer of the ink receiving layer with a sufficient amount of adhesive melted during thermocompression bonding to form the melted adhesive into an adhesive film. For example, when pigment ink with a pigment concentration of 10% is used, firm adhesion can be achieved by setting the thickness H of the adhesive portion larger than one-tenth of the thickness of the ink receiving layer. As described above, to bring the ink having just landed on the adhesive portion to into quick contact with the exposed portion of the ink receiving layer to allow substantially all of the liquid component of the ink to be absorbed into the ink receiving layer, the thickness H of the adhesive portion may be set smaller than approximately half or one-third of the thickness I of the ink receiving layer. Therefore, when ink such as pigment ink is used which contains solids such as a color material which are likely to remain on the front layer of the ink receiving layer, the porosity of the gap-absorbing ink receiving layer may be set to 80%, and given the ink in two-three colors is received, the thickness H of the adhesive portion may be set to approximately seven-hundredths to half of the thickness I of the ink receiving layer as described above.

More preferably, sufficient adhesion can be achieved by setting the height H of the adhesive layer within the range of one-tenth to one-third of the thickness I of the ink receiving layer. That is, printing is assumed to be performed under the following conditions: the volume of the ink droplet is 2 to 4 pl, the gap-absorbing ink receiving layer has a porosity of 80%, and a color image is printed. Then, preferably, the thickness I of the ink receiving layer is approximately 8 to 16 μm, and the thickness H of the adhesive portion is approximately 0.5 μm to 8 μm. With an environment-related variation in the volume of the ink droplet and a manufacturing variation in the porosity of the ink receiving layer taken into account, the thickness H of the adhesive portion is more preferably 1 μm to 5 μm. When the ink has a pigment concentration of approximately 5%, the thickness H of the adhesive layer is preferably approximately three-hundredths to half of the thickness I of the ink receiving layer. That is, printing is assumed to be performed under the following conditions: the volume of the ink droplet is 2 to 4 pl, the gap-absorbing ink receiving layer has a porosity of 80%, and a color image is printed. Then, preferably, the thickness I of the ink receiving layer is approximately 8 to 16 μm, and the thickness H of the adhesive portion is approximately 0.3 μm to 8 μm. With an environment-related variation in the volume of the ink droplet and a manufacturing variation in the porosity of the ink receiving layer taken into account, the thickness H of the adhesive portion is more preferably 0.5 μm to 5 μm.

Even when the pigment ink is separated into solids and liquids on the ink receiving layer, appropriate adhesion can be achieved even with a further reduced thickness H of the adhesive layer if the air gaps in the gap-absorbing ink receiving layer are each larger than a pigment dispersing element to allow the pigment dispersing element itself to slightly permeate the front layer of the ink receiving layer. When the pigment is a resin dispersing pigment, appropriate adhesion can be achieved without completely covering the pigment with the adhesive if the dispersing resin has a melting temperature lower than an adhesion temperature. This is because, in this state, the dispersing resin contributes to the adhesion. In this case, the thickness of the adhesive may be smaller than the above-described values.

If the top surface of the adhesive portion does not have a flat shape but has an inclined surface that allows the ink droplet having landed on the adhesive portion to smoothly fall down along the surface of the adhesive portion, the height of the adhesive portion may be partly larger than the above-described thickness. In short, any configuration may be used so long as the ink is unlikely to remain on the surface of the island-like adhesive and a portion of the ink droplet having landed on the adhesive comes into quick contact with the exposed portion of the ink receiving layer without being broken off so that the ink droplets are autonomously absorbed.

For dye ink, the color material is unlikely to remain on the surface of the ink receiving layer, the thickness of the adhesive portion may be reduced. For example, with a manufacturing variation among ink receiving layers taken into account, the thickness of the adhesive portion is preferably set equal to or larger than the particle size of the inorganic particulates in order to fill the surface of the ink receiving layer with a sufficient amount of adhesive pieces so as to absorb the unevenness of the surface of the ink receiving layer. When each adhesive particle is smaller than each inorganic particulate and each air gap in the adhesive portion are smaller than each air gap in the ink receiving layer, the ink absorption speed of the adhesive portion is higher than the ink absorption speed of the ink receiving layer. This precludes the ink from being absorbed in a bypassing manner, with the ink likely to remain inside the adhesive portion. When the ink remains inside the adhesive portion, the adhesive portion may collapse during transfer, moisture and solvent components in the ink may seep through the adhesive surface to hinder the adhesion. Even if the dye ink contains a color material that is unlikely to remain on the surface, each adhesive particle is preferably larger than each inorganic particulate in the ink receiving layer in view of ink absorption and adhesion.

In short, any configuration may be used so long as the transfer material and the image substrate can be appropriately attached to each other. The thickness of the adhesive layer and the thickness of the ink receiving layer may be adjusted according to the porosity of the ink receiving layer, the color material of the ink used and the concentration of the color material, and the type of a print image (a monochrome image, a color image, or the like).

In the attachable and transferable transfer material in the present embodiment, the sea portions, which permit bypassing passage of the ink, can provide a second function as a storage that stores solids such as color materials remaining on the surface of the ink receiving layer as a result of separation of pigment ink into solids and liquids, to prevent the solids from hindering the adhesion function of the island-like adhesive pieces. The sea portions of the adhesive layer may function as an air outlet through which, during attachment and transfer of the transfer material to the image substrate or the like, air is discharged to the outside when air reservoirs are inadvertently generated between the image substrate and the adhesive layer that are in close contact with each other. Since the gap-absorbing ink receiving layer is configured to substantially maintain the gap structure during attachment as described above, even if the adhesive layer is slightly collapsed when brought into close contact with the image substrate to compress the air in the sea portions, a certain amount of the air can be absorbed through the air gaps in the ink receiving layer.

When the adhesive layer and the image substrate are brought into contact with each other, if large air reservoirs are generated due to a difference in flatness, extendibility, or contact pressure between the adhesive layer and the image substrate, the air may be precluded from being sufficiently absorbed through the air gaps in the ink receiving layer. In that case, after attachment and transfer of the transfer material, air reservoirs may be generated on the surface of the transfer material or the adhesion may be weakened due to a difference in adhesive force. In such a case, when the adhesive layer and the image substrate are brought into close contact with each other, the island portions of the adhesive layer, which are in communication with one another, may be collapsed to sequentially discharge the air in the air reservoirs inadvertently generated in the contact areas to non-contact portions between the adhesive layer and the image substrate. Depending on the intended use of the transfer material or the printed material, small parts of the collapsed sea portions may remain as air gaps that are in communication with one another. Since the gap-absorbing ink receiving layer is disposed all over the surface of the attachable transfer material in the present embodiment, the air in the inadvertently generated air reservoirs can be discharged to ends of the transfer material or the sea portions in the non-contact portions by the air discharge effect of the sea portions that are in communication with one another, in combination with the effect of the air gaps in the ink receiving layer that are in communication with one another. That is, when the adhesive pieces are discretely disposed on the surface of the ink receiving layer like islands to form, in the adhesive layer, sea portions that are substantially in communication with one another, the sea portions provide a third function to discharge air when the adhesive layer and the image substrate are brought into close contact with each other, along with the air gaps in the ink receiving layer that are in communication with one another.

If, in the adhesive portion, the adhesive particles partly aggregate to form sub-particles, air gaps are formed which are unlikely to transmit liquids such as the ink but likely to transmit air. Thus, before the adhesive pieces are melted, the air in the air reservoirs can be discharged via the air gaps in the adhesive layer. A supplementary effect for the third function of the sea portions can be expected.

For the above-described third function of sea portions, the use of adhesive pieces shaped like spherical or high-order polyhedral particles is effective. When the adhesive pieces are discretely formed like islands in an appropriate area ratio, effective islands can be reliably formed in the adhesive layer. If the adhesive particles partly aggregate to form sub-particles in the adhesive portion, air gaps that are unlikely to transmit liquids such as the ink but likely to transmit air are formed in the adhesive portion. The air gaps in the adhesive portion are expected to be effective for discharging the air in the air reservoirs. Consequently, particulate adhesive pieces are preferably used.

[1-7] Particle Size of the Adhesives

The average particle size of the adhesives is not particularly limited but is preferably set so as to meet the following two conditions.

A first condition is that the ink having landed on the adhesive layer is dragged and absorbed into the corresponding exposed portions of the ink receiving layer without being broken off as described above. The average particle size of the adhesives is set so as to meet the condition. Specifically, the thickness of the adhesive layer is determined by the average particle size and the amount of the adhesives, the average particle size of the adhesives is preferably set so as to make the thickness of the adhesive portion smaller than the thickness of the ink receiving layer. For color printing, the average particle size of the adhesives may be set so as to make the thickness of the adhesive portion smaller than one-third of the ink receiving layer. When the adhesives are contained in an adhesive portion with a plurality of layers, the average particle size of the adhesives may further be reduced. A second condition is that ink absorptance is prevented from decreasing as result of filling of the air gaps with the adhesives having failed to infiltrate through the air gaps in the ink receiving layer. The average particle size of the adhesives is set so as to meet the condition. That is, the average particle size of adhesives is preferably set so as not to be smaller than the gap size of the gap-absorbing ink receiving layer.

To meet the two conditions, the average particle size of the adhesives is preferably set to be larger than the air gap diameter of the ink receiving layer and equal to or smaller than the half of the thickness of the ink receiving layer to achieve both appropriate image printing and appropriate adhesion. If the adhesives are dispersed as a coating liquid, the adhesive particles are dispersed as substantially single particles. When the coating liquid is applied and formed into a film, the dispersion liquid vaporizes to increase the concentration of the adhesives. At the same time, the plurality of adhesive particles aggregate to discretely form adhesive portions like islands. Adhesion strength does not substantially vary between the single adhesive particles and the aggregated adhesive particles. However, when single adhesive particles form island-like adhesive portions in an isolated manner, each island portion has a low strength, and the island portions are sequentially destroyed during peel-off. Thus, peel-off strength is low. In contrast, when a plurality of adhesive particles aggregates to form island-like adhesive portions, each island portion has a higher peel-off strength than the island-like adhesive portion formed of an isolated single adhesive particle. The aggregated adhesive particles are thus excellent in peel-off strength.

When the color material of the ink is pigment, the average particle size and the amount of the adhesives may be adjusted so as to allow the color material remaining on the ink receiving layer as a result of solid-liquid separation after ink jet printing to be covered with the adhesives during attachment. For example, when the aqueous ink that can be stably ejected by ink jet printing has a pigment concentration of 10% or less and a certain amount of pigment is expected to permeate the ink receiving layer, the average particle size may be set to be larger than approximately one-tenth of the thickness of the ink receiving layer. When the pigment concentration is more than 10%, the average particle size may be set to be much larger than one-tenth of the thickness of the ink receiving layer. The average particle size and the amount of the adhesives may be adjusted depending on the pigment concentration of the ink used.

For monochrome pigment ink, the average particle size of the adhesives is preferably larger than the gap size of the ink receiving layer and larger than one-tenth of the thickness of the ink receiving layer and equal to or smaller than the thickness of the ink receiving layer. This allows both appropriate image printing and appropriate adhesion to be achieved. For color printing, the average particle size of the adhesives may be set larger than the gap size of the ink receiving layer and larger than one-tenth of the thickness of the ink receiving layer and smaller than one-third of the thickness of the ink receiving layer. If the pigment is a resin dispersing pigment, since the dispersing resin can contribute to adhesion when having a melting temperature lower than an adhesion temperature, the adhesion can be appropriately achieved without the need to completely cover the pigment with the adhesives. Thus, the thickness of the adhesives may be smaller than the above-described thickness. In short, any configuration may be used so long as the transfer material and the image substrate can be approximately attached to each other with the color material prevented from hindering the attachment. The thickness of the adhesive layer and the thickness of the ink receiving layer may be adjusted as needed according to factors such as the porosity of the ink receiving layer, the color material of the ink used and the concentration of the color material, and the type of printing (monochrome or multicolor).

Specifically, the average particle size of the adhesives is preferably larger than 10 nm and smaller than 5 μm. Setting the average particle size of the adhesives larger than 10 nm makes the particle size of the adhesive sufficiently larger than the gap size of the gap-absorbing ink receiving layer. Thus, the adhesives are unlikely to infiltrate through the air gaps in the ink receiving layer. Consequently, insufficient ink absorption can be prevented to allow the ink to be appropriately absorbed. Setting the average particle size of the adhesives smaller than 5 μm makes the thickness of the adhesive portion smaller than the thickness of the ink receiving layer. Thus, the ink having landed on the adhesive layer can be dragged and absorbed into the exposed portion of the ink receiving layer without being broken off. As a result, the ink is unlikely to remain on the surface of the adhesive layer or inside the adhesive layer, allowing the adhesion to be strengthened.

When the adhesives have an average particle size of 10 nm or less, the average particle size may be smaller than the gap size of the ink receiving layer. In this case, the adhesives infiltrate through the air gaps in the ink receiving layer, and the air gaps may be filled with the adhesive, resulting in inappropriate ink absorption. However, when being likely to aggregate, the particles of the adhesives aggregate to form large secondary particles even with an average particle size of 10 nm or less. Thus, the air gaps are prevented from being filled with the adhesives. Therefore, in such a case, the average particle size may be smaller than 10 nm. In short, depending on the property of the adhesive, the average particle size of the adhesives may be adjusted as needed so as not to fill the air gaps in the ink receiving layer.

When the adhesives have an average particle size of 5 μm or more, the thickness of the adhesive layer may be larger than the thickness of the ink receiving layer. In this case, when the ink lands on the adhesive portion, the ink is broken off at the boundary between the adhesive portion and the ink receiving layer to bring a portion of the ink into contact with the ink receiving layer. Thus, the ink on the surface of the adhesive portion is prevented from being dragged into the exposed portion of the ink receiving layer. Thus, the ink remains on the surface of the adhesive portion, leading to insufficient ink absorption. Furthermore, the ink, hindering the adhesion, is likely to remain on the surface of the adhesive portion and inside the adhesive portion, possibly weakening the adhesion. However, when adhesive pieces shaped to allow the ink to flow down along the adhesive pieces, in other words, spherical or polyhedral adhesive pieces, are used, even if the thickness of the adhesive portion is larger than the thickness of the ink receiving layer, the ink flows into the exposed portion of the ink receiving layer without being broken off. The ink is autonomously absorbed into the exposed portion. In such a case, the adhesives may have an average particle size of 5 μm or more. Conditions may be set as needed so as to allow a portion of the ink to flow into the exposed portion of the ink receiving layer without being broken off, according to the shape and property of the adhesive pieces and the surface tension and viscosity of the ink.

In short, to allow the ink to be appropriately absorbed, the adhesive layer may be discretely disposed on the ink receiving layer so that, upon landing on the adhesive layer, the ink comes into instantaneous contact with the exposed portion of the ink receiving layer without being broken off and is autonomously absorbed into the exposed portion in a dragging manner. In view of the appropriate adhesion, any configuration may be used so long as the transfer material and the image substrate can be appropriately attached to each other with the color material of the ink prevented from hindering the adhesion. The particle size of the adhesive may be adjusted as needed according to factors such as the porosity of the ink receiving layer, the color material of the ink used and the concentration of the color material, and the type of printing (monochrome or multicolor).

[1-8] Amount (Volume) of the Adhesives

The amount of the adhesive may be adjusted according to the intended use. For example, when a high adhesive force is needed, the amount of the adhesive is preferably such that the adhesive can absorb the unevenness of the adhesion surfaces of the image substrate and the ink receiving layer. More preferably, the amount of the adhesive and the adhesion area resulting from melting are adjusted so that, when the adhesive is melted during attachment, the adhesive can cover substantially an entire surface of the ink receiving layer to attach the entire surface to the image substrate. When only a weak adhesive force is needed, the area of the exposed portions of the ink receiving layer may be increased to enhance the characteristics of image printing with ink.

[1-9] Density of the Exposed Portions of the Ink Receiving Layer

The intervals at which the exposed portions of the ink receiving layer are arranged may be adjusted so as to set the area factor to substantially 100%. When the adhesive layer is discretely provided on the ink receiving layer, the surface of the ink receiving layer is covered with the adhesive layer, which does not absorb the ink or which absorbs the ink but at low absorption speed. Thus, the ink is unlikely to be absorbed through the surface of the ink receiving layer, which is in contact with the adhesive layer. Therefore, to maintain the area factor needed to form an image, it is important to arrange the exposed portions of the ink receiving layer, which serve as base points for ink absorption, at appropriate intervals.

Figure 12:
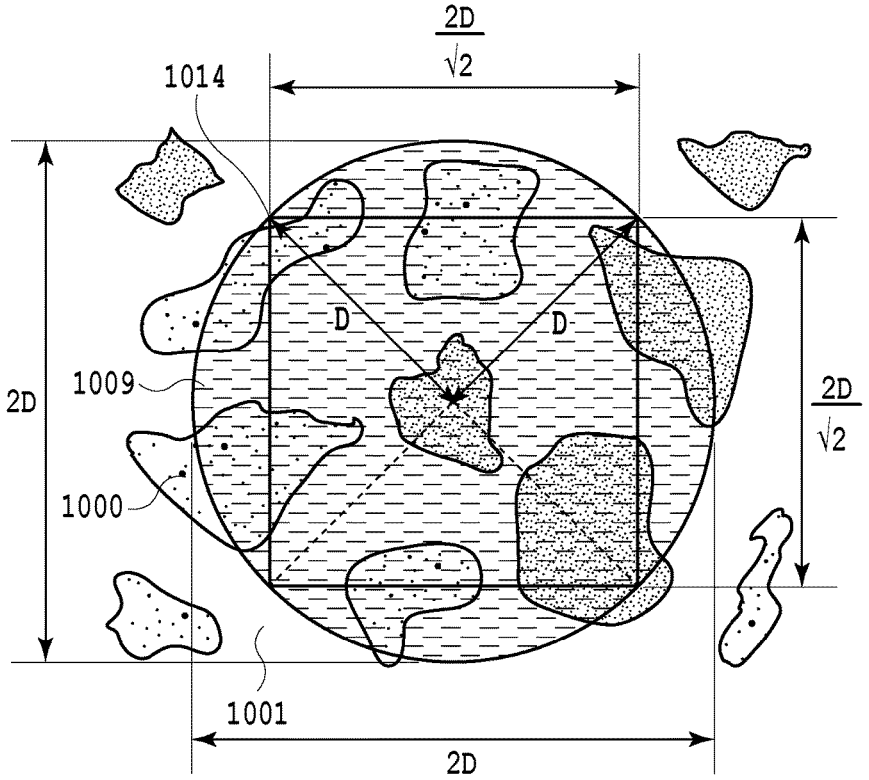
FIG. 12 is a diagram illustrating the probability density of the exposed portions of the ink receiving layer.

FIG. 12 is a diagram illustrating the density of the exposed portions of the ink receiving layer. As described above, the cylinder of the ink, which is spread by the impact of landing of the ink, has a diameter that is double the diameter D of the ink droplet and has a thickness that is one-sixth of the diameter D of the ink droplet. A side of a square that is inscribed in the bottom surface of a cylinder with a diameter 2D is ≈2D/2. If at least one cylinder with the diameter 2D is present in a square in which the sea portion is inscribed, a portion of the ink having landed on the adhesive portion can come into quick contact with the ink receiving layer. Therefore, the density of the exposed portions of the ink receiving layer is preferably set such that at least one sea portion is present in an area that is double the square of D.

As described above, to set the area factor to 100% or more, the diameter of the ink droplet may be set larger than √2/2 of a side P of an assumed print pixel, that is, one or more sea portions may be present in an area equal to the square of P. In other words, in one pixel for assumed ink jet printing, one or more sea portions, that is, one or more exposed portions of the ink receiving layer, which absorbs the ink at high absorption speed, may be present. Consequently, the ink does not remain on the island-like adhesive portions but is quickly absorbed into the ink receiving layer, preventing inappropriate adhesion. Since one or more sea portions are present in one pixel, the ink having landed on the adhesive portion is absorbed into the ink receiving layer without significantly falling out of the predetermined pixel. Thus, appropriate image printing characteristics can be achieved.

As described above, to allow the ink having landed on the adhesive portion to achieve an area factor of 100% and thus the desired image density, the diameter D of the ink droplet may be set larger than √2/2 times as large as the side P of the assumed print image. Consequently, at least one sea portion is present inside an inscribed square, and an image printing surface of the ink receiving layer can be covered with the ink. In this case, the ink receiving layer is configured to be able to absorb all of the ink satisfying an area factor of 100%. For example, within the range of the ink and the ink receiving layer assumed to be used, the gap-absorbing ink receiving layer is assumed to have an absorptance of 80%, and one 2 pl or 4 pl ink droplet is allowed to land on the adhesive portion during monochrome printing, as described above. In this case, to allow the ink to be completely absorbed, the thickness I of the ink receiving layer may be set sufficiently larger than approximately one-third of the diameter D of the assumed ink droplet. For color printing, the thickness I of the ink receiving layer needs to be approximately equivalent to or larger than the diameter D of the ink droplet. Therefore, the area where the sea portion is to be present can be associated with the thickness I of the ink receiving layer. When monochrome printing is assumed to be performed and the ink receiving layer that can receive the ink satisfying an area factor of 100% is assumed to have a thickness I, at least one sea portion may be present in a square that is 6 times as large as 1/√2 of the thickness I on a side. When color printing is assumed to be also performed, at least one sea portion may be present in a square that is twice as large as 1/√2 on a side.

In the above-described example, as a condition for achieving appropriate image printing characteristics, an area factor of 100% or more is satisfied. However, depending on the intended use of the transfer material and the printed material, the desired image density may be achieved even with an area factor of less than 100%. Therefore, in actuality, the size of the ink droplet and the porosity of the ink receiving layer may be designed according to the intended use of the transfer material and the printed material, and the thickness of the ink receiving layer, the thickness of the adhesive, and the distribution of the adhesives may be appropriately adjusted. The transfer material in the present embodiment is configured such that the adhesive pieces of the adhesive layer are discretely provided on the surface of the ink receiving layer so as to leave certain portions of the surface of the ink receiving layer directly exposed. Consequently, a portion of the ink having landed on the adhesive comes into instantaneous contact with the surface of the gap-absorbing ink receiving layer while bypassing the adhesive and is autonomously absorbed into the ink receiving layer in a dragging manner. As a result, appropriate ink dots can be formed on the ink receiving layer including the bottom of the adhesive, the ink is unlikely to remain on the surface of the adhesive or inside the adhesive, and both appropriate printing characteristics and appropriate adhesion can be achieved.

In the above-described example, one pixel is printed with one ink droplet. However, the transfer material in the present embodiment is effective for printing one pixel with a plurality of ink droplets in monochrome printing and color printing. As described above, the ink vaporization speed is lower than the ink absorption speed of the ink receiving layer and the ink jet printing speed. Thus, in ink jet printing that achieves the desired area factor, behavior of the ink having landed on the surface of the adhesive portion is substantially similar in the case where one pixel is printed with a plurality of ink droplets and in the case where one pixel is printed with one of ink droplet. That is, for ink droplets having landed on the surfaces of the adhesive pieces, which absorb the ink at low absorption speed, even when a plurality of droplets land within one pixel with slight time differences, the ink droplets may be considered to be one ink droplet resulting from integration of the plurality of ink droplets due to slow vaporization and absorption. Consequently, the behavior of the ink related to the contact with the exposed portion of the ink receiving layer, which absorbs the ink at high absorption speed, is substantially similar in the case where one pixel is printed with a plurality of ink droplets and in the case where one pixel is printed with one of ink droplet.

[1-10] Other Configurations

One or more types of adhesives may be used. Importantly, at least the adhesive in contact with the ink receiving layer substantially maintains a particulate shape. When the adhesive in contact with the ink receiving layer substantially has a particulate shape, the color material of the ink is likely to flow down to below the adhesive pieces, improving ink jet image printing characteristics.

For example, a plurality of adhesives with different particle sizes may be used. The particle size is related to the volume of the adhesive. An increased particle size increases the volume of the adhesive and thus the adhesion area between the adhesive and the image substrate, allowing the adhesion to be strengthened. Therefore, an adhesive with a large particle size may be highly compatible with the image substrate, and adhesive with a small particle size may be a binder for adhesive with large particle sizes and for an adhesive with a large particle size and the ink receiving layer. The use of an adhesive with a small particle size as a binder enables an adhesive layer to be formed while substantially maintaining a gap structure between particles of adhesives with large particle sizes. On the other hand, if, before ink jet printing, most of the particle structures in the adhesive layer are collapsed to cover the surface of the ink receiving layer with the melted adhesive, the ink may be unlikely to permeate the ink receiving layer under the adhesive, degrading image printing characteristics.

To achieve the appropriate adhesion, the adhesive may be formed of a plurality of thermoplastic resin particles. When thermoplastic resin particles with different particle sizes and different Tgs are combined together, thermoplastic resin particles with a small particle size are preferably used as a binder for thermoplastic resin particles with large particle size in order to maintain the particle structures in the thermoplastic resin particles with large particle size. Furthermore, to allow the adhesive to be appropriately formed into a film, the thermoplastic resin particles with a small particle size preferably have a lower glass transition temperature than the thermoplastic resin particles with large particle size. However, even when the thermoplastic resin particles with different particle sizes have similar Tgs, the thermoplastic resin particles with a small particle size have a large specific surface area and are likely to transmit heat. Thus, when the thermoplastic resin particles with different particle sizes are dried at the same temperature by hot-air drying, the thermoplastic resin particles with large particle size maintain particulate shapes to some degree, whereas the thermoplastic resin particles with a small particle size are melted to act as a binder. Therefore, the adhesion between the adhesive layer and the ink receiving layer can be enhanced. In this case, importantly, in order to prevent inappropriate ink jet printing, film formation is performed under such conditions as inhibit the air gaps in the surface of the ink receiving layer from being completely filled with particulates with a small particle size. That is, importantly, in the transfer material in the present embodiment, adhesive resin particles kept in particulate form are brought into close contact with the surface of the gap-absorbing ink receiving layer so as to be formed into a film, and the resin in the adhesive layer is substantially prevented from flowing into the air gaps in the gap-absorbing ink receiving layer. For example, if only thermoplastic resin particles having a particle size larger than the size of each air gap in the gap-absorbing ink receiving layer, the surfaces of the thermoplastic resin particles may be exclusively softened and melted to form an adhesive layer on the surface of the ink receiving layer with the shape of the thermoplastic resin particles substantially maintained. When the thermoplastic resin particles are formed into a film, the water-soluble resin in the ink receiving layer may be softened and melted to assist formation of the thermoplastic resin particles into a film.

Moreover, in view of the weatherability of the printed material depending on its intended use, adhesives of a plurality of materials may be used. A resin of a plurality of materials may be used which contains, for example, an adhesive having a small particle size and acting as a binder, an adhesive which has a large particle size and which is unlikely to peel off with a polar solvent, and an adhesive which has a large particle size and which is unlikely to peel off with a nonpolar solvent. As adhesive with large particle sizes, a plurality of types of resin may be used which adhere suitably to a particular image substrate. For adhesion to an image substrate such as paper with a rough surface, a cushionable adhesive may be used which is partly softened and melted and which may come into close contact with the rough surface.

The adhesive layer may include a single layer or multiple sublayers. The functions of the adhesive layer as a whole may be assigned to the different sublayers of the adhesive layer; an ink receiving layer-side sublayer of the adhesive layer may be likely to adhere to the ink receiving layer, whereas an image substrate-side sublayer of the adhesive layer may be likely to adhere to the image substrate. In this regard, to adhere more suitably to the ink receiving layer, the ink receiving layer-side sublayer may contain more adhesive likely to adhere to the ink receiving layer than adhesive likely to adhere to the image substrate. To adhere more suitably to the image substrate, the image substrate-side sublayer may contain more adhesive likely to adhere to the image substrate than adhesive likely to adhere to the ink receiving layer. When the different sublayers of the adhesive layer have the respective functions, the adhesive layer can be firmly attached (transferred) to each of the ink receiving layer and the image substrate to strengthen the adhesion. The adhesive in the uppermost sublayer in the adhesive layer, which is at a thermally remote position, preferably has a lower glass transition temperature than the water-soluble resin. However, adhesive resin particles with a high Tg may be used depending on the level of the adhesion to the image substrate. In general, the transfer material is heated from the substrate side during transfer, and thus, the thermally remote adhesive preferably has a lower Tg. For an adhesive layer with a plurality of sublayers, the adhesive in the uppermost sublayer in the adhesive layer may be completely formed into a film and smoothened rather than being particulate. However, importantly, the adhesive in the sublayer in the adhesive layer which contacts the ink receiving layer has a particulate shape. When at least the adhesive in the sublayer in the adhesive layer which contacts the ink receiving layer has a particulate shape, the ink is likely to flow down to the ink receiving layer under the adhesive, improving ink jet image printing characteristics.

[2] Substrate

[2-1] Functions of the Substrate

The transfer material 1 in the present embodiment includes a substrate 50 as depicted in FIG. 1. The substrate 50 is a sheet serving as a substrate for the ink receiving layer 53 and the adhesive layer 1012 of the adhesive discretely provided on the surface of the ink receiving layer 53. The substrate 50 has a function to serve as a conveyance layer to suppress curling of the transfer material 1 to allow the transfer material 1 to be appropriately conveyed during ink jet printing and when the transfer material is attached to the image substrate.

In addition to the function to allow the transfer material to be appropriately conveyed, the substrate may have other functions. For example, when the printed material is manufactured by printing an image on the ink jet printing surface of the transfer material and then executing adhesion processing, (1) the conveyance layer of the substrate is left on the printed material without being peeled off to allow the substrate to function as a protective layer for a print image resulting from ink jet printing. (2) After the adhesion processing, the substrate including the conveyance layer is peeled off so as to function as a separator. (3) When the substrate includes a functional layer such as a transparent protective layer, a hologram layer, or a printing layer, only the conveyance layer is peeled off (a part of the substrate is peeled off) after the adhesion processing to allow the conveyance layer of the substrate (a part of the substrate) to function as a separator while allowing the other part to function as a protective layer or a security layer for the print image resulting from ink jet printing. As described above, the peel-off of the conveyance layer of the substrate may be omitted, and the "case where the conveyance layer of the substrate is not peeled off" and the "case where the conveyance layer of the substrate is peeled off" may be used depending on the intended use of the transfer material and the printed material. The "case where the conveyance layer of the substrate is peeled off" may hereinafter referred to as "all or a part of the substrate is peeled off". When peeled off, the conveyance layer of the substrate may include a release layer to allow the peel-off function of the conveyance layer to be appropriately fulfilled. The release layer is formed of a composition containing a releasing agent and provided in the conveyance layer. The release layer facilitates peel-off of the conveyance layer. When the release layer is thus provided, the conveyance layer includes the release layer.

[2-2] Case where the Conveyance Layer of the Substrate is Peeled Off

A printed material will be described which is manufactured by using the transfer material in which the conveyance layer of the substrate is not peeled off.

[2-2-1] Printed Material Manufactured Using the Transfer Material in which the Substrate is not Peeled Off.

Figure 13C:
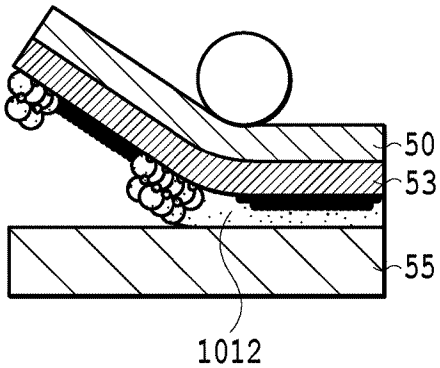
FIGS. 13A to 13D are process diagrams illustrating a manufacturing method for a printed material.
Figure 13B:
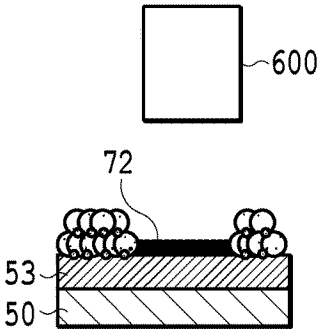
Figure 13D:
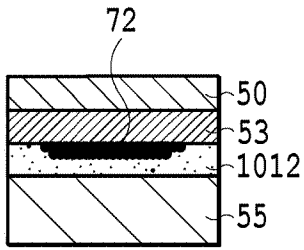
Figure 13A:
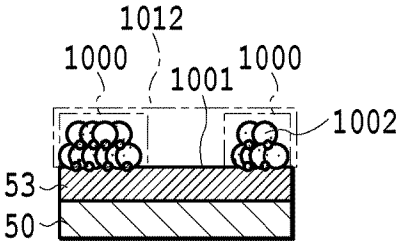

FIG. 13A depicts the transfer material in which the conveyance layer of the substrate is not peeled off. On the surface of the ink receiving layer 53, the adhesive portions 1000 of the adhesive layer 1012 are formed at particular positions, and bypass portions are also formed in which no adhesive portion 1000 is provided.

When the printed material 73 is manufactured, first, the ink is applied to the printing surface of the transfer material via the print head 600 to print an image 72 as depicted in FIG. 13B. Then, as depicted in FIG. 13C, the ink receiving layer 53 is attached (transferred) to the image substrate 55 with the discretely disposed adhesive 1002 to provide a printed material as depicted in FIG. 13D. The printed material is structured such that the adhesive layer 1012, the ink receiving layer 53, and the substrate 50 are sequentially laminated on the image substrate 55. When at least one of the substrate 50 and the image substrate 55 is transparent, the image 72 is visible from the transparent substrate 50 side or the image substrate 55 side. The transfer material in which the conveyance layer of the substrate is not peeled off is preferably used to manufacture a printed material such as a construction material or wallpaper. When the image is viewed from the transparent substrate, an inverted image is printed on the ink jet printing surface of the transfer material. When the image is viewed from the image substrate side, a normal image is printed on the ink jet printing surface of the transfer material.

Figure 14B:
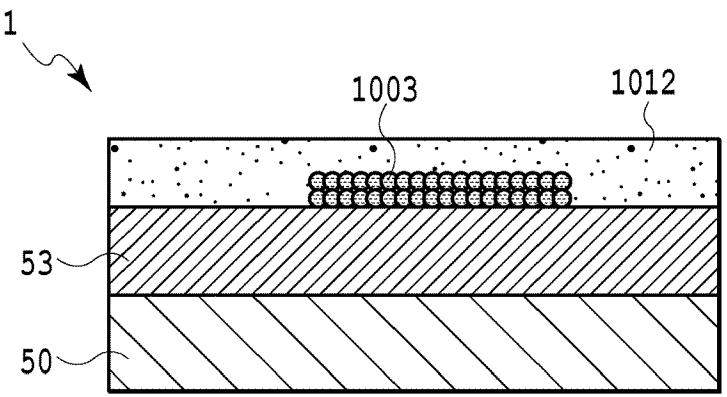
FIG. 14A and FIG. 14B are diagrams of a self-melt-adhesion adhesive.
Figure 14A:
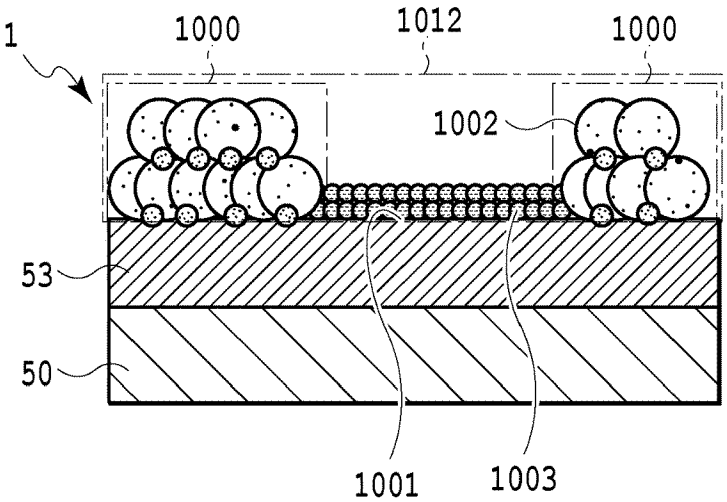

[2-2-2] Printed Material Manufactured Using a Self-Melt Transfer Material in which Conveyance Layer of the Substrate is not Peeled Off A self-melt transfer material in which the conveyance layer of the substrate is not peeled off is configured by forming the gap-absorbing ink receiving layer 53 on the substrate 50 and discretely providing the self-melt adhesive pieces 1002 on the surface of the ink receiving layer 53 as depicted in FIG. 14A. On the surface of the ink receiving layer 53, the adhesive portions 1000 of the adhesive layer 1012 are formed at particular positions, and bypass portions are also formed in which no adhesive portion 1000 is provided. When a printed material is manufactured, ink 1003 is applied to the printing surface of the transfer material to print an image as depicted in FIG. 14A, and the discretely disposed adhesive pieces 1002 self-melt, with the adjacent adhesive pieces 1002 adhering to each other as depicted in FIG. 14B. As described above, the printed material is manufactured by forming a film of the adhesive 1002 on the surface of the ink receiving layer 53 resulting from ink jet printing. Such a self-melt transfer material can preferably be used to manufacture a printed material used for a sign display plate or a poster.

As described above, an image is printed on the transfer material in which the self-melt adhesive pieces are discretely provided on the surface of the ink receiving layer, and heating treatment is performed on the transfer material. Then, the discretely disposed adhesive pieces self-melt, and the adjacent adhesive pieces adhere to each other. The adhesive pieces thus adhere to one another to cover the surface of the gap-absorbing ink receiving layer with the film of the adhesive. The film of the adhesive is firm and thus functions as a protective film for an image formed on the ink receiving layer. In particular, when the ink is formed of pigment, the pigment of the color material may be likely to remain on the surfaces of the exposed portions of the gap-absorbing ink receiving layer and unlikely to permeate the ink receiving layer, as depicted in FIG. 14B. In this case, the adhesion between the ink receiving layer and the pigment ink on the surface of the ink receiving layer is weak, and thus, the pigment ink is likely to peel off from the surface of the ink receiving layer due to abrasion. However, as depicted in FIG. 14B, the self-melt adhesive is thermally treated such that the melted adhesive covers the color material of the pigment ink remaining on the surfaces of the exposed portions of the ink receiving layer to function as a protective film. When the image is viewed from the transparent substrate side, an inverted image is printed on the ink jet printing surface of the transfer material. When the image is viewed from the film formation surface of the adhesive, a normal image is printed on the ink jet printing surface of the transfer material.

Figure 15A:
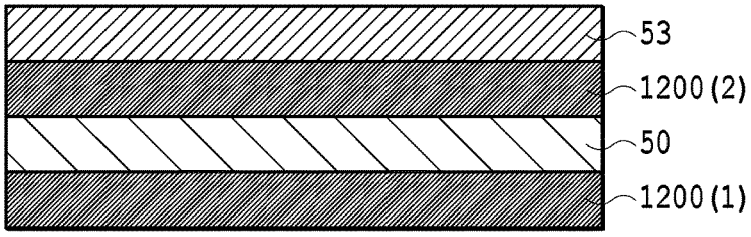
FIGS. 15A to 15D are sectional views illustrating another embodiment of the transfer material.

[ 2-2-3] Printed Material Manufactured Using a Transfer Material in which Heat Seal Layers are Provided on Opposite Surfaces of the Substrate The substrate includes, for example, the conveyance layer that is not peeled off. An example of a transfer material in which a heat seal layer is provided on each of the opposite surfaces of the substrate may be a configuration in which the heat seal layers are provided on the substrate as depicted in FIG. 15A. A highly adhesive heat seal layer 1200(1) is provided on a surface (a lower surface in FIG. 15A) of the substrate 50 that is opposite to the ink receiving layer 53 side. A heat seal layer 1200(2) between the substrate 50 and the ink receiving layer 53 need not necessarily be provided. The transfer material is configured by providing a gap-absorbing ink receiving layer 53 on such a substrate 50 and discretely providing the adhesive pieces 1002 of the adhesive layer 1012 on the surface of the ink receiving layer 53. A printed material is manufactured by applying the ink to the printing surface of such a transfer material to print an image.

Figure 15B:
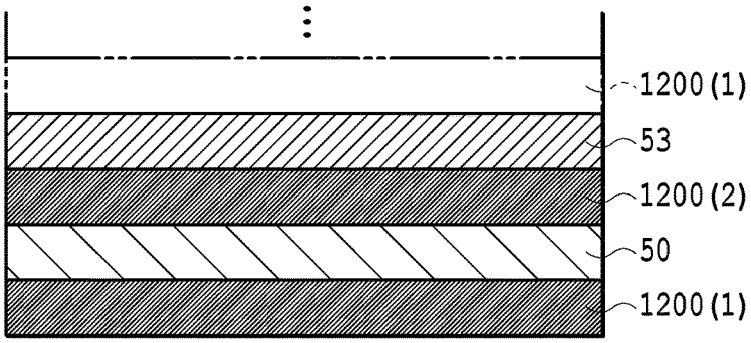
Figure 15C:
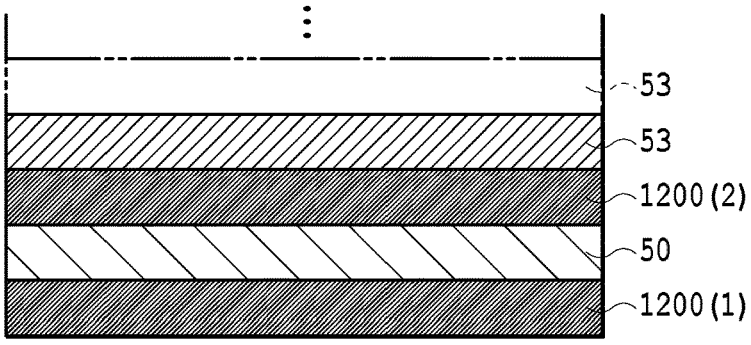
Figure 15D:
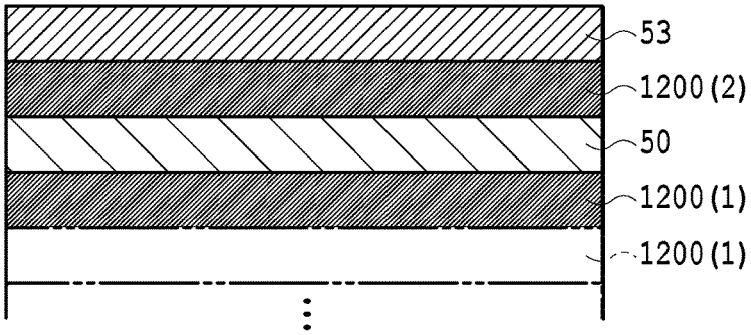

For example, the transfer material is folded back to allow the printed material as described above to be attached, via the adhesive discretely disposed on the surface of the ink receiving layer 53, to a member such as another layer, another transfer material, or another printed material. For example, the heat seal layer 1200(1) can be attached to the ink receiving layer 53 as depicted in FIG. 15B, or to the ink receiving layer 53, another ink receiving layer 53 can be attached as depicted in FIG. 15C. Alternatively, to the heat seal layer 1200(1), another heat seal layer 1200(1) can be attached as depicted in FIG. 15D.

Such a transfer material and a printed material can be preferably used as a packaging material to package a box. When the transfer material or the printed material is used as a packaging material, the substrate functions as a protective layer for an image resulting from ink jet printing and also as a protective layer that protects a box when the box is packaged to provide a package. A heat seal layer 1200(2) may be provided between the substrate 50 and the ink receiving layer 53. Thus, the transfer material or printed material can appropriately resist bending when used as a packaging member.

[2-2-3-1] Caramel Wrap

Figure 16A:
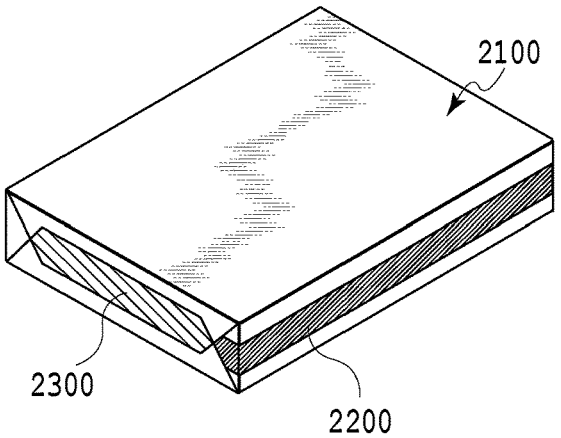
FIGS. 16A to 16C are diagrams illustrating examples of a usage form of a printed material in which a substrate is not peeled off.
Figure 16B:
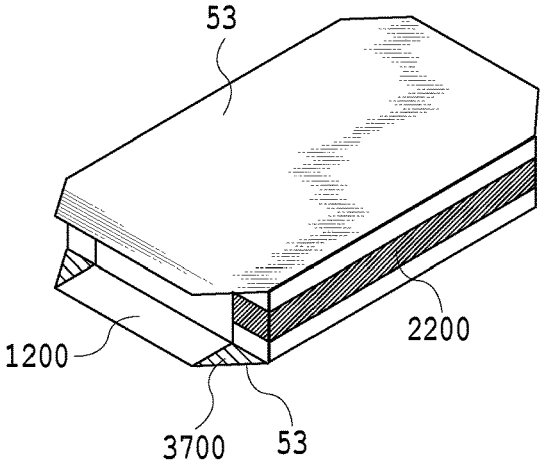
Figure 16C:
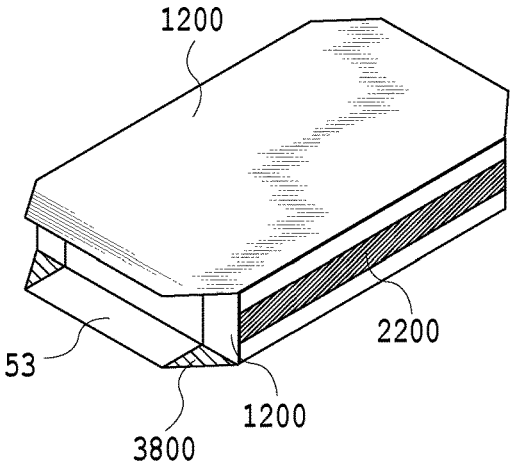

FIGS. 16A to 16C illustrate examples in which the transfer material as described above is used as a packaging material. FIG. 16A is a perspective view schematically illustrating an example of a package. A package 2100 in FIG. 16A is obtained by caramel-wrapping a packaging target using the transfer material. The surface of the package 2100 may be the ink receiving layer or the heat seal layer depending on the intended use. Overlaps 2200 and 2300 are portions in which the ink receiving layer and the heat seal layer are attached together via the adhesive pieces discretely disposed on the ink receiving layer. The package 2100 is produced by thermocompression-bonding and attaching the overlaps 2200 and 2300 between the ink receiving layer and the heat seal layer.

FIG. 16B is a diagram illustrating an example of production of the package 2100. FIG. 16C is a diagram illustrating another example of production of the package 2100. In FIG. 16B, the ink receiving layer 53 is positioned on the surface of the package 2100. Thus, after the package 2100 is produced, an image can be printed on the surface of the package 2100. In FIG. 16C, the heat seal layer 1200 is positioned on the surface of the package 2100. Thus, before the package 2100 is formed, an image can be printed on the heat seal layer 1200. During a process of forming a package, in an overlap 3700 in FIG. 16B, parts of the ink receiving layer 53 contact each other. In an overlap 3800 in FIG. 13C, parts of the heat seal layer 1200 contact each other. As described above, providing the heat seal layer on one surface of the substrate allows parts of the heat seal layer to be attached to each other. In the overlap 2300 in FIG. 16A, appropriate adhesion can be achieved to prevent the overlap from being loose as a result of inappropriate adhesion.

In FIG. 16B, in a triangular overlap 3700, parts of the ink receiving layer 53 contact each other and can thus be thermobonded to each other with the discretely disposed adhesive pieces. Thus, the package can be accurately and stably produced by accurately thermobonding fold-back trapezoidal portions and the like (thermobonding the ink receiving layer 53 and the heat seal layer 1200 together and thermobonding parts of the heat seal layer 1200 together) after thermobonding of the parts of the ink receiving layer 53. In FIG. 16C, in a triangular overlap 3800, parts of the heat seal layer 1200 contact each other and can thus be thermobonded to each other. Thus, the package can be accurately and stably produced by accurately thermobonding fold-back trapezoidal portions and the like (thermobonding the heat seal layer 1200 and the ink receiving layer 53 together and thermobonding parts of the ink receiving layer 53 together) after thermobonding of the parts of the heat seal layer 1200.

[2-2-3-2] Butt Seaming

Figure 17:
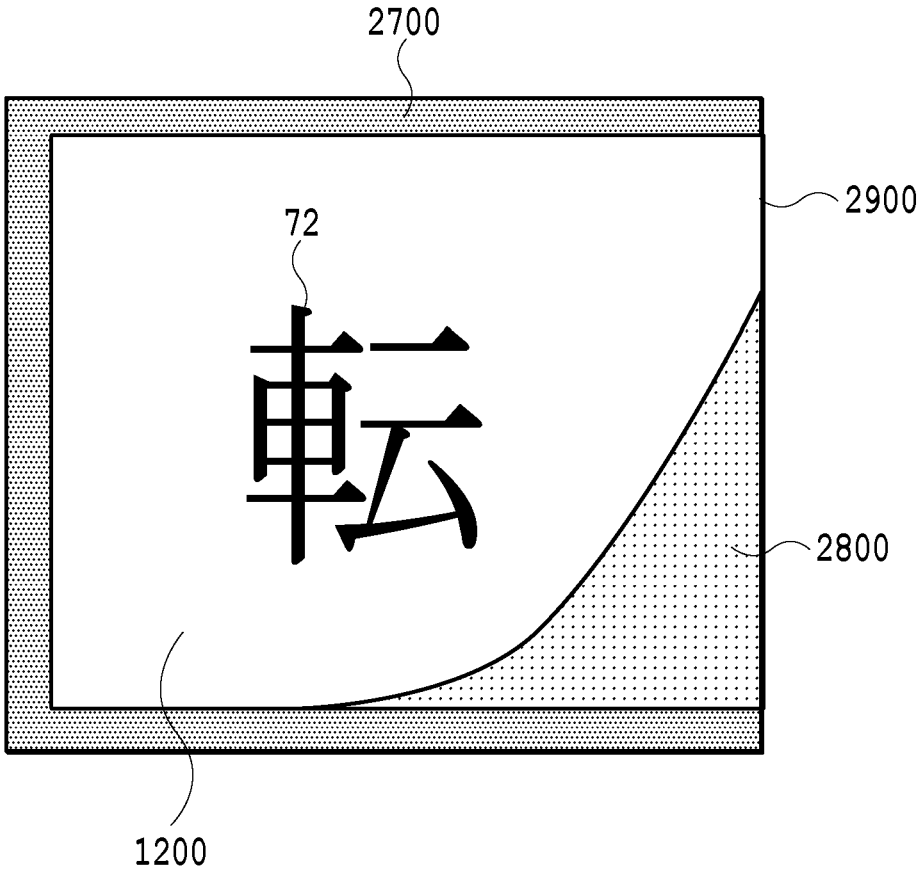
FIG. 17 is a diagram illustrating another example of the usage form of a printed material in which a substrate is not peeled off.

FIG. 17 is a top view schematically illustrating another example of a package. The package in this example is of a bag type. In the bag-type package, the transfer material is folded back at a fold 2900 such that the ink receiving layer is positioned on an inner side, whereas the heat seal layer is positioned on an outer side. Then, the package can be produced by thermocompression-bonding and attaching overlapping parts of the ink receiving layer in an overlap 2700 together. In this case, an inverted image is printed on the ink jet printing surface of the transfer material. Furthermore, in order to suppress peel-off of the printing surface caused by contact between the ink jet printing surface and the content of the package and detachment of the ink receiving layer (dusting), the discretely disposed adhesive pieces are preferably melted after ink jet printing to allow all of the printing surface and the surface of the ink receiving layer to be protected by the protective film of the protective layer.

If the content of the package is powder 2800, peel-off of the printing surface and detachment of the ink receiving layer (dusting) need to be more reliably suppressed. In such a case, the transfer material is folded back at the fold such that the heat seal surface is positioned on the inner side, whereas the ink receiving layer is positioned on the outer side. Furthermore, the package may be formed by thermo-compression-bonding (butt-seaming) parts of the heat seal layer in the overlap 2700 together. In this case, after the package is produced, a normal image 72 is printed on the ink receiving layer 53 on the outer side. Preferably, the ink jet printing system, which enables an image to be printed in a non-contact manner, is used to print the normal image 72 because the ink jet printing system enables a reduction in thermal damage to the content of the package and allows an image to be printed after sealing of the content (powder 2800) unlike the thermal transfer system. To suppress peel-off of the printing surface caused by abrasion, the printing surface may be thermally treated to the extent that thermal damage to the content of the package is prevented, to melt the discretely disposed adhesive pieces, allowing the printing surface and the surface of the ink receiving layer to be protected by the protective film.

[2-3] Case where the Conveyance Layer of the Substrate is Peeled Off

The following description relates to a transfer material in which all of the substrate including the conveyance layer is peeled off and a printed material is produced using the transfer material.

Figure 18C:
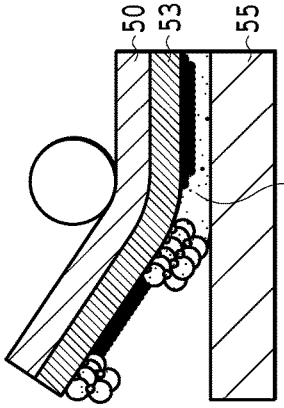
FIGS. 18A to 18G are process diagrams illustrating another example of the manufacturing method for a printed material.
Figure 18B:
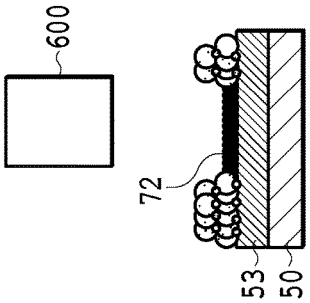
Figure 18A:
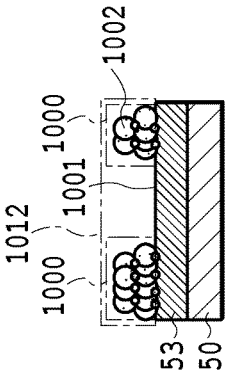
Figure 18G:
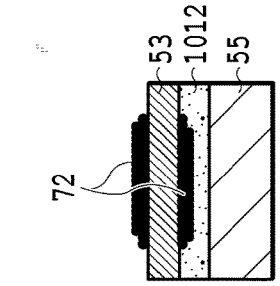
Figure 18F:
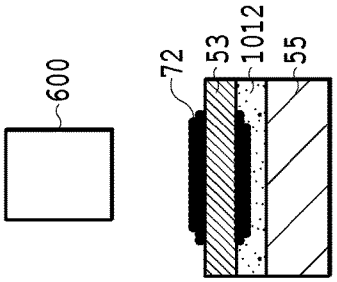
Figure 18E:
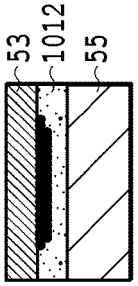
Figure 18D:
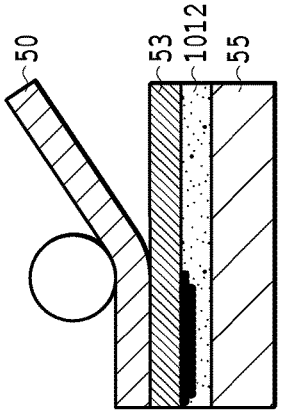

[2-3-1] Printed Material in which the Ink Receiving Layer with an Image Formed Thereon is Laminated to the Image Substrate FIG. 18A depicts a transfer material in which all of the substrate including the conveyance layer is peeled off. To produce a printed material, first, the inverted image 72 can be printed on the printing surface of the transfer material with the ink ejected from an ink jet print head 600 as depicted in FIG. 18B. Then, as depicted in FIG. 18C, the transfer material with an image printed thereon is attached (transferred) to the image substrate 55 with the discretely disposed adhesive pieces 1002. Subsequently, as depicted in FIG. 18D, the conveyance layer (all of the substrate) is peeled off to provide such a printed material as depicted in FIG. 18E. The transfer material in which all of the substrate including the conveyance layer as described above is peeled off may preferably be used, for example, for ID cards, company ID cards, and notifications for public documents such as an a social security and tax number and a passport.

In the thus produced printed material, the uppermost layer corresponds to the ink receiving layer 53. Thus, an image can be formed on the surface of the printed material. Furthermore, since the ink receiving layer is of the gap-absorbing type, the air gaps are maintained even after transfer. For example, such a printed material as depicted in FIG. 18E may be produced by preliminarily inversely printing a very sensitive text information on the ink receiving layer 53 side of the transfer material as depicted in FIG. 18B. Then, a normal image may be formed on the surface of the printed material as needed. Specifically, as depicted in FIG. 18F and FIG. 18G, information such as the image 72 can be easily printed on the printed material by ink jet printing using the print head 600 or by touch-up, seal affixation, or the like.

[2-3-2] Multilayer Printed Material (Multilayer)

As a printed material, a multilayer printed material can be produced in which multiple ink receiving layers are formed on the image substrate. As depicted in FIG. 19A, a transfer material is prepared in which the gap-absorbing ink receiving layer 53 is formed on the substrate 50 and in which the adhesive pieces 1002 of the adhesive layer 1012 are discretely provided on the surface of the ink receiving layer 53. First, an inverted image can be formed on the transfer material with the ink ejected from the print head 600. Then, as depicted in FIG. 19B and FIG. 19C, the transfer material with the image printed thereon is attached (transferred) to the printed material in FIG. 18G with the discretely disposed adhesive pieces 1002. In the printed material in FIG. 18G, the ink receiving layer has been previously transferred to the surface of the image substrate, and a normal image is printed on the ink receiving layer by touch-up or the like, as needed. Subsequently, as depicted in FIG. 19D, the conveyance layer (all of the substrate) is peeled off to provide a multilayer printed material in which multiple ink receiving layers 53 are formed on the image substrate 55. Repeated transfer of the transfer material allows the ink receiving layer to be formed on the image substrate any number of times. That is, a plurality of ink receiving layers may be formed on the image substrate.

When a transfer material is used in which only the gap-absorbing ink receiving layer is formed on the substrate and in which no adhesive layer is formed on the surface of the ink receiving layer, the transfer material has difficulty being laminated to the printed material with the transfer material transferred onto the image substrate. In other words, it is difficult to laminate the ink receiving layer of the transfer material to the gap-absorbing ink receiving layer on the image substrate of the printed material. Common ink receiving layers are composed of approximately 90% inorganic particulates and approximately 10% water-soluble resin functioning as a binder that binds the inorganic particulates together. A large number of air gaps are formed to allow the ink to be adequately absorbed, by setting the amount of the resin component, functioning as a binder, significantly smaller than the amount of the inorganic particulates. On the surface of the gap-absorbing ink receiving layer, a countless number of recesses and protrusions are defined by exposed inorganic particulates, which are not adhesive. As described above, a countless number of recesses and protrusions are formed on each of the ink receiving layer of the printed material laminated to the image substrate and the ink receiving layer on the transfer material side. To attach the ink receiving layers together, the resin components of the ink receiving layers, which serve as binders, need to be melted and flow at a temperature higher than Tg (melting temperature) when the ink receiving layers are brought into close contact with each other and thermo-compression-bonded together.

However, the ink receiving layer of the printed material and the ink receiving layer of the transfer material contain only a small amount of water-soluble resin, which is melted and flows, and thus, it is difficult to fill, with the water-soluble resin component, spaces between the adhesion surfaces which are defined by the recesses and protrusions on the surfaces of the ink receiving layers. This may prevent the appropriate adhesion from being achieved. When the amount of water-soluble resin is increased to strengthen the adhesion, the air gaps between the inorganic particulates are likely to be filled with the resin. This hinders the ink from being appropriately absorbed during ink jet printing, preventing the appropriate image printing characteristics from being achieved.

The transfer material in the embodiment of the present invention is configured such that the gap-absorbing ink receiving layer is formed on the substrate and that the adhesive pieces of the adhesive layer are discretely provided on the surface of the ink receiving layer to leave the remaining portions of the surface of the ink receiving layer directly exposed. The use of such a transfer material allows the adhesive layer to be easily melted by thermocompression bonding to fill the space formed between the surfaces of the ink receiving layers of the printed material and the transfer material. Since the gap-absorbing ink receiving layers can be attached to each other, a multilayer printed material can be produced in which multiple ink receiving layers are formed on the image substrate.

Since the surface of the printed material with the multiple ink receiving layers corresponds to the ink receiving layer, information such as the image 72 can be easily added to the printed material by ink jet printing using the print head 600 or by touch-up, seal affixation, or the like. In this case, a normal image is printed. As described above, repeated transfer of the transfer material allows the ink receiving layer to be repeatedly formed on the printed material any number of times. When information needs to be added to the printed material depending on the intended use of the printed material, the ink receiving layer may be formed on the printed material so as to allow for repeated addition of information.

[2-3-3] Printed Material Including Transfer Material Partly Peeled Off

High durability and security are needed for a passport, various security cards such as credit card, and the like which are printed materials manufactured using a transfer material in which only the conveyance layer of the substrate (a part of the substrate) is peeled off. In such a printed material, the substrate may be provided with one or more functional layers such as one or more transparent protective layers, one or more hologram layers, or one or more printing layers with an image preliminarily printed thereon.

Figure 20C:
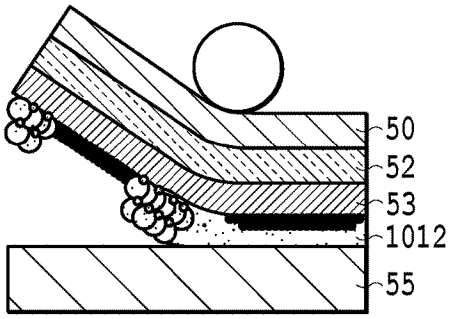
FIGS. 20A to 20E are process diagrams illustrating still another example of the manufacturing method for a printed material.
Figure 20E:
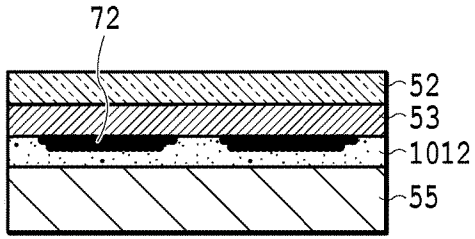
Figure 20B:
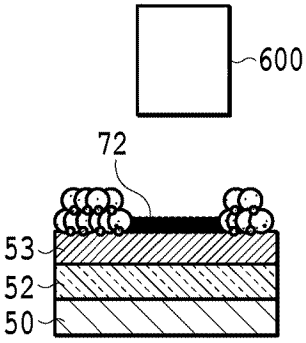
Figure 20D:
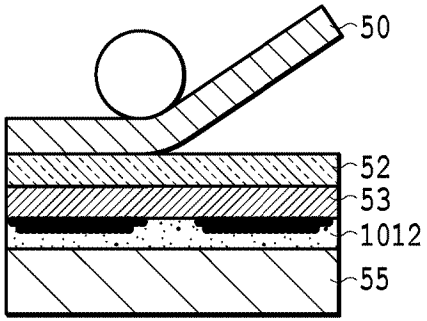
Figure 20A:
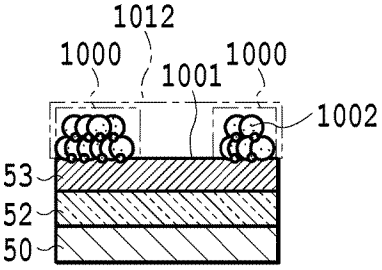

A transfer material in which the substrate includes the functional layer is configured by forming the gap-absorbing ink receiving layer 53 on the substrate 50 including a functional layer 52 and discretely providing the adhesive pieces 1002 of the adhesive layer 1012 on the surface of the ink receiving layer 53 as depicted in FIG. 20A. The functional layer 52 may be, for example, a transparent protective layer, a hologram layer, or a printing layer with an image preliminarily printed thereon. To produce a printed material, first, the inverted image 72 can be printed on the printing surface of the transfer material with the ink ejected from an ink jet print head 600 as depicted in FIG. 20B. In this case, a portion of the ink passes through the space between the adhesive portions 1000 of the adhesive layer 1012 in a bypassing manner to come into contact with the corresponding exposed portion 1001 of the ink receiving layer 53. The ink is then absorbed into the ink receiving layer 53 in a dragging manner. Then, as depicted in FIG. 20C, the transfer material with the image printed thereon is attached (transferred) to the image substrate 55 with the discretely disposed adhesive pieces 1002. Subsequently, only the conveyance layer (a part of the substrate) is peeled off as depicted in FIG. 20D to allow production of a printed material to which the functional layer 52 such as a transparent protective layer, a hologram layer, or a printing layer is laminated. In such a printed material, the uppermost layer corresponds to the functional layer 52 such as a protective layer, a hologram layer, or a printing layer, allowing high durability and security to be achieved.

[2-3-3-1] Transparent Protective Layer

The substrate of the transfer material may include a transparent protective layer in order to enhance durability such as weatherability, friction resistance, and chemical resistance. The transparent protective layer corresponds to a sheet having a total light transmittance of 50% or more and preferably 90% or more as measured in compliance with JIS K7375. Therefore, the transparent protective layer includes a translucent protective layer and a colored transparent protective layer, in addition to a colorless transparent protective layer.

The type of the transparent protective layer is not particularly limited. The transparent protective layer is preferably a sheet or a film formed of a material that is excellent in durability such as weatherability, friction resistance, and chemical resistance and that is highly compatible with the ink receiving layer.

When dye ink is used to print an image, the transparent protective layer preferably contains a UV cutting agent in order to prevent the dye from being decomposed by ultraviolet rays (photo degradation). Examples of the UV cutting agent include ultraviolet absorbers such as benzotriazole-based compound and a benzophenone-based compound; and ultraviolet scattering agents such as titanium oxide and zinc oxide.

The transparent protective layer may be formed of one or more types of resin particles. Preferably, the transparent protective layer contains two types of resin (resin E1 and resin E2). Preferably, the resin E1 has a glass transition temperature Tg1 of higher than 50° C. and lower than 90° C., the resin E2 has a glass transition temperature Tg2 of 90° C. or higher and 120° C. or lower, and at least the resin E2 remains particles in the transparent protective layer. When the two types of resins are used and the film state of the resin E2 is changed utilizing the temperature during thermocompression bonding, the transparent protective layer can be more appropriately cut off in the peeling step, allowing possible burrs at an end of the transparent protective layer to be suppressed.

[2-3-3-2] Water-Swelling Resin

To prevent the transparent protective layer 52 from fissuring when the printed material with an image formed therein is immersed in water for a long time, the transparent protective layer 52 may contain water-swelling resin and thus have a mechanism that discharges moisture to the outside. Containing the selling resin in the transparent protective layer allows the transparent protective layer to function as a pump that discharges the moisture inside the printed material to the outside. Similarly, the water-swelling resin can promote vaporization of the moisture in the ink absorbed into the gap-absorbing ink receiving layer during ink jet printing. That is, the moisture in the ink absorbed into the gap-absorbing ink receiving layer also vaporizes through the entire surface of the transparent protective layer via the water-soluble resin. Drying of the ink can also be promoted by vaporization of the moisture in the ink in the ink receiving layer through the entire surface of the transparent protective layer.

[2-3-3-3] Hologram Layer

To enhance the security of the printed material, the substrate may include a hologram layer. The hologram layer is a layer on which a three-dimensional image is printed. Inclusion of the hologram layer provides the printed material (credit card or the like) with an effect that prevents forgery. The configuration of the hologram layer is not particularly limited, and a common configuration may be adopted. For example, a relief hologram may be used. A hologram formation layer may be a plane hologram or a volume hologram, and the plane hologram, particularly the relief hologram, is preferable in terms of mass productivity and costs.

[2-3-3-4] Printing Layer

To enhance the security of the printed material, the substrate may include a printing layer on which an image is printed and which is not peeled off. A supplementary image (preprint) may be printed on the substrate. That is, the functional image is preliminarily printed on the substrate to allow the security of the printed material to be further enhanced.

[2-3-4] Multilayer Printed Material (Multilayer)

The printed material may be a multilayer printed material in which multiple ink receiving layers are formed as depicted in FIGS. 24A to 24E.

Figure 21A:
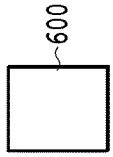
FIGS. 21A to 21E are process diagrams illustrating further another example of the manufacturing method for a printed material.
Figure 21A:
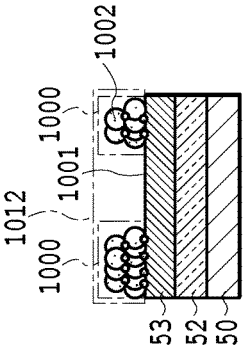
Figure 21B:
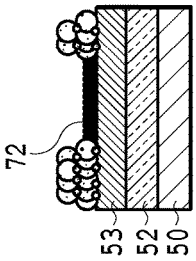
Figure 21C:
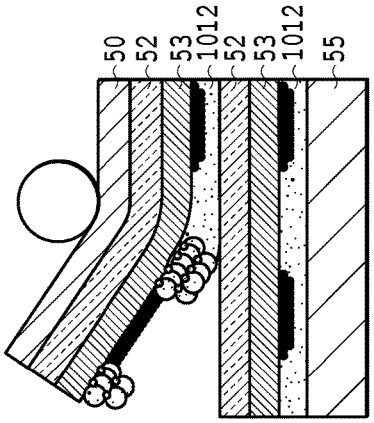
Figure 21D:
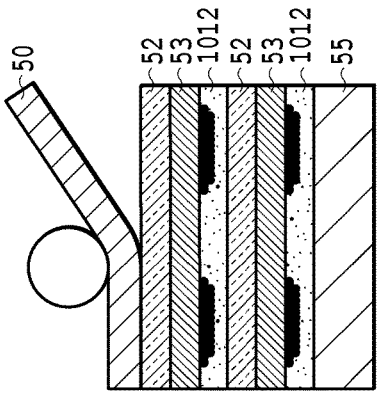
Figure 21E:
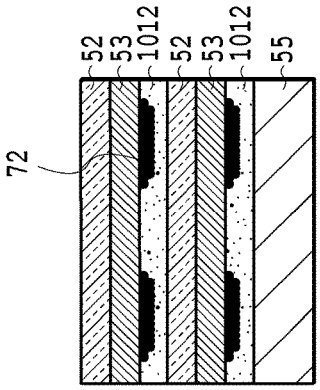

As depicted in FIG. 21A, one or more functional layers 52 such as one or more transparent protective layers, one or more hologram layers, or one or more printing layers are formed on the substrate 50. The transfer material is configured by forming the gap-absorbing ink receiving layer 53 on the functional layer 52 and discretely providing the adhesive pieces 1002 of the adhesive layer 1012 on the surface of the ink receiving layer 53. To produce a multilayer printed material, first, an inverted image 72 is formed on the printing surface of the transfer material as depicted in FIG. 21B. Subsequently, as depicted in FIG. 21C, the transfer material with the image printed thereon is attached (transferred) to the printed material in FIG. 20E with the discretely disposed adhesive pieces 1002. In the printed material in FIG. 20E, the transparent protective layer and the hologram layer, which serve as functional layers, and the ink receiving layer are preliminarily laminated to the surface of the image substrate. Subsequently, as depicted in FIG. 21D, only the conveyance layer (a part of the substrate) is peeled off from the substrate including any of the functional layers such as the conveyance layer, the transparent protective layer, the hologram layer, and the printing layer. Thus, a multilayer printed material can be produced in which multiple layers are formed, including any of the functional layers 52 such as the conveyance layer, the transparent protective layer, the hologram layer, and the printing layer, and the ink receiving layer 53 with the image printed thereon. The uppermost surface of the printed material corresponds to the transparent protective layer, the hologram layer, or the printing layer, which can protect the print image on the printed material and provide the printed material with the security function. Repeated transfer of the transfer material allows formation, on the image substrate, a plurality of ink receiving layers each having an image printed thereon and integrated with any of the transparent protective layer, the hologram layer, and the printing layer. That is, when the surface of the printed material needs the protection function or the security function, a protective layer or a security layer can be formed on the surface of the printed material any number of times, depending on the intended use of the printed material.

A transfer material is assumed in which, for example, the functional layer such as the transparent protective layer, the hologram layer, or the printing layer and the gap-absorbing ink receiving layer are provided on the substrate and in which no adhesive layer is provided on the surface of the ink receiving layer. Such a transfer material may be difficult to transfer to the printed material in which the ink receiving layer 53 with an image printed thereon and the functional layer 52 are laminated. That is, in many transfer materials, the water-soluble resin contained in the ink receiving layer of the transfer material has a low affinity to the material of the functional layer in the uppermost surface of the printed material. Thus, it may be difficult to attach together the layer positioned in the uppermost surface of the printed material (such as the transparent protective layer, the hologram layer used to form interference fringes, and the ink used for the preprint) and the ink receiving layer of the transfer material, depending on the combination of the former material (material of the transparent protective layer, the hologram layer, and the ink) and the latter material (material of the water-soluble resin contained in the ink receiving layer 53).

However, in the present invention, the adhesive pieces of the adhesive layer are discretely provided on the surface of the ink receiving layer of the transfer material and thus allow the ink receiving layer of the transfer material to attach the uppermost surface of the printed material with the possible adverse effect of the material of the uppermost surface of the printed material avoided.

[2-3-5] Other Configuration of the Multilayer Printed Material (Multilayer)

As described above, one or more functional layers are formed on the substrate from which only the conveyance layer of the substrate (a part of the substrate) is peeled off, the gap-absorbing ink receiving layer is formed on the substrate including such a functional layer, and the adhesive pieces of the adhesive layer are discretely provided on the surface of the ink receiving layer. Then, the remaining portions of the surface of the ink receiving layer can be left directly exposed. An inverted image can be formed on the printing surface of the transfer material. Then, a multilayer printed material can be produced by attaching (transferring) the transfer material with the image printed thereon onto the ink receiving layer of the printed material in [2-3-1] and then peeling only the conveyance layer (a part of the substrate) off from the substrate including the functional layer such as the conveyance layer, the transparent protective layer, the hologram layer, and the printing layer. Consequently, a multilayer printed material is obtained in which multiple layers including the ink receiving layer and the functional layer such as the transparent protective layer, the hologram layer, or the printing layer are formed on the image substrate. In this case, the uppermost surface of the printed material corresponds to the transparent protective layer, the hologram layer, or the printing layer, which can protect the print image on the printed material and provide the printed material with the security function. As described above, repeated transfer of the transfer material allows formation, on the image substrate, a plurality of ink receiving layers each having an image printed thereon and integrated with any of the transparent protective layer, the hologram layer, and the printing layer. That is, when the surface of the printed material needs the protection function or the security function, a protective layer or a security layer can be formed on the surface of the printed material any number of times depending on the intended use of the printed material.

The following description relates to other forms of the multilayer printed material manufactured using the transfer material in which only the conveyance layer of the substrate (a part of the substrate) is peeled off.

The transfer material is configured by forming the gap-absorbing ink receiving layer on the substrate and discretely providing the adhesive pieces of the adhesive layer on the surface of the ink receiving layer so as to leave the remaining portions of the surface of the ink receiving layer directly exposed. An inverted image can be formed on the printing surface of the transfer material. A multilayer printed material can be produced by attaching (transferring) the transfer material with the image printed thereon onto the ink receiving layer of the printed material in [2-3-3] with the discretely disposed adhesive pieces 1002 and then peeling off all of the substrate. Consequently, a multilayer printed material can be produced in which multiple layers including the ink receiving layer and the functional layer such as the transparent protective layer, the hologram layer, or the printing layer are formed on the image substrate.

In the multilayer printed material including the ink receiving layer, the ink receiving layer corresponds to the uppermost layer. Thus, image formation can further be performed on the surface of the multilayer printed material. In this case, a normal image is printed. Since touch-up, seal affixation, and ink jet printing can be performed on the surface of the ink receiving layer of the multilayer printed material, information can be easily added to the multilayer printed material. Repeated transfer of the transfer material allows the ink receiving layer to be formed on the image substrate any number of times. When information needs to be added to the printed material depending on the intended use of the printed material, the ink receiving layer may be formed on the printed material so as to allow for repeated addition of information.

Various multilayer printed materials can be manufactured by freely combining the multilayer printed material resulting from repeated transfer of the transfer material with various transfer materials. The multilayer printed material may be combined with, for example, the transfer material in which all of the substrate is peeled off as described in [2-3-1] or the transfer material in which a part of the substrate is peeled off as described in [2-3-3]. The transfer material to be combined with the multilayer printed material may be freely selected according to the intended use of the printed material. For example, to allow information to be added to the printed material, a multilayer printed material is manufactured by forming the ink receiving layer in the uppermost surface of the multilayer printed material using the transfer material in which all of the substrate is peeled off as described in [2-3-1]. To allow the uppermost surface of the printed material to have a security function or a function to protect the printing surface, a multilayer printed material is manufactured by forming any of the functional layers such as the transparent protective layer, the hologram layer, and the printing layer in the uppermost surface of the multilayer printed material, using the transfer material in which a part of the substrate is peeled off as described in [2-3-3].

[3] Materials

[3-1] Gap-Absorbing Ink Receiving Layer

The ink receiving layer, for example, receives the ink applied by the ink jet printing system. In the present embodiment, the ink receiving layer is of the gap-absorbing type. The transfer material is configured by discretely providing the adhesive pieces of the adhesive layer on the surface of the ink receiving layer so as to leave the remaining portions of the surface of the ink receiving layer directly exposed.

Figure 22B:
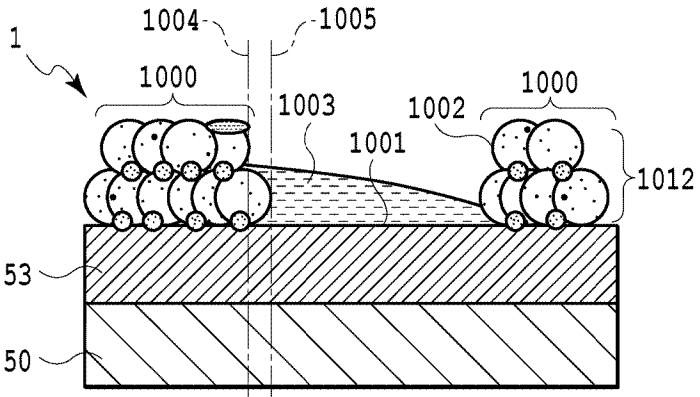
FIGS. 22A to 22C are diagrams illustrating absorption of ink into a swelling absorbing ink receiving layer.
Figure 22A:
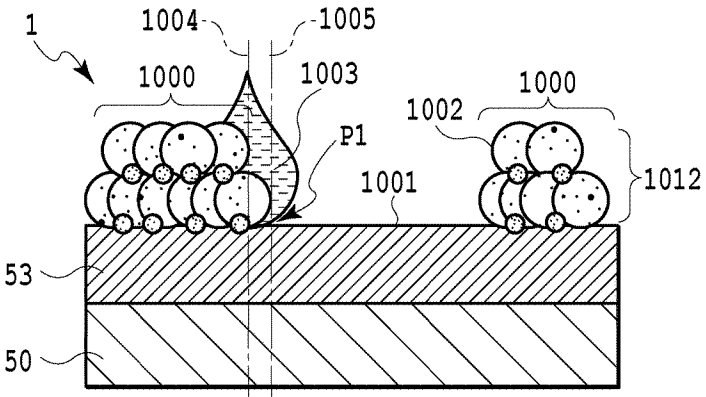
Figure 22C:
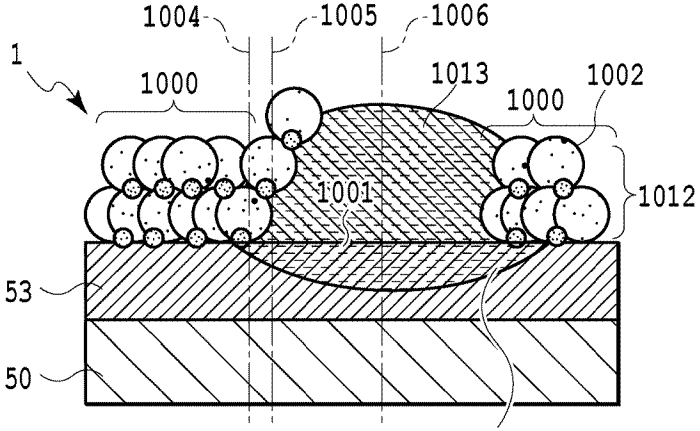

When the ink receiving layer is of the swelling absorbing type, the swelling absorbing ink receiving layer 53 absorbs ink 1003 as depicted in FIG. 22A and FIG. 22B, and thus, a portion 1013 of the ink receiving layer 53 corresponding to the absorbed ink may swell as depicted in FIG. 22C. In such a case, the surface of the adhesive layer 1012 may become uneven to weaken the adhesion. The ink absorption capacity of the swelling absorbing ink receiving layer 53 can be increased even when the swelling absorbing ink receiving layer 53 is thinned. However, the swelling absorbing ink receiving layer swells by absorbing the ink into the area between molecules and thus absorbs the ink at low absorption speed. Thus, even when a portion of the ink having spread after landing extends out from the adhesive portion and passes through the space between the adhesive portions of the adhesive layer in a bypassing manner to come into contact with the exposed portion 1001 of the ink receiving layer 53, that portion exerts only a weak force to drag the remaining portion of the ink into the ink receiving layer 53. Therefore, the ink may remain on the surface of the adhesive layer to hinder the adhesion. Since the swelling absorbing ink receiving layer absorbs the ink at low absorption speed, the speed at which the ink spreads over the surface of the ink receiving layer 53 is higher than the speed at which the ink 1003 is absorbed into the ink receiving layer 53 as depicted in FIG. 22B. Thus, as depicted in FIG. 22C, the ink 1003 spreads over the surface of the ink receiving layer 53. As a result, an image center 1006 is displaced from a landing point P1 (FIG. 22A) to a central portion of the exposed portion 1001, leading to the likelihood of image disturbance. When the ink absorption speed is lower than the ink drying speed, the ink on the surface of the adhesive layer is dried before absorbed. Then, the color material may remain on the surface of the adhesive layer to weaken the adhesion. Therefore, importantly, the ink absorption speed of the ink receiving layer is sufficiently higher than the ink drying speed. That is, importantly, in order to prevent the ink from remaining on the surface of the adhesive layer, the speed is increased at which the ink is dragged into the exposed portion of the ink receiving layer. In view of this, the gap-absorbing ink receiving layer is preferably used.

The gap-absorbing ink receiving layer needs to have air gaps through which the ink is absorbed. The gap-absorbing ink receiving layer may be formed of, for example, diatomaceous earth, a sponge, microfibers, a water absorptive polymer, a set of resin particles and water-soluble resin, or a set of inorganic particulates and water-soluble resin. The speed at which the ink receiving layer formed of such a material is higher than the speed at which the adhesive absorbs the ink. Consequently, when a portion of the ink comes into contact with the exposed portion of the ink receiving layer, the ink present on the surface of the adhesive layer or inside the adhesive layer can be quickly dragged into the ink receiving layer. The ink absorbed through the surface of the ink receiving layer sequentially infiltrates into the ink receiving layer and is absorbed while spreading in the film thickness direction and the horizontal direction, in accordance with the permeability anisotropy of the ink receiving layer. The permeability anisotropy of the ink receiving layer may be designed so as to allow appropriate control of the spread of ink dots that are the basis of ink jet print images. That is, when relatively large ink dots are needed, the permeability may be set higher in the horizontal direction than in the film thickness direction. In contrast, when relatively small ink dots are needed and the amount of ink that can be absorbed is increased, the permeability may be set higher in the film thickness direction than in the horizontal direction.

The gap-absorbing ink receiving layer is preferably configured to contain inorganic particulates and water-soluble resin and to contain the ink in a fine gap structure. In the gap-absorbing ink receiving layer formed of the inorganic particulates and the water-soluble resin, air gaps through which the ink is absorbed are formed in spaces resulting from bonding of particles with the resin to allow a large amount of ink to be absorbed through the air gaps. When the air gaps between the inorganic particulates bound together with the water-soluble resin are substantially uniformly arranged all through the ink receiving layer, the ink can be allowed to substantially isotropically permeate the ink receiving layer.

The structure of the gap-absorbing ink receiving layer formed of the inorganic particulates and the water-soluble resin is easily controlled so as to inhibit a large amount of ink autonomously absorbed into the ink receiving layer from hindering the adhesion. If, during transfer, the gap structure of the ink receiving layer is destroyed to cause the liquid component of the ink to seep through the surface of the ink receiving layer and to turn into a film or the liquid component of the ink is explosively boiled to form an air layer on the adhesion surface between the ink receiving layer and the image substrate, then the adhesion may be hindered. The structure of the gap-absorbing ink receiving layer formed of the inorganic particulates and the water-soluble resin is easily controlled so as to substantially prevent the gap structure of the ink receiving layer from being collapsed.

In the ink receiving layer with the air gaps formed by bonding the inorganic particulates together with the binder formed of the water-soluble resin, the inorganic particulates are a very hard material, and thus, the gap structure is unlikely to be destroyed by pressure or heat. After attachment of the ink receiving layer, the gap structure can be substantially maintained. In such an ink receiving layer, even when the adhesive and the binder are melted, the absorbed ink can be held inside, and possible vapor can be sealed inside. Thus, preferably, particularly appropriate adhesion can be achieved. When the gap structure is maintained in spite of heat during thermocompression bonding, even if the liquid component of the ink is explosively boiled in the individual air gaps to generate vapor, the vapor is sealed in the air gaps so as to prevent an air layer and the like from being formed on the adhesion surface. Thus, appropriate adhesion can be achieved. When the gap structure is substantially maintained in spite of heat during thermocompression bonding, the air gaps are inhibited from being collapsed or being melted on heating, and a main solvent such as water, the liquid component of the ink, and a nonvolatile solvent are prevented from seeping through the surface. Thus, appropriate adhesion can be achieved. The gap-absorbing ink receiving layer formed of the inorganic particulates and the water-soluble resin can be produced without any special orientation processing, and can thus be effectively and efficiently manufactured.

The present inventors' examinations indicate that the gap-absorbing ink receiving layer formed of the inorganic particulates and the water-soluble resin had a gap capacity of 0.1 $cm^3/g$ to approximately 3.0 $cm^2/g$. When a pore volume is less than 0.1 $cm^3/g$, adequate ink absorption performance fails to be delivered, and unabsorbed ink may remain in the ink receiving layer. When the pore volume is more than 3.0 $cm^3/g$, the ink receiving layer exhibits a low strength, leading to the likelihood of cracking or dusting in the ink receiving layer. In short, the gap capacity is preferably set such that, after a portion of the ink having landed on the adhesive layer passes through the space between the adhesive portions in a bypassing manner and comes into contact with the surface of the ink receiving layer, the remaining portion of the ink is absorbed into the ink receiving layer in a dragging manner and the absorbed ink is held inside the ink receiving layer. In spite of the transfer based on thermocompression bonding, the gap capacity present before the transfer is preferably maintained.

When the gap-absorbing ink receiving layer containing the inorganic particulates and the water-soluble resin has the above-described gap capacity, the ink receiving layer has a porosity of approximately 60% to 90%. When the ink receiving layer has a porosity of 60% or less, sufficient ink absorption performance fails to be delivered, and the ink may overflow, with unabsorbed ink remaining in the ink receiving layer. A porosity of more than 90% reduces the strength of the ink receiving layer and may lead to the likelihood of cracking and dusting in the ink receiving layer. In short, the porosity is preferably set such that, after a portion of the ink having landed on the adhesive layer passes through the space between the adhesive portions of the adhesive layer in a bypassing manner to come into contact with the surface of the ink receiving layer, the remaining part of the ink is absorbed into the ink receiving layer in a dragging manner, with the absorbed ink held inside the ink receiving layer. In spite of the transfer based on thermocompression bonding, the porosity present before the transfer is preferably maintained.

The present inventors' examinations indicate that, in the gap-absorbing ink receiving layer containing the inorganic particulates and the water-soluble resin, the ink receiving layer has an average pore size of approximately 10 nm to 60 nm. An average pore size of less than 10 mm may preclude sufficient ink absorption performance from being delivered to cause the ink to overflow, with unabsorbed ink remaining in the ink receiving layer. An average pore size of equal to or more than 60 nm may lead to inadequate coloration and resolution of images, a reduced strength of the ink receiving layer, and the likelihood of cracking and dusting in the ink receiving layer. In short, the average pore size is preferably set such that, after a portion of the ink having landed on the adhesive layer passes through the space between the adhesive portions of the adhesive layer in a bypassing manner to come into contact with the surface of the ink receiving layer, the remaining part of the ink is absorbed into the ink receiving layer in a dragging manner, with the absorbed ink held inside the ink receiving layer. In spite of the transfer based on thermocompression bonding, the average pore size present before the transfer is preferably maintained.

When the adhesive enters the air gaps, which are thus filled with the adhesive, the ink is insufficiently absorbed. Thus, the average particle size of the adhesive and the average pore size of the ink receiving layer are preferably set so as to prevent the average particle size of the adhesive from being smaller than the porosity of the ink receiving layer. The diameter of each of the pores defined by the inorganic particulates and the water-soluble resin increases consistently with the particle size of the inorganic particulates. When the particle size of the inorganic particulates is increased, the amount of the binder of the water-soluble resin immobilizing the inorganic particulates is preferably increased in order to make the strength of the ink receiving layer appropriate. That is, the average diameter of the pores is preferably set by adjusting the amount of the binder according to the particle size of the inorganic particulates such that the ink is absorbed into the ink receiving layer in a dragging manner and that the absorbed ink is held inside the ink receiving layer.

If the color material of the ink is pigment, when an average particle size of the color material is set larger than the average pore size of the gap-absorbing ink receiving layer, the color material component is likely to remain on the surface of the exposed portions of the ink receiving layer. A water component and a solvent component in the ink infiltrate into the ink receiving layer, and thus, the ink is subjected to solid-liquid separation, that is, the color material component of the pigment is separated from the moisture and the solvent component and the color material is likely to remain on the surface of the ink receiving layer. In such a case, the thickness of the adhesive may be set according to the concentration of the pigment ink. That is, all of the color material of the pigment may be stored in the exposed portions of the ink receiving layer so as to prevent the color material remaining on the surface of the ink receiving layer from acting as a factor that affects the adhesion.

For example, on the assumption that, as a result of solid-liquid separation on the surface of the ink receiving layer, all of the pigment, which serves as a color material, remains on the surface of the ink receiving layer, the pigment concentration of the ink is set to approximately 5% as the weight concentration of solids such as the pigment in the aqueous ink that can be stably ejected using the ink jet printing system. In such a case, when the thickness of the adhesive layer is set within the range of approximately three-hundredths to half of the thickness of the ink receiving layer, the color material is prevented from extending up above the height of the adhesive. Thus, the color material remaining on the surface of the ink receiving layer is preventing from acting as a factor that affects the adhesion, allowing appropriate adhesion to be achieved. Furthermore, the color material remaining on the surface of the ink receiving layer can be covered with a sufficient amount of adhesive melted during thermal transfer to form an adhesive film of the molten adhesive between the color material and the image substrate, allowing the adhesion to be further strengthened. For example, when the ink droplet has a volume of 2 pl to 4 pl, the gap-absorbing ink receiving layer has a porosity of 80%, and the print image is colored, the ink receiving layer preferably has a thickness of approximately 8 μm to 16 μm and the adhesive portion has a thickness of approximately 0.3 μm to 8 μm. With an environment-related variation in the volume of the ink droplet and a manufacturing variation in the porosity of the ink receiving layer taken into account, the adhesive portion more preferably has a thickness of 0.5 μm to 5 μm.

When the gap size of the ink receiving layer is set larger than the average particle size of the assumed pigment color material, some of the solid components such as the pigment can infiltrate into the ink receiving layer, enabling a reduction in the thickness of the adhesive layer. However, if the gap size of the ink receiving layer is significantly larger than the average particle size of the pigment and the air gaps in the ink receiving layer are filled with liquid components of the ink to some degree, image bleeding (color material migration) may occur depending on a storage condition for the printed material. That is, along with the liquid components of the remaining ink, the pigment component, serving as a color material, may gradually infiltrate and diffuse through the ink receiving layer. Therefore, when the gap size of the ink receiving layer is slightly larger than the average particle size of the pigment, serving as a color material, or slightly larger than secondary or composite particles of the pigment, permeation of the pigment through the ink receiving layer can be controlled. As a result, a transfer material can be provided which has high image printing characteristics and which is excellent in image preservation.

Extra attention needs to be paid to the above-described color material migration in dye ink that contains no solids because the color material is dissolved in the ink. Thus, for example, links between the air gaps are narrowed so that, when even a very small portion of the ink temporarily absorbed and contained in the air gaps in the ink receiving layer is dried, the links between the air gaps are broken, and portions of the ink remaining in the air gaps are likely to be isolated from one another.

Figure 23B:
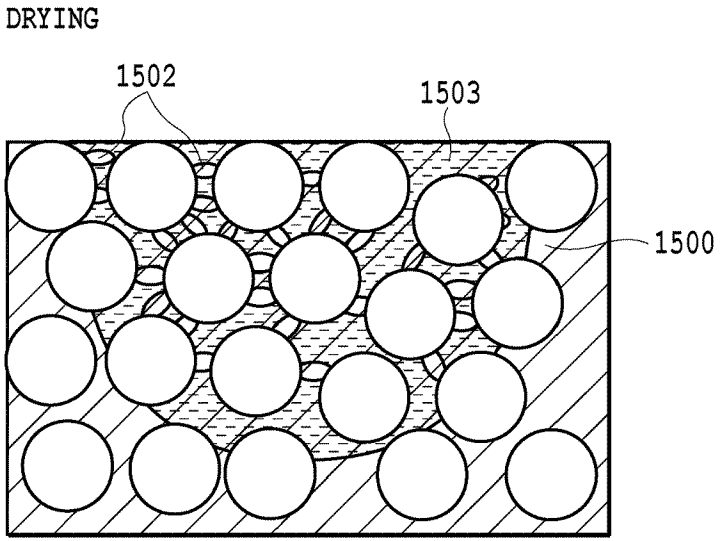
FIGS. 23A and 23B are diagrams illustrating a relation between air gaps in the ink receiving layer and ink.
Figure 23A:
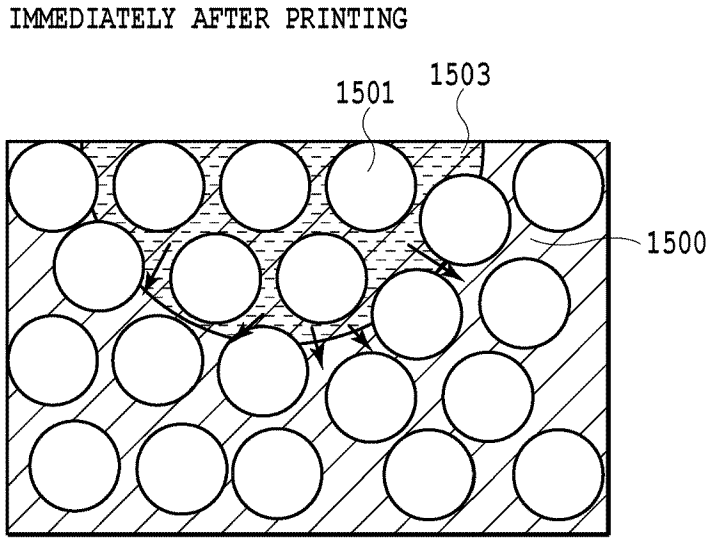

As depicted in FIG. 23A, immediately after dye ink is absorbed into the air gaps in the gap-absorbing ink receiving layer containing inorganic particulates 1501 and the water-soluble resin, the continuous dye ink 1503 infiltrates into air gaps 1500 without being separated into ink portions. At this time, not all of the air gaps in the ink receiving layer are replaced with the ink, and air remains in some of the air gaps. When even a very small portion of the ink vaporizes, a portion of the air remaining at the links between the air gaps 1500 migrates to form air layers 1502, as depicted in FIG. 23B. The continuous ink 1503 having infiltrated into the air gaps 1500 is separated into portions of the ink by the air layers 1502, and the portions of the ink in the air gap 1500 are isolated from one another. The portions of the ink 1503 separated and isolated from one another by the air layers 1502 are unlikely to migrate because the air layers 1502 offer resistance to the migration. These effects allow image bleeding (color material migration) to be suppressed even when dye ink is used.

Figure 24B:
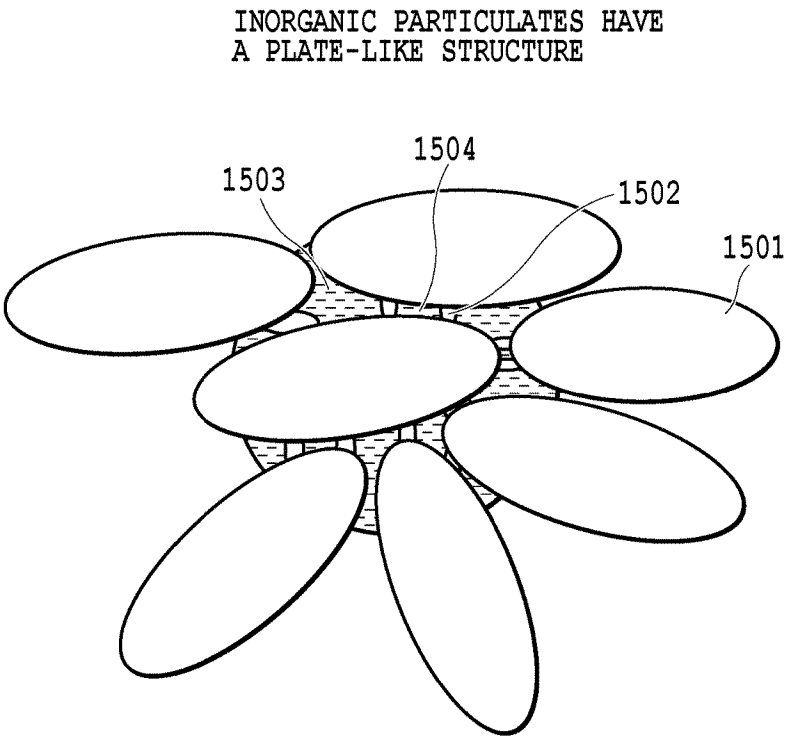
FIG. 24A and FIG. 24B are diagrams illustrating a relation between inorganic particulates contained in the ink receiving layer and ink.
Figure 24A:
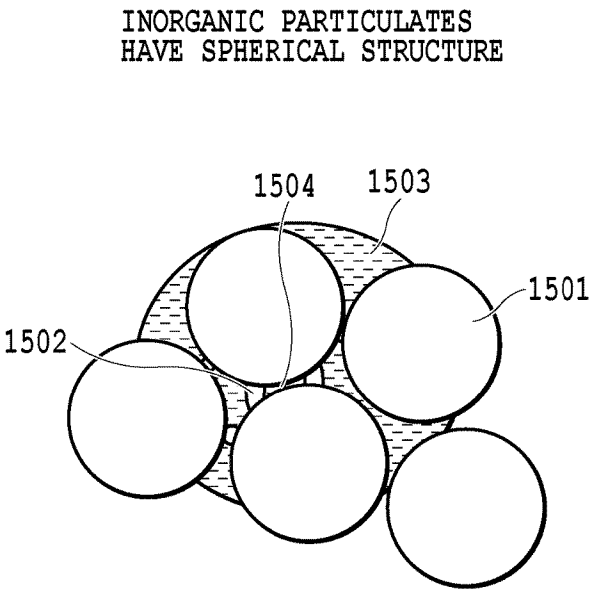

Specifically, as depicted in FIG. 24A and FIG. 24B, links 1504 between the air gaps in the ink receiving layer are preferably narrowed so that, when the ink in the air gap is separated into portions of the ink, the portions of the ink remaining in the air gaps are likely to be isolated from one another. In the gap-absorbing ink receiving layer containing the inorganic particulates 1501 and the water-soluble resin, in many cases, the inorganic particulates 1501 are spherical as depicted in FIG. 24A, or are shaped like flat plates as depicted in FIG. 24B, or have a spindle structure. Thus, when the ink receiving layer is formed, the inorganic particulates 1501 are irregularly oriented and are likely to narrow the links 1504 between the air gaps in the ink receiving layer. As a result, the links between the air gaps are separated, the portions of the ink remaining in the air gap being likely to be isolated from one another.

Figure 25B:
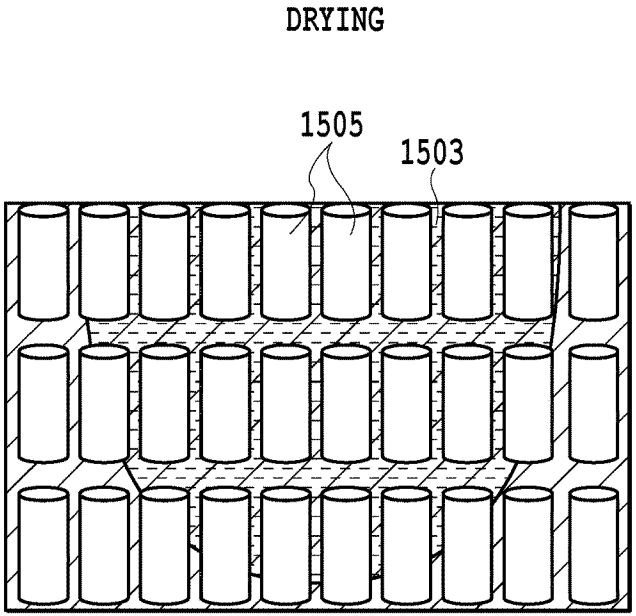
FIG. 25A and FIG. 25B are diagrams illustrating a relation between fibers contained in the ink receiving layer and ink.
Figure 25A:
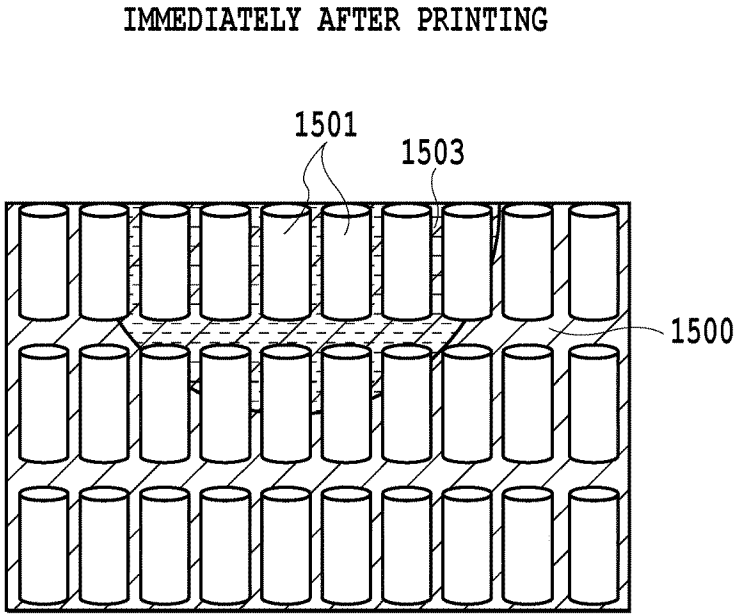

However, when the gap-absorbing ink receiving layer is formed of cilium-like fibers 1505 or the like as depicted in FIG. 25A, since the fibers 1505 are regularly oriented, the links between the air gaps in the ink receiving layer are likely to be shaped to be continuous. Thus, even when the ink 1503 is slightly dried, the ink 1503 in the air gaps is difficult to separate into ink portions as depicted in FIG. 25B. The ink remaining in the air gaps remains continuous in the same manner as immediately after ink absorption, leading to the likelihood of migration. Therefore, the use of the gap-absorbing ink receiving layer containing the inorganic particulates and the water-soluble resin as in the present invention is also effective for the case of the dye ink.

In the present invention, the gap capacity, the porosity, and the pore size of each air gap can be calculated using a BET method. The "BET method" is a measuring method for the surface area of powder based on gas phase adsorption, and involves measuring the total surface area of a 1 g sample based on an adsorption isotherm. A pore volume is the volume of a pore with a radius of 0.7 nm to 100 nm calculated based on a BJH method using a nitrogen desorption isotherm. The average pore size is the diameter of a pore with a cumulated pore volume that is half the cumulated pore volume of a pore with a radius of 0.7 nm to 100 nm as indicated by a cumulated pore volume distribution curve determined based on the BJH method using a nitrogen desorption isotherm. The porosity is the ratio of the pore volume to the total pore volume. Nitrogen gas is normally often used as an adsorption gas, and a method is most often used in which the adsorption amount is measured based on a variation in the pressure or volume of the adsorption target gas. The BET method (Brunauer, Emmett, and Teller Equation) is known as a method for representing an isotherm of multi-molecular adsorption, and is widely used to determine a specific surface area.

The gap-absorbing ink receiving layer may be formed in which air gaps are formed by using, instead of the inorganic particulates, resin particles that have a melting temperature Tg higher than a transfer temperature and that are thus unlikely to be melted or deformed during thermocompression bonding, and bonding the resin particles together with the binder resin. Those of the resin particles which have a melting temperature Tg higher than a transfer temperature maintain a particle structure in spite of heat during transfer. This prevents a situation where the resin particles are melted by the heat during transfer to collapse the air gaps. The resin particles having a melting temperature higher than a transfer temperature have a high Tg. Most of the resin particles with such a high Tg generally have a rigid molecule structure forming the resin particles and are thus relatively hard. Thus, the air gaps are prevented from being collapsed by pressure. As described above, the air gaps are prevented from being collapsed by pressure or melted by heat, in turn preventing a main solvent such as water, the liquid component of the ink, and a nonvolatile solvent from seeping through the surface. Thus, appropriate adhesion can be achieved.

As an example of the gap-absorbing ink receiving layer, component materials of the ink receiving layer containing the water-soluble resin and at least the inorganic particulates will be described below in detail.

[3-1-1] Inorganic Particulates

The inorganic particulates are formed of an inorganic material. The inorganic particulates function to form air gaps in which the color material is contained.

The type of the inorganic material contained in the particulates is not particularly limited. However, the inorganic material preferably has a large absorptive capacity and an excellent color developing property and enables high-quality images to be formed. Examples of the inorganic material include calcium carbonate, magnesium carbonate, kaolin, clay, talc, hydrotalcite, aluminum silicate, calcium silicate, magnesium silicate, diatomaceous earth, alumina, colloidal alumina, aluminum hydroxide, an alumina hydrate of boehmite structure, an alumina hydrate of pseudo-boehmite structure, lithopone (a mixture of barium sulfate and zinc sulfide), and zeolite.

For the inorganic particulates, the average particle size is preferably precisely controlled. Reducing the average particle size of the inorganic particulates allows light scattering to be suppressed, enhancing the transparency of the ink receiving layer. For example, if an attachable and transferrable transfer material with a transparent protective layer is used and an image is viewed from the transparent protective layer side, then normally, the protective layer, a part of the substrate layer, needs to be sufficiently transparent, and the ink receiving layer itself needs to have a certain degree of transparency. Thus, using inorganic particulates with a small average particle size for the ink receiving layer is effective. When the inorganic particulates have a reduced average particle size, the ink receiving layer has a reduced gap size and thus a reduced ink absorption capacity. Thus, the ink receiving layer needs to be sufficiently thick.

Increasing the average particle size of the inorganic particulates in the ink receiving layer enables an increase in the pore size of the ink receiving layer. Thus, the use of pigment ink enables some of the solid components such as the pigment to infiltrate into the ink receiving layer. The transparency of the ink receiving layer may be reduced by light scattering by the inorganic particulates. Thus, if print information needs to be secret, increasing the particle size of each inorganic particulate is effective. On the other hand, an increased particle size of the inorganic particulate weakens the ink receiving layer. In such a case, to keep the ink receiving layer sufficiently strong, the amount of the binder of the water-soluble resin immobilizing the inorganic particulates may be increased. As described above, the average particle size of the inorganic particulates may be selected according to the intended use of the transfer material and the printed material in view of the absorptivity of the ink receiving layer and the transparency of the ink receiving layer. The average particle size of the inorganic particulates as described above is preferably 120 nm to 10 μm, more preferably 120 nm to 1 μm, and much more preferably 140 nm to 200 nm.

The average particle size and polydispersity index as used herein can be determined by analyzing values measured by a dynamic light scattering method, using a cumulant approach described in "Chapter 1 Light Scattering in Structure of Polymer (2) Scattering Experiments and Morphological Observations" (published by KYORITSU SHUPPAN CO., LTD. and edited by The society of Polymer Science, Japan) or J. Chem. Phys., 70 (8), 15 April, 3965 (1979). The average particle size defined in the present embodiment can be easily measured using, for example, a laser particle size analyzer PARIII (manufactured by OTSUKA ELECTRONICS Co., Ltd.).

One type of inorganic particulates may be used alone or two or more types of inorganic particulates may be mixed together. "Two or more types" of inorganic particulates include inorganic particulates of different materials and inorganic particulates with different characteristics such as different average particle sizes or different polydispersity indices.

[3-1-2] Water-Soluble Resin

The water-soluble resin is a resin that adequately mixes with water or that has a solubility of 1 (g/100 g) or more, at 25° C. For the gap absorbing type, the water-soluble resin functions as a binder that binds inorganic particulates together. When the transfer material and the image substrate are attached together, the water-soluble resin is melted at the glass transition temperature or higher during the attachment to adhere to the image substrate.

Examples of the water-soluble resin include starch, gelatin, casein, and modified materials thereof;

cellulose derivatives such as methylcellulose, carboxymethylcellulose, and hydroxyethylcellulose;

polyvinyl alcohols (completely saponified polyvinyl alcohol, partially saponified polyvinyl alcohol, low saponified polyvinyl alcohol, or the like) and modified resins thereof (cation modified resin, anion modified resin, modified resin, and the like); and resins such as urine-based resin, melamine-based resin, epoxy-based resin, epichlorohydrin-based resin, polyurethane-based resin, polyethyleneimine-based resin, polyamide-based resin, polyvinyl pyrrolidone-based resin, polyvinyl butyral-based resin, poly (meth)acrylic acid or copolymer resin thereof, acrylamid-based resin, maleic anhydride-based copolymer resin, and polyester-based resin.

Among the water-soluble resins, saponified polyvinyl alcohol is preferable which is obtained by hydrolyzing (saponifying) polyvinyl alcohol, particularly polyvinyl acetate.

The ink receiving layer is preferably a composition containing polyvinyl alcohol with a degree of saponification of 70 to 100 mol %. The saponification means the percentage of the amount by mole of a hydroxyl group of the polyvinyl alcohol relative to the total amount by mole of an acetate group and the hydroxyl group of the polyvinyl alcohol.

Setting the degree of saponification preferably to 70 mol % or more and more preferably to 86 mol % or more allows the ink receiving layer to be provided with the appropriate hardness. In particular, in the transfer material including the substrate from which the conveyance layer can be peeled off and from which the functional layer such as the transparent protective layer is not peed off, the ink receiving layer can be more appropriately cut off during the peeling step, allowing suppression of possible burrs at the ends of the ink receiving layer. This also enables a reduction in the viscosity of a coating liquid containing inorganic particulates and polyvinyl alcohol. Therefore, the coating liquid can be easily applied to the transparent protective layer, allowing the transfer material to be more effectively and efficiently produced. Setting the degree of saponification preferably to 100 mol % or less and more preferably to 90 mol % or less provides the ink receiving layer with appropriate flexibility. In particular, in the transfer material including the substrate from which the conveyance layer can be peeled off and from which the functional layer such as the transparent protective layer is not peed off, the adhesive strength between the transparent protective layer and the ink receiving layer is improved to allow suppression of peel-off of the ink receiving layer from the transparent protective layer due to insufficient adhesive strength. Furthermore, the ink receiving layer can be provided with appropriate hydrophilicity, facilitating absorption of ink. Therefore, a high-quality image can be printed on the ink receiving layer.

The ink receiving layer is preferably a composition containing polyvinyl alcohol with a weight-average degree of polymerization of 2,000 to 5,000.

The ink receiving layer can be provided with appropriate flexibility by setting the weight-average degree of polymerization preferably to 2,000 or more and more preferably to 3,000 or more. Therefore, during a peeling step, the ink receiving layer can be more appropriately cut off, allowing suppression of possible burrs at the ends of the ink receiving layer. The ink receiving layer can be provided with appropriate hardness by setting the weight-average degree of polymerization preferably to 5,000 or less and more preferably to 4,500 or less. This improves the adhesive strength between the transparent protective layer and the ink receiving layer to allow suppression of peel-off of the ink receiving layer from the transparent protective layer due to insufficient adhesive strength. This also enables a reduction in the viscosity of a coating liquid containing inorganic particulates and polyvinyl alcohol. Therefore, the coating liquid can be easily applied to the transparent protective layer, allowing the transfer material to be more effectively and efficiently produced. Furthermore, the pores in the ink receiving layer can be prevented from being filled and can be appropriately kept open, facilitating absorption of ink. Therefore, a high-quality image can be printed on the ink receiving layer.

The values of the weight-average degree of polymerization are calculated in compliance with a method described in JIS-K-6726.

One type of water-soluble resin may be used alone or two or more types of water-soluble resins may be mixed together. "Two or more types" of water-soluble resins include water-soluble resins with different characteristics such as different degrees of saponification or different degrees of weight-average degrees of polymerization.

The amount of the water-soluble resin is preferably 3.3 to 20 pts·wt. relative to 100 pts·wt. inorganic particulates. When the amount of the water-soluble resin is preferably 3.3 pts·wt. or more and more preferably 5 pts·wt. or more, the air gaps are prevented from being collapsed by pressure or heat and an ink receiving layer with an appropriate strength can be formed. When the amount of the water-soluble resin is preferably 20 pts·wt. or less and more preferably 15 pts·wt. or less, an optimal amount of binder is provided for the air gaps in the ink receiving layer. Thus, the ink can be appropriately absorbed, and the air gaps between the inorganic particulates bound together with the water-soluble resin can be substantially uniformly arranged throughout the ink receiving layer, allowing substantially isotropic permeation of the ink. When the amount of the water-soluble resin is 3.3 pts·wt. or less, only a small amount of binder binding the inorganic particulates together is provided. Thus, the ink receiving layer is weakened, possibly causing fissuring and dusting of the ink receiving layer. This is not preferable. When the amount of the water-soluble resin is 20 pts·wt. or more, a larger amount of water-soluble resin is provided and buries the air gaps in the ink receiving layer, resulting in inappropriate ink absorption. This is not preferable.

[3-1-3] Cationic Resin

The ink receiving layer in the present embodiment may contain cationic resin.

[3-2] Material of the Adhesive

As described above, the transfer material in the present embodiment is configured such that the gap-absorbing ink receiving layer is formed on the substrate and that the adhesive pieces of the adhesive layer are discretely provided on the surface of the ink receiving layer so as to leave the remaining portions of the surface of the ink receiving layer directly exposed. Preferably, the adhesive pieces of the adhesive layer do not substantially absorb the ink or the adhesive pieces absorb the ink but only at low absorption speed. A portion of the ink having landed on the adhesive layer passes through the space between the adhesive portions of the adhesive layer in a bypassing manner, comes into direct contact with the corresponding exposed portion of the ink receiving layer, and starts to be absorbed into the ink receiving layer. Then, the remaining portion of the ink that is continuous with the above-described portion is sequentially drawn into the ink receiving layer without interruption. That is, the ink comes into quick contact with the exposed portion of the ink receiving layer and is absorbed into the ink receiving layer at a point of contact with the exposed portion (sea portion), which absorbs the ink at high absorption speed, in a dragging manner. Therefore, the ink is unlikely to remain on the surface of the adhesive portion or inside the adhesive portion. As described above, the adhesive is not directly related to the ink absorption. Thus, the material of the adhesive is not related to the ink and may be selected with emphasis placed on the adhesion between the adhesive and the image substrate. Therefore, the transfer material in the present embodiment can be attached to various image substrates. Specifically, according to the material of a particular image substrate attached to the transfer material, a user may select one of well-known adhesives that adheres firmly to the image substrate. For example, it is possible to select an adhesive that adheres firmly to a particular image substrate formed of plastic such as PET, PVC, PET-G, acrylic, polycarbonate, POM, ABS, PE, or PP, paper, glass, woods, or metal.

Examples of well-known adhesives include, as organic natural materials, starch-based materials such as uncooked wheat gluten, dextrin, and rice paste, protein-based materials such as glue, cassein, and soy protein, natural rubber-based materials, lacquer, pine resin, wax, and asphalt.

Examples of organic synthetic materials include vinyl acetate-based materials, polyol-based materials, polyvinyl acetal-based materials, vinyl acetate copolymer-based materials, ethylene-vinyl acetate-based materials, vinyl chloride-based materials, acrylic-based materials, polyester-based materials, polyamide-based materials, cellulose-based materials, olefin-based materials, styrene-based materials, urea-based materials, melamine-based materials, phenol-based materials, resorcinol-based materials, epoxy-based materials, polyurethane-based materials, silicone-based materials, polyamide-based materials, polybenzimidazole-based materials, polyimide-based materials, isocyanate-based materials, chloroprene rubber-based materials, nitrile rubber-based materials, styrene-butadiene rubber-based materials, polysulfide-based materials, butyl rubber-based materials, silicone rubber-based materials, acrylic rubber-based materials, modified silicone rubber-based materials, urethane rubber-based materials, and silylated urethane resin-based materials.

Examples of inorganic materials include water glass-based materials such as sodium silicate, cement-based materials such as portland cement, plaster, gypsum, magnesia cement, and litharge cement, and ceramics-based materials. The adhesive is not limited to the above-described materials.

One or more types of adhesives may be selected. As in the adhesive 1002 in FIG. 1, an adhesive 1002(1) that adheres firmly to a particular image substrate and an adhesive 1002(2) that is highly compatible with the ink receiving layer may be selected to allow achievement of appropriate adhesion both to the image substrate and to the ink receiving layer.

An adhesive that adheres firmly to a particular image substrate may be of a stimulation activated type that is made by external stimulation to adhere to a particular image substrate. The stimulation activated adhesive is not particularly limited but a well-known stimulation activated adhesive may be used. For example, stimulation activated adhesives may be used for which heat, pressure, water, light, a reactant, or the like is used as an external stimulation.

For example, the stimulation activated adhesive may be a thermal adhesive for which heat is used as external stimulation and which contains, as a main component, thermoplastic resin that is melted when the adhesive is heated at the glass transition temperature of the adhesive or higher to make the adhesive to adhere to image substrate. The stimulation activated adhesive may be a pressure-sensitive adhesive for which pressure is used as external stimulation and which can be attached to the image substrate simply by applying a slight pressure to the adhesive at normal temperature for a short time. The stimulation activated adhesive may be a water activation adhesive, that is, a remoistening adhesive, for which water is used as external stimulation and which is made to adhere to the image substrate by applying water to the adhesive in a dray state. When the water activation adhesive is used, water adheres to the adhesion surface when the transfer material is attached to the image substrate. Thus, the color material of the ink preferably offers water resistance and may be, for example, a waterproof dye and more preferably a pigment.

When the transfer material is used without being attached to a particular image substrate, a self-melt-adhesion adhesive may be used in order to protect the printing surface subjected to ink jet printing. The self-melt-adhesion adhesive includes adhesive pieces which are provided on the ink receiving layer and which are melted such that the adjacent adhesive pieces adhere to each other. When the self-melt-adhesion adhesive is used, the adhesive pieces provided on the ink receiving layer are melted such that the adjacent adhesive pieces adhere to each other while covering the printing surface subjected to ink jet printing. Consequently, the printing surface subjected to ink jet printing is protected by the self-melt adhesive to enhance the abrasion resistance of the printed material.

The color and the transparency of the adhesive may be determined according to the intended use of the transfer material and the printed material. The adhesive may be transparent, translucent, or opaque or may be colored. For example, when print contents are made visible both from the substrate side and from the adhesive layer side, the adhesive may be transparent. When the print contents are made visible from the substrate side, the adhesive may be transparent. When the print contents are made visible from the adhesive layer side, the adhesive may be transparent or may be colored in order to provide a background color. As described below, the adhesive may be in white in order to conceal print information. In that case, the adhesive may have a particle size larger than the wavelength of visible light.

[3-3] Material of the Substrate

The material of the substrate may be selected according to the intended use of the transfer material and the printed material, and is not particularly limited.

Examples of the resin film included in the substrate may include:

polyester resins such as polyethylene terephthalate, polybutylene terephthalate, and a polyethylene terephthalate/isophthalate copolymer;

polyolefin resins such as polyethylene, polypropylene and polymethylpentene;

polyethylene fluoride-based resins such as polyvinyl fluoride, polyvinylidene fluoride, polytetrafluoroethylene, and an ethylene-polytetrafluoroethylene copolymer;

aliphatic polyamide resins such as nylon 6 and nylon 6, 6;

vinyl polymer resins such as polyvinyl chloride, a vinyl chloride/vinyl acetate copolymer, an ethylene/vinyl acetate copolymer, an ethylene/vinyl alcohol copolymer, polyvinyl alcohol, and vilylon;

cellurose-based resins such as cellulose triacetate and cellophane;

acrylic-based resins such as polymethyl methacrylate, polyethyl methacrylate, polyethyl acrylate, and polybutyl acrylate; and other synthetic resins such as polystyrene, polycarbonate, polyarylate, and polyamide.

One type of resin film may be independently used or two more types of resin films may be combined or laminated together. Other examples may include glass, metal plates, and woods.

When the substrate includes a releasable layer formed of a composition containing a releasing agent, the type of the releasing agent is not particularly limited. Preferably, a material of the releasing agent is excellent in releasability and is not easily dissolved by heat generated by a heat roller or an ink jet print head (in particular, a thermal ink jet print head including electrothermal transducing elements (heaters) serving as ejection energy generating elements). For example, a silicone-based material such as silicone wax represented by waxes or silicone resin and a fluorine-based material such as fluorine resin are preferable because these materials are excellent in releasability.

[3-3-1] Material of the Substrate in which the Conveyance Layer is not Peeled Off When the transfer material in which the conveyance layer of the substrate is not peeled off is used to produce a construction material, a poster, wallpaper, or a sign display plate, PET, acrylic, polycarbonate, and POM, included in the above-described substrates, are preferably used.

When the transfer material is used as a packaging material, a resin film formed of polypropylene-based resin, included in the above-described substrates, is preferably used. Examples of the polypropylene-based resin include not only crystalline popypropylene (homopolypropylene) but also a copolymer or a terpolymer of ethylene, butene, pentene, hexene, or the like so long as the resin exhibits a certain degree of rigidity.

When the transfer material is used as a packaging material, the substrate may include a heat seal layer opposite to a surface in which the ink receiving layer is formed. As a heat sealing resin material contained in the heat seal layer, at least one of a polyethylene-based resin and a polypropylene-based resin is preferably used. Examples of the polyethylene-based resin include HDPE, LDPE, and L.LDPE.

The propylene-based resin is attachable at relatively low temperature and is thus preferably used as a heat sealing resin material. The heat sealing resin material preferably has a lower melting point than the polypropylene-based resin or the like which may form the substrate. As such a material, the following are preferably used: an ethylene butene-1 copolymer, an ethylene-propylene-butene-1 copolymer, an ethylene-acrylate copolymer, an ionomer resulting from crosslinking of ethylene-acrylate copolymer molecules with metal ions, a polybutene-1, a butene-ethylene copolymer, a propylene-ethylene copolymer, a propylene-butene-1 copolymer, a propylene-pentene copolymer, a mixture of two or more of these materials, and a mixture of polypropylene with any of the above-described materials. No restriction is imposed on the material of the heat seal so long as the adhesion can be achieved according to the intended use of the transfer material.

The thickness of the heat seal layer is not particularly limited. However, the thickness of the heat seal layer is preferably set to 0.5 μm or more and 40 μm or less. When the thickness of the heat seal layer is set to 0.5 μm or more and more preferably to 1 μm or more, heat is appropriately transferred during thermocompression bonding and the adhesion between the ink receiving layer and the heat seal layer is strengthened. When the thickness of the heat seal layer is set to 40 μm or less and more preferably to 10 μm or less, the transparency of the heat seal layer can be enhanced.

The heat seal layer can be formed by laminating the heat sealing resin material to the substrate by dry lamination, extrusion lamination, or the like. Available methods for forming a heat seal layer by extrusion lamination includes (i) extrusion lamination involving applying an anchoring agent such as an organic titanate-based agent, polyethyleneimine, a urethane-based agent, or a polyester-based agent to the substrate, melting and extrusion-molding PP, EVA, an ionomer, or the like into a film form, and thus forming a heat seal layer on the surface of the substrate to which the anchor agent has been applied; and (ii) coextrusion lamination involving using two or more extruders to melt a resin serving as a substrate and a resin serving as a heat seal layer and to join the resins together inside a die or at an opening of the die.

[3-3-2] Material of the Substrate in which the Conveyance Layer is Peeled

The transfer material in which the conveyance layer of the substrate is peeled off may be used in the field of various security cards such as ID cards, company ID cards, and credit cards, in the field of notifications for public documents such as an a social security and tax number and a passport, and in the fields of pharmacology and pathology concerning embedding cassettes and the like. For such applications, among the above-described substrates, PET is preferable. The peelable substrate may include a transparent protective layer and hologram layer.

[3-3-3] Material of the Transparent Protective Layer

The component materials of the transparent protective layer will be described below. The transparent protective layer may be formed using one or more resin particles but preferably contain two types of resin (a resin E1 and a resin E2) with different glass transition temperatures.

Examples of a preferable material for the resin E1 include resins such as an acrylic-based resin, a vinyl acetate resin, a vinyl chloride resin, an ethylene/vinyl acetate copolymer resin, a polyamide resin, a polyester resin, a urethane-based resin, and a polyolefin resin, and copolymer resins thereof. Among these resins, the acrylic-based resin is particularly preferably used because the resin can be formed into a film at relatively low temperature, with the resultant coating film having high transparency, and because the resin has an SP value close to the SP value of saponified polyvinyl alcohol contained as water-soluble resin to allow the adhesion to be strengthened.

The material of the resin E2 may be the same as the material of the resin E1 but is preferably a urethane resin because the urethane resin allows the transparent protective layer to be made appropriately soft and to be prevented from being sticky. The urethane resin further makes the film less brittle and improves solubility to chemicals, making the transparent protective layer less likely to be subjected to fissuring, peel-off, or the like even when the transparent protective layer is immersed in a chemical such as alcohol and enhancing chemical resistance. The resin E2 is preferably a resin different from the resin of the resin E1. The use of different types of resins of the resin E1 and E2 makes the resins unlikely to be compatible with each other, making coexistence of films and particles likely to be maintained before transfer and allowing the transparent protective layer to be appropriately cut off. When the resin E1 is an acrylic-based resin, the resin E2 is particularly preferably a urethane-based resin.

The transparent protective layer may contain a water-swelling resin and have a mechanism that discharges moisture to the outside in order to prevent the transparent protective layer from fissuring when the ink jet printed material is immersed in water for a long time. Examples of the water-swelling resin include water-soluble resins that are swollen with and dissolved into water and water-absorbing resins that is insoluble to water.

The type of the water-soluble resin is not particularly limited. For example, the same water-soluble resin used for the above-described ink receiving layer may be used for the transparent protective layer. In particular, saponified polyvinyl alcohol is preferable which is obtained by hydrolyzing (saponifying) polyvinyl acetate.

The polyvinyl alcohol used for the transparent protective layer is preferably a composition containing polyvinyl alcohol with a degree of saponification of 75 to 100 mol %.

The transparent protective layer is preferably a composition containing polyvinyl alcohol with a weight-average degree of polymerization of 1,500 to 5,000. Setting the weight-average degree of polymerization within such a range, the amount by which the polyvinyl alcohol is swollen with absorbed water can be optimized. Consequently, moisture can be vaporized through the surface of the transparent protective layer to more appropriately suppress possible fissuring. Moreover, the moisture absorption speed can be kept down, protecting the print information from liquid contamination.

[3-3-4] Material of the Hologram Layer

Now, the component materials of the hologram layer will be described. Examples of a photosensitive material for hologram formation that is used to print interference fringes include silver halidet, dichlomated gelatin, thermoplastics, diazo-based photosensitive material photoresist, ferroelectrics, photochromic materials, and chalcogen glass. Examples of a material for the hologram formation layer may include thermoplastic resins such as polyvinyl chloride, an acrylic resin (for example, polymethylmethacrylate), polystyrene, and polycarbonate. Examples of the material for the hologram formation layer may further include materials resulting from curing of thermosetting resins such as unsaturated polyester, melamine, epoxy, polyester (meth) acrylate, urethane (meth)acrylate, epoxy (meth)acrylate, polyether (meth)acrylate, polyol (meth)acrylate, melamine (meth) acrylate, and triazine-based acrylate. The material for the hologram formation layer may also be a mixture of any of the thermoplastic resins and any of the thermosetting resins.

[3-3-5] Thickness of the Substrate

The thickness of the substrate may be determined as needed in view of appropriate conveyance and appropriate material strength taken into account and is not particularly limited. The thickness of the substrate is preferably 5 to 300 μm.

When the thickness of the substrate is preferably 5 μm or more and more preferably 15 μm or more, the transfer material can be more appropriately conveyed if an image is printed on the transfer material and if the transfer material is attached to the image substrate after ink jet printing. When the transfer material is formed into a cut sheet or a plate form, the substrate is preferably strong, hard, and thick. In this case, the thickness of the substrate is preferably 30 μm or more. When the thickness of the substrate is 300 μm or less, more preferably 100 μm or less, and much more preferably 50 μm or less, heat can be appropriately transmitted through the substrate when, after ink jet printing, the transfer material is heated and attached to the image substrate.

[3-4] Material of the Image Substrate

The material of the image substrate is not particularly limited. Examples of the image substrate include an image substrate containing resin as a component material (resin-based substrate) and an image substrate containing paper as a component material (paper-based substrate). The resin contained in the resin-based substrate is selected as needed according to the intended use of the image substrate and is not particularly limited. The resin may be similar to the resin contained in the substrate.

Examples of the resin include:

polyester resins such as polyethylene terephthalate, polybutylene terephthalate, a polyethylene terephthalate/isophthalate copolymer;

polyolefin resins such as polyethylene, polypropylene and polymethylpentene;

polyethylene fluoride-based resins such as polyvinyl fluoride, polyvinylidene fluoride, polytetrafluoroethylene, and an ethylene-polytetrafluoroethylene copolymer;

aliphatic polyamide resins such as nylon 6 and nylon 6, 6;

vinyl polymer resins such as polyvinyl chloride, a vinyl chloride/vinyl acetate copolymer, an ethylene/vinyl acetate copolymer, an ethylene/vinyl alcohol copolymer, polyvinyl alcohol, and vilylon;

cellurose-based resins such as cellulose triacetate and cellophane;

acrylic-based resins such as polymethyl methacrylate, polyethyl methacrylate, polyethyl acrylate, and polybutyl acrylate; and other synthetic resins such as polystyrene, polycarbonate, polyarylate, and polyamide.

Examples of the resin contained in the resin-based substrate may include biodegradable resins such as aliphatic polyester, polycarbonate, polyactic acid, polyvinyl alcohol, cellulose acetate, and polycaprolactone. Any resin-based substrate may be used so long as the substrate contains resin as a main component material. The resin-based substrate may contain materials other than the resins, for example, a metal foil.

The type of the paper contained in the paper-based substrate is not particularly limited. Examples of the paper contained in the paper-based substrate may include capacitor paper, glassine paper, parchment paper, paper with a high sizing degree, synthetic paper (polyolefin-based or polystyrene-based), high-quality paper, art paper, coat paper, cast-coated paper, wall paper, backing paper, synthetic-resin or emulsion impregnated paper, synthetic-rubber-latex impregnated paper, synthetic resin-containing paper, paperboards, cellulose fiber paper, and cellulose nanofibers.

The resin-based substrate and the paper-based substrate may include embossment, a signature, an IC memory (IC chip), optic memory, a magnetic recording layer, forgery-preventive recording layer (a pearl pigment layer, a watermark recording layer, micro characters, or the like), an embossment recording layer, and an IC chip masking layer as needed. The resin-based substrate and the paper-based substrate may be configured as a single-layer element containing any of the above-described materials or a multilayer element including two or more sheets or films laminated together and having different materials or thicknesses. Other examples of the substrate include plates formed of glass, metal plates, woods, or plate formed of the above-described resins. In short, when the transfer material is used in which the adhesive layer is formed of the adhesive selected as needed according to the material and the intended use of the image substrate, that is, in which the adhesive layer is discretely formed on the surface of the ink receiving layer, the optimal material of the image substrate can be freely selected without limitation according to the intended use.

[4] Manufacturing Method for the Transfer Material

The transfer material in the present invention can be manufactured by, for example, coating the substrate with a coating liquid containing the inorganic particulates, the water-soluble resin, and the cationic resin to form an ink receiving layer on the substrate and further coating the ink receiving layer with a coating liquid containing the adhesive. With the above-described matters omitted, only matters specific to the manufacturing method will be described below.

[4-1] Manufacturing Method for the Substrate

The substrate may be configured, for example, such that the conveyance layer of the substrate is not peeled off or that the conveyance layer of the substrate is peeled off, depending on the intended use. The substrate can be manufactured using a well-known method.

[4-1-1] Formation Method for the Transparent Protective Layer

A formation method for the transparent protective layer will be described in which only the conveyance layer is peeled off after the adhesion processing (a part of the substrate is peeled off). The transparent protective layer can be formed by preparing a coating liquid for the transparent protective layer containing the resin E1 and the resin E2, coating the surface of the substrate with the coating liquid, and then drying (heating) the substrate.

As the medium for the coating liquid, an aqueous medium is preferably used. Examples of the aqueous medium include water and a mixed solvent of water and a water-soluble organic solvent. Examples of the water-soluble organic solvent include:

alcohols such as methanol, ethanol, and propanol;

lower alkyl ethers of polyalcohols such as ethylene glycol monomethyl ether and ethylene glycol dimethyl ether;

ketones such as acetone and methylethyl ketone; and ethers such as tetrahydrofuran.

The coating liquid may contain various additives so long as the containment inhibits the effects of the present invention.

[4-1-1-1] Coating

The transparent protective layer can be formed by coating the substrate with a coating liquid containing a resin by roll coating, rod bar coating, spray coating, air knife coating, a slot die coating, or the like and drying the coating liquid.

The coating amount of the coating liquid for the transparent protective layer is set preferably to 1 to 40 g/m$^2$, more preferably to 2 to 30 g/m$^2$, and much more preferably 4 to 20 g/m$^2$. When the coating amount is set preferably to 1 g/m$^2$ or more, more preferably to 2 g/m$^2$ or more, and much more preferably to 4 g/m$^2$ or more, appropriate water resistance and appropriate abrasion resistance can be achieved. When the coating amount is set preferably to 40 g/m$^2$ or less, more preferably 30 g/m$^2$ or less, and much more preferably to 20 g/m$^2$ or less, the transparency of the transparent protective layer can be enhanced. Moreover, heat is more appropriately transmitted through the transparent protective layer to allow the transparent protective layer and the ink receiving layer to more closely contact each other (transfer performance).

[4-1-1-2] Drying of the Transparent Protective Layer During Formation

The present embodiment includes a drying (heating) step, during formation of the transparent protect layer, for forming the resin E1 contained in the transparent protective layer into a film while allowing the resin E2 contained in the transparent protective layer to remain particles.

When a drying temperature during formation of the transparent protective layer is set equal to or higher than a glass transition temperature Tg1 of the emulsion E1 and lower than a glass transition temperature Tg2 of the resin E2, a transparent protective layer can be manufactured in which the resin E1 is formed into a film while the resin E2 remains particles.

[4-1-1-3] Miscellaneous

The substrate may be submitted to preliminary surface modification. Surface modification is performed to roughen the surface of the substrate to enhance wettability of the substrate, allowing the substrate to more closely contact the transparent protective layer. A method for surface modification is not particularly limited. Examples of the method for surface modification include preliminarily executing corona discharge treatment or plasma discharge treatment on the surface of the transparent protective layer and coating the surface of the substrate with an organic solvent such as IPA or acetone. The above-described surface treatment strengthens the binding between the substrate and the transparent protective layer to make the substrate and the transparent protective layer stronger, allowing the transparent protective layer to be prevented from disadvantageously peeling off from the substrate. When the conveyance layer of the substrate is peeled off, a releasable layer may be formed on the conveyance layer of the substrate in order to enhance the peeling function of the conveyance layer. The releasable layer can be formed by coating the substrate with a composition containing the above-described releasing agent by roll coating, rod bar coating, spray coating, air knife coating, a slot die coating, or the like and drying the composition.

[4-2] Formation of the Ink Receiving Layer

[4-2-1] Ink Jet Coating Liquid

The ink receiving layer can be formed by mixing at least the inorganic particulates, the water-soluble resin, and the cationic resin with an appropriate medium to prepare a coating liquid, applying the coating liquid to the surface of the substrate, and drying the coating liquid.

Other examples of the additive include a surfactant, a pigment dispersant, a thickener, a defoamer, an ink fixative, a dot regulator, a colorant, fluorescent whitening agent, an antioxidant, an ultraviolet absorber, a preservative, and a pH regulator.

The concentration of the inorganic particulates in the coating liquid may be determined as needed with coatability with the coating liquid and the like taken into account and is not particularly limited. However, the weight percentage of the inorganic particulates in the total coating liquid is preferably 10 wt % or more to 30 wt % or less.

[4-2-2] Coating with the Ink Jet Coating Liquid

The ink receiving layer can be formed by coating the surface of the above-described substrate with the coating liquid. After the coating, the coating liquid is dried as needed.

A well-known coating method may be used. Examples of the well-known coating method include blade coating, air knife coating, curtain coating, slot die coating, bar coating, gravure coating, and roll coating.

The amount of coating liquid applied is preferably 10 g/m$^2$ or more and 40 g/m$^2$ or less in terms of solid content. When the amount of coating liquid applied is set preferably to 10 g/m$^2$ or more and more preferably to 15 g/m$^2$ or more, a ink receiving layer can be formed which effectively and efficiently absorbs moisture in the ink. This enables suppression of defects such as unwanted flow of the ink in the printed image and bleeding of the image. When the amount of coating liquid applied is set preferably to 40 g/m$^2$ or less and more preferably to 20 g/m$^2$ or less, the transfer material is hindered from being curled when the coating layer is dried.

[4-3] Formation of the Adhesive Layer

[4-3-1] Coating Liquid of the Adhesive

The transfer material in the present invention can be configured by applying the coating liquid of the prepared adhesive to the surface of the gap-absorbing ink receiving layer laminated to the substrate and discretely providing the adhesive pieces of the adhesive layer on the surface of the ink receiving layer so as to leave the remaining portions of the surface of the ink receiving layer directly exposed.

The concentration of the adhesive in the coating liquid may be determined as needed and is not particularly limited.

The ratio of the mass of the adhesive to the total mass of the coating liquid is preferably 2 wt % or more and 40 wt % or less.

[4-3-2] Coating with the Adhesive

The transfer material is configured, for example, by applying the coating liquid of the adhesive to the surface of the ink receiving layer formed on the substrate. After the coating, the coating liquid is dried as needed.

Since the adhesive pieces of the adhesive layer need to be provided on the surface of the gap-absorbing ink receiving layer, gravure coating is preferably used for the coating. In this case, the number of groove lines in a gravure roll is preferably 200, more preferably 300, and much more preferably 600. An increased number of groove lines facilitate formation of one or more exposed portions of the ink receiving layer in one pixel of ink jet print image.

[4-3-3] Drying During Formation

When the coating liquid of the adhesive is applied to the surface of the ink receiving layer formed on the substrate, the adhesive is preferably dried at less than the glass transition temperature, at the glass transition temperature the adhesive is melted. When the adhesive is dried at the glass transition temperature or higher, the adhesive melts and flows and the adhesive pieces adhere to one another to possibly coat the entire surface of the ink receiving layer including the exposed portions thereof, leading to inappropriate ink absorption. A configuration may also be provided in which the adhesive contains a plurality of types of particles, and one of these types of particles has a function as a binder for a portion of the adhesive that remains particles and a function to strengthen the adhesion between the water-soluble resin in the ink receiving layer and the adhesive layer. In such a case, the adhesive is preferably dried at the glass transition temperature of the adhesive functioning as a binder or higher and at less than the glass transition temperature of the adhesive particles remaining particles. When the drying temperature is selected as needed according to the properties of the adhesive, both appropriate characteristics of ink jet printing and appropriate adhesion can be achieved.

Moisture in the adhesive coating liquid vaporizes during the process of drying, leading to an increased concentration of the adhesive coating liquid during coating and film formation. Before drying, the adhesive particles contained in the adhesive coating liquid are dispersed substantially as single particles. When the concentration of the adhesive coating liquid increases during the process of drying, the dispersion of the adhesive particles is likely to be hampered, and the adhesive particles collide and join together. Thus, a plurality of particles aggregates. With a plurality of the particles thus aggregated, the adhesive coating liquid is formed into a film. Consequently, the adhesive pieces of the adhesive layer can be discretely provided on the surface of the ink receiving layer. Therefore, the concentration of the adhesive coating liquid before drying may be reduced in order to discretely provide the adhesive in the form of single particles. On the other hand, the concentration of the adhesive coating liquid before drying may be increased in order to discretely provide the adhesive such that a plurality of the particles is aggregated. As described above, the concentration of the adhesive coating liquid before drying is adjusted as needed to allow dispersion of the adhesive pieces of the adhesive layer during film formation to be controlled. The dispersion of the adhesive of the adhesive layer can be controlled depending on the intended use of the transfer material and the printed material. When the adhesive is discretely provided in the form of single particles, each of the discretely disposed adhesives has a low strength, and the island portions are sequentially destroyed during peeling. Thus, peel strength is low. When the adhesive is discretely provided such that a plurality of the particles is aggregated, each of the discretely disposed adhesives has a high strength, resulting in a high peel strength.

[5] Manufacturing Method for the Printed Material

[5-1] Image Printing Using the Ink Jet Printing System

A method for printing an image on the transfer material in the present invention will be described.

An image is printed on the printing surface of the transfer material as described above using the ink jet printing system.

The ink jet printing system prints an image by ejecting the ink (ink droplets) onto the ink jet printing surface of the transfer material through a plurality of nozzles formed in the print head. The type of the ink jet printing system is not particularly limited, and either a thermal ink jet printing system or a piezoelectric printing system may be used.

The ink jet printing system involves no contact between the print head and the image substrate with the ink receiving layer, allowing for very stable image printing. A printing method for the ink jet printer may be serial-scan printing, full-line printing, or the like.

[5-2] Ink Used

As ink, either dye ink or pigment ink may be used. With the image quality and the durability of print images taken into account, pigment ink is preferably used.

[5-2-1] Dye Ink

The dye ink is fixed by infiltration of a dye color material component, a water component, and a solvent component in the ink even into the gap-absorbing ink receiving layer. In the present invention, when a portion of the ink coming into contact with the exposed portion of the ink receiving layer, which absorbs the ink at high absorption speed, the ink is absorbed into the ink receiving layer in a dragging manner. The dye ink absorbed through the exposed portion of the ink receiving layer infiltrates into the ink receiving layer according to the appropriately designed and controlled permeability anisotropy of the ink receiving layer, thus forming desired ink dots. In the ink receiving layer, the ink infiltrates and spreads in accordance with the permeability anisotropy, and thus, ink dots can be formed over the bottom of the adhesive portion. Therefore, an area factor needed for image formation is maintained to enable high-resolution images to be printed. However, the dye color material and the moisture and solvent in the ink infiltrate into the ink receiving layer, and thus, depending on the storage condition for the printed material, both the liquid component and the dye color material in the remaining ink may infiltrate and diffuse through the ink receiving layer to cause image bleeding (color material migration) in connection with the storage. The dye ink offers only low light resistance. When the dye ink is exposed to sunlight for a long time, the dye may be decomposed to fade the colors of the print image.

Extra attention needs to be paid to the above-described color material migration in dye ink that contains no solids because the color material is dissolved in the ink. Thus, for example, links between the air gaps in the ink receiving layer are narrowed so that, when even a very small portion of the ink temporarily absorbed and contained in the air gaps is dried, the links between the air gaps are broken and portions of the ink remaining in the air gaps are likely to be isolated from one another. More specifically, as described above using FIGS. 26A to 27B, a portion of the air remaining at the links between the air gaps 1500 is migrated to form air layers 1502. The continuous ink 1503 having infiltrated into the air gap 1500 is separated into portions of the ink by the air layers 1502 such that the portions of the ink in the air gap 1500 are isolated from one another. The portions of the ink 1503 separated and isolated from one another by the air layers 1502 are unlikely to migrate because the air layers 1502 offer resistance to the migration. These effects allow image bleeding (color material migration) to be suppressed even when dye ink is used.

[5-2-2] Pigment Ink

The pigment ink is absorbed in a manner varying according to the average particle size of the pigment color material in the ink and the average pore size of the ink receiving layer. For example, when the average particle size of the pigment color material in the ink is larger than the average pore size of the gap-absorbing ink receiving layer, the pigment color material component remains on the surface of the ink receiving layer, and the water component and the solvent component in the ink infiltrate into the ink receiving layer. Then, the ink is subjected to solid-liquid separation, and the pigment color material component is separated from the moisture and the solvent component. In this case, in order to prevent the color material remaining on the front layer of the ink receiving layer from acting as a factor that affects the adhesion, the thickness of the adhesive layer is preferably appropriately adjusted such that the exposed portions of the ink receiving layer store all of the color material remaining on the surface of the ink receiving layer as a result of the solid-liquid separation to inhibit the color material from extending up above the adhesive layer. More preferably, the color material remaining on the surface of the ink receiving layer is covered with a sufficient amount of adhesive melted during thermal transfer to form an adhesive film of the molten adhesive, allowing the adhesion to be further strengthened.

When the gap size of the ink receiving layer is set larger than the average particle size of the assumed pigment, some of the solid components such as the pigment can infiltrate into the ink receiving layer, enabling a reduction in the thickness of the adhesive layer. However, if the gap size of the ink receiving layer is significantly larger than the average particle size of the pigment and the air gaps in the ink receiving layer are filled with the liquid components of the ink to some degree, image bleeding (color material migration) may occur depending on the storage condition for the printed material. That is, along with the liquid components of the remaining ink, the pigment component, serving as a color material, may gradually infiltrate and diffuse through the ink receiving layer. Therefore, when the gap size of the ink receiving layer is set slightly larger than the average particle size of the pigment, serving as a color material, or slightly larger than the secondary or composite particles of the pigment, permeation of the pigment through the ink receiving layer can be controlled. As a result, a transfer material can be provided which has high image printing characteristics and which is excellent in image preservation.

For the pigment ink, only the water component and the solvent component of the ink infiltrate into the ink receiving layer in accordance with the appropriately designed and controlled permeability anisotropy of the ink receiving layer. Thus, the pigment color material, which contributes to coloration, is unlikely to permeate portions of the ink receiving layer located under the adhesive portions and thus inferior to the dye ink in the capability of forming high-resolution images. However, substantially non-problematic high-resolution images can be printed by extending the exposed portion of the ink receiving layers to below the adhesive portions, adjusting the structure of the adhesive with the adhesion and the area factor taken into account, or enlarging the air gaps to allow the color material to easily permeate the ink receiving layer. That is, a part of each adhesive portion which contacts the ink is reduced in area to allow the ink to flow down even to the portions of the ink receiving layer located under the adhesive portions after ink jet printing. This increases the area factor and thus the image density.

Regardless of whether the pigment ink has a large or small particle size, the particle size of the pigment, which serves as a coloring agent, is of substantially the same order as that of the gap size of the ink receiving layer. The surface of the pigment has high compatibility. Thus, the layer of the pigment remaining in the ink receiving layer as a result of solid-liquid separation is likely to allow the water component and the solvent component in the pigment ink to infiltrate through. Therefore, even if the pigment covers the adhesive before covering the ink receiving layer in the color printing, the water component and the solvent component in the pigment ink are absorbed more quickly into the ink receiving layer than into the adhesive because these components are sufficiently small compared to the gap size of the adhesive formed of adhesive particles.

The pigment ink is likely to be subjected to solid-liquid separation, that is, likely to be separated into the color material component and the water component or the solvent component, on the surface of the ink receiving layer, and the water component or the solvent component infiltrates into the ink receiving layer. Thus, surface of the ink receiving layer is likely to be dried. Thus, during attachment, a reduced amount of moisture is present on the surface of the ink receiving layer, thus suppressing inappropriate adhesion caused by vaporization of moisture to allow the adhesion to be strengthened.

The pigment component in the pigment ink may be a self-dispersing pigment with a bond to at least one type of functional group selected from the group consisting of a carbonyl group, a carboxyl group, a hydroxyl group, and a sulfon group, or salt thereof, or a resin-dispersing pigment containing pigment particles peripherally coated with resin. In the transfer material in the present embodiment, appropriate adjustment of the thickness of the adhesive portions allows the pigment color material remaining on the surface of the ink receiving layer as a result of solid-liquid separation to be all housed in the exposed portions of the ink receiving layer to preclude the color material from extending up above the height of the adhesive. This prevents a situation where the color material remaining on the surface of the ink receiving layer acts as a factor that affects the adhesion. Thus, the adjustment of the thickness of the adhesive portions allows the color material remaining on the surface of the ink receiving layer to be covered with a sufficient amount of molten adhesive during thermal transfer, forming an adhesive film of the molten adhesive between the color material and the image substrate. Such adhesive portions are suitable when a self-dispersing pigment is used in which pigment particles themselves are not adhesive.

The resin with which the periphery of the pigment particles is coated is preferably an ester (meth) acrylate-based copolymer having an acid value of 100 to 160 mg KOH/g. An acid value of 100 mg KOH/g or more allows the ink to be more stably ejected in the ink jet printing system that thermally ejects the ink. On the other hand, an acid value of 160 mg KOH/g or less makes the resin hydrophobic relative to the pigment particles, improving the fixability and the bleeding resistance of the ink. Therefore, the resin is suitable for high-speed fixation of the ink and high-speed printing.

The acid value refers to the amount (mg) of KOH needed to neutralize 1 g of resin and may be an indicator of hydrophilicity of the resin. The acid value in this case may be calculated from the composition ratio of monomers contained in the resin dispersant. As a specific method for measuring the acid value of the resin dispersion element, Titrino (manufactured by Metrohm) may be used which determines the acid value by potentiometric titration.

[5-2-3] White Ink

In the present invention, after an image is printed on the ink receiving layer of the transfer material, ink jet printing may be performed on at least a part of the ink receiving layer using white ink (ink in white). The use of white ink enables at least a part of the image formation surface of the ink receiving layer to be hidden so as to preclude at least a part of the image printed on the ink receiving layer from being visible from the adhesive layer side. This allows print information to be more appropriately hidden. That is, if the substrate of the transfer material is transparent, when the image printed on the ink receiving layer is viewed from the substrate side, the white ink serves as a background, allowing the image to be made more visible. When the image substrate is colored, the white ink as described above allows the image to be prevented from being less visible as a result of the coloring of the image substrate. When the transfer material in the present invention is used as a label, the concealment of print information using white ink is unlikely to be affected by the coloring of the image substrate, making the label more visible. Thus, the concealment of print information using white ink is effective. The particle size of the white ink is preferably larger than the wavelength of visible light. When the particle size of the white ink is larger than the wavelength of visible light, the print information is more effectively hidden, and the image can be more visible when viewed from the substrate side.

The transfer material in the present invention may be configured as follows. When an image is printed on the printing surface of the transfer material with white ink, a portion of the white ink having landed on any of the adhesive portions extends out from the adhesive portion and hangs into the corresponding exposed portion of the ink receiving layer, similarly to the above-described dye ink and pigment ink. A portion of the white ink passes through the space between the adhesive portions of the adhesive layer in a bypassing manner and comes into contact with the exposed portion of the ink receiving layer, which absorbs the ink at high absorption speed. The portion the white ink is then absorbed into the ink receiving layer in a dragging manner. When the average particle size of the white pigment color material in the white ink is larger than the average pore size of the ink receiving layer, the white ink is subjected to solid-liquid separation and separated into the white pigment component and the water and solvent components, on the exposed portions of the surface of the ink receiving layer. That is, the white pigment component of the white ink is fixed to the exposed portions of the surface of the ink receiving layer. When the average particle size of the white pigment color material of the white ink is smaller than the average pore size of the ink receiving layer, some of the solid components such as the pigment also infiltrate into the ink receiving layer. In either case, the printing surface on which the image is printed with the above-described dye ink or pigment ink is covered with the white pigment, allowing the print image to be more visible when viewed from the substrate side of the transfer material. A sufficient height of each adhesive portion (island portion) of the adhesive layer allows the white pigment component to be coated with the adhesive layer when the transfer material and the image substrate are melted to adhere to each other. This prevents the pigment of the white ink from remaining on the surface to strengthen the transfer material and the image substrate. When white ink described below is used, particles in the white ink and the like which have a function to conceal print information (concealing particles) need to be large for optical reasons. Thus, the concealing particles have a larger particle size than the pigment color material of the above-described pigment ink. When the printing surface is covered with the concealing particles before being covered with the pigment color material of the pigment ink, the pigment ink is absorbed at a reduced speed. Therefore, the image is preferably printed with the white ink after being printed with the pigment ink.

For the method in the present invention, any white ink composition may be used which is normally used for the ink jet printing method. Examples of such a white pigment may include inorganic white pigments, organic white pigments, and white hollow polymer particulates.

Examples of organic white pigments include sulfates of alkaline earth metal such as barium sulfate, carbonates of alkaline earth metal such as calcium carbonate, silicas such as fine powder of silicic acid and synthetic silicate, calcium silicate, alumina, hydrated alumina, titanium oxide, zinc oxide, talc, and clay, Examples of organic white pigments include organic compound salt disclosed in Japanese Patent Laid-Open No. H11-129613 (1999) and alkylenebismelamine derivatives disclosed in Japanese Patent Laid-Open Nos. H11-140365 (1999) and 2001-234093. Examples of specific products of the white pigment include ShigenoxOWP, ShigenoxOWPL, ShigenoxFWP, ShigenoxFWG, ShigenoxUL, and ShigenoxU (all manufactured by Hakkol Chemical Co., Ltd.; all trade names).

Examples of hollow polymer particulates are described in U.S. Pat. No. 4,880,465 and Japanese Patent No. 3,562,754.

In the present invention, the surface tension and the viscosity of the ink for ink jet printing are appropriately controlled. Thus, when a portion of the ink having come into contact with the exposed portion of the ink receiving layer starts to be absorbed into the ink receiving layer, which absorbs the ink at low absorption speed, the remaining portion of the ink that is continuous with the above-described portion is sequentially drawn into the ink receiving layer without interruption. The viscosity $\eta$ of such ink is preferably 1.5 to 10.0 mPa·s, more preferably 1.6 to 5.0 mPa·s, and particularly preferably 1.7 to 3.5 mPa·s. On the other hand, the surface tension $\gamma$ of the ink is preferably 25 to 45 mN/m.

That is, the surface tension and the viscosity of the ink are preferably controlled such that, when a portion of the ink having landed on the printing surface of the transfer material extends out from any of the adhesive portions and hangs into the corresponding exposed portion of the ink receiving layer, the ink is prevented from being broken off on the surface of the adhesive layer. Furthermore, the surface tension and the viscosity of the ink are preferably controlled such that a portion of the ink passes through the space between the adhesive portions of the adhesive layer, comes into contact with the exposed portion of the surface of the ink receiving layer, which absorbs the ink at high absorption speed, and is then dragged and absorbed into the ink receiving layer. Adjustment of the viscosity of the ink to within the above-described range enhances the fluidity of the ink during ink ejection, allowing the ink to be appropriately supplied to the nozzles and to be stably ejected. Adjustment of the surface tension of the ink to within the above-described range allows meniscuses at ink outlet ports to be maintained during ink ejection.

The viscosity of the ink means a value measured at 25° C. in accordance with JIS Z 8803 using an E viscometer (for example, "RE-80L Viscometer" manufactured by TOKI SANGYO CO., LTD.). The viscosity of the ink may be adjusted based on the type and amount of a surfactant, the type and amount of a water-soluble organic solvent, and the like.

The surface tension of the ink means a value measured at 25° C. by a Plate method using a platinum plate and an automatic surface tensiometer (for example, "CBVP-Z" manufactured by Kyowa Interface Science Co., LTD). The surface tension of the ink can be adjusted based on the amount of surfactant added, the type and content of the water-soluble organic solvent, and the like.

In the present embodiment, the concentration of the color material in the ink is not particularly specified. However, the color material concentration is preferably 0.5% or more and 10% or less and more preferably 1% or more and 5% or less. Setting the color material concentration within such a range allows both appropriate image visibility and appropriate adhesion to be achieved. In particular, for the pigment ink, the color material concentration needs to be strictly controlled to allow the color material remaining on the surface of the ink receiving layer to be housed in the exposed portions of the ink receiving layer. That is, the pigment concentration is preferably set as high as possible to the extent that the color material is precluded from extending up above the height of the adhesive and that the image can be made more visible. Controllably adjusting the ink concentration to within the above-described range optimally controls the viscosity of the ink to enhance the fluidity of the ink during ink ejection, allowing the ink to be appropriately supplied to the nozzles in the print head and to be stably ejected.

[5-3] Transfer Method

If the transfer material in which the substrate is not peeled off is used, when the printed material in the present invention is produced, first, a normal image or an inverted image is printed on the ink jet printing surface of the transfer material, for example, depending on the direction in which the image is viewed. Then, the printed material is obtained by transferring the transfer material to the image substrate via the discretely disposed adhesive pieces or by allowing the discretely disposed self-melt adhesive pieces to be self-melt.

If the transfer material is used in which all of the substrate including the conveyance layer is peeled off, when the printed material in the present invention is produced, for example, an inverted image is printed on the printing surface of the transfer material. Then, the transfer material is transferred to the image substrate via the discretely disposed adhesive pieces, and then the conveyance layer (all of the substrate) is peeled off. Thus, the printed material is obtained in which the ink receiving layer is laminated to the image substrate.

If the substrate includes any of the functional layers such as the transparent protective layer, hologram layer, and the printing layer, first, for example, an inverted image is printed on the printing surface of the transfer material including the functional layer. Then, the transfer material is transferred to the image substrate via the discretely disposed adhesive pieces, and then, the only the conveyance layer (a part of the substrate) is peeled off from the substrate including any of the functional layers such as the conveyance layer, the transparent protective layer, hologram layer, and the printing layer. Thus, the printed material is obtained which is integrated with the functional layer and in which the ink receiving layer with the image printed thereon is laminated to the image substrate.

In the present invention, during the transfer step, appropriate transfer can be achieved even when the ink receiving layer sufficiently contains water. For the gap-absorbing ink receiving layer, a large amount of ink can be absorbed, and the gap structure is unlikely to be destroyed during transfer and can be maintained after transfer, as described above. Thus, even when the adhesive and the binder melt during transfer, the absorbed ink is held inside the ink receiving layer and possible vapor is also sealed inside the ink receiving layer, appropriate transfer can be achieved even when the ink receiving layer sufficiently contains water. In the adhesive layer where the adhesive pieces are discretely disposed on the ink receiving layer, the adhesive does not substantially absorb the ink or the adhesive absorb the ink but only at low absorption speed. Thus, the ink is unlikely to remain on the surface of the adhesive layer or inside the adhesive portion. Thus, the ink inhibiting the transfer is unlikely to remain on or in the adhesive layer, allowing the transfer material to be appropriately transferred to the image substrate.

An adhesion method preferably used in the present invention may be selected in accordance with the characteristics of the adhesive. For example, if a stimulation-responsive material is used for the adhesive, when the adhesive is of the water activation type, the adhesive layer where the adhesive pieces are discretely disposed can be made adhesive by applying water to the transfer material in a water application step using a water application apparatus after an image is formed on the transfer material. When the adhesive is of an ultraviolet activation type, the adhesive layer where the adhesive pieces are discretely disposed can be made adhesive by irradiating the transfer material with ultraviolet rays in an ultraviolet irradiation step using an ultraviolet irradiation apparatus after an image is formed on the transfer material.

When the adhesive is of a heat activation type and of a self-melt type, the adhesive layer where the adhesive pieces are discretely disposed can be made adhesive by heating the transfer material in a heating step using a heating apparatus. Examples of the heating apparatus include apparatuses including a heating fan, a heating belt, or a thermal transfer head. However, the present invention is not limited to these apparatuses.

When the adhesive is of a tacky type, the adhesive layer where the adhesive pieces are discretely disposed is adhesive by itself. Thus, the adhesive layer where the adhesive pieces are discretely disposed can be made adhesive by being compressed in a compression bonding step.

The above-described transfer step may include a plurality of steps based on a combination of a plurality of apparatuses if the adhesive is composed of a plurality of materials.

In the present invention, as the adhesive, thermoplastic particles are particularly preferably used which are made adhesive by heat or pressure. Thus, among the above-described transfer methods, a thermocompression bonding step using both heat and compression bonding is preferable. A configuration for such transfer may include both a heat roller and a pressure roller.

In the present invention, the printed material can be obtained by forming an image on the ink receiving layer of the transfer material, then laying the ink receiving layer on top of the image substrate, and subsequently conveying such a laminate between the heated heat roller and the pressure roller to attach the transfer material and the image substrate together via the adhesive layer of the discretely disposed adhesive pieces. Alternatively, the printed material can be obtained by printing an image on the ink receiving layer of the transfer material, and then passing the transfer material between the heated heat roller and the pressure roller to allow the adhesive layer of the discretely disposed self-melt adhesive pieces to self-melt. In this case, the transfer material is heated from the substrate side using the heat roller. Heating from the substrate side facilitates heating of the water-soluble resin in the ink receiving layer at least to the glass transition temperature at which the water-soluble resin becomes adhesive and heating of the adhesive layer of the discretely disposed adhesive pieces at least to a temperature at which the adhesive layer becomes adhesive.

In the present invention, when the transfer material with the image printed in the ink receiving layer is transferred to the image substrate by thermocompression bonding, it is important to control the heat and pressure during the thermocompression bonding so as to maintain the gap structure of the ink receiving layer after the thermocompression bonding. Even if the liquid components of the ink are explosively boiled in the individual air gaps by the heat and pressure during the thermocompression bonding to generate vapor, the maintained gap structure allows the vapor to be trapped in the air gaps. This prevents formation of an air layer on the adhesion layer to allow appropriate adhesion to be achieved. The gap structure maintained during transfer restrains the air gaps from being collapsed by pressure and from being melted by heat and prevents a nonvolatile solvent, which is a liquid component of the ink, from seeping through the surface. This allows the adhesion to be strengthened.

When the transfer material is used in which the transparent protective layer of the substrate includes two types of resin, adjustment of transfer conditions (for example, a transfer temperature and a transfer speed) enables the above-described resin E2 to be adequately turned into a film or partly left in particle form for transfer. The film state may be controllably varied, during thermocompression bonding, between the portion of the transparent protective layer corresponding to the portion in which the image substrate and the ink receiving layer adhere to each other and the portion of the transparent protective layer corresponding to the portion in which the image substrate and the ink receiving layer do not adhere to each other. A crack is likely to form starting at the boundary portions in the peeling step. Therefore, the transparent protective layer can be appropriately cut off by using the two types of resin and varying the film state of the resin E2 utilizing the temperature during thermocompression bonding.

The temperature during thermocompression bonding is preferably controllably adjusted at least to the glass transition temperature at which the thermoplastic resin of the discretely disposed adhesive becomes adhesive. When the temperature during thermocompression bonding is adjusted at least to the glass transition temperature at which the thermoplastic resin becomes adhesive, the transfer material can be transferred to the image substrate via the discretely disposed adhesive. More preferably, when the temperature during thermocompression bonding is controllably adjusted at least to the glass transition temperature at which the water-soluble resin contained in the ink receiving layer of the transfer material is melted, the water-soluble resin in the ink receiving layer and the adhesive melt and adhere to each other, strengthening the adhesion. More preferably, when the temperature during thermocompression bonding is controllably adjusted at least to a temperature at which the resin E2 contained in the transparent protective layer are melted, the transparent protective layer can be appropriately cut off.

Importantly, the temperature during thermocompression bonding is controllably adjusted so as to prevent the gap structure of the ink receiving layer from being collapsed more significantly than necessary when the image substrate and the transfer material are thermocompression bonded together and so as to maintain the gap structure after the attachment. That is, the transfer is preferably performed at not higher than the melting temperature of the component forming the air gaps so as to prevent the nonvolatile solvent, which is a liquid component of the ink, from seeping through the surface as a result of melting of the air gaps. The transfer is preferably performed particularly at not higher than the boiling point of water so as to prevent the water and the solvent component of the ink from being explosively boiled or vaporized in the individual air gaps.

A pressure for thermocompression bonding is preferably 0.5 $kg/cm^2$ or more and 7.0 $kg/cm^2$ or less. Setting the pressure for thermocompression bonding to 0.5 kg/cm or more brings the ink receiving layer with the image of the transfer material into close contact with the image substrate to allow the image substrate and the transfer material to be thermocompression-bonded together. That is, setting the pressure for thermocompression bonding as described above enables spaces formed between the gap-absorbing ink receiving layer and the image substrate due to fine recesses and protrusions of the gap-absorbing ink receiving layer to be filled with the molten thermoplastic resin of the discretely disposed adhesive pieces. On the other hand, when the image substrate and the transfer material are thermocompression-bonded together, the pressure for thermocompression bonding set to 7.0 $kg/cm^2$ or less allows the air gaps in the ink receiving layer to be maintained without collapsing the gap structure of the ink receiving layer more significantly than necessary to prevent the nonvolatile solvent, which is a liquid component of the ink, from seeping through the surface. This enables the adhesion to be strengthened.

A silicone roller is preferably used as the pressure roller 22 that contacts the image substrate 55 side. The silicone roller has a releasing function, and thus, the surface of the ink receiving layer is difficult to transfer when the image substrate 55 is not present between the heat roller 21 and the pressure roller 22, in other words, when the surface of the ink receiving layer with the adhesive layer of the discretely disposed adhesive pieces contacts the pressure roller 22. Therefore, the surface of the ink receiving layer can be prevented from adhering to the pressure roller 22 via the discretely disposed adhesive pieces.

In the present invention, when the transfer material is used in which all of the substrate including the conveyance layer is peeled off, an inverted image can be printed via the discretely disposed adhesive pieces. Subsequently, the transfer material with the image printed thereon is transferred (attached) to the image substrate, and then, the conveyance layer (all of the substrate) is peeled off in the peeling step. Consequently, the printed material is obtained in which the ink receiving layer with the image printed thereon is laminated to the image substrate via the discretely disposed adhesive pieces. If the substrate includes any of the functional layers such as the transparent protective layer, the hologram layer, and the printing layer, then after the transfer material and the image substrate are attached together, only the conveyance layer of the substrate (a part of the substrate)

is peeled off in the peeling step, providing the printed material in which the ink receiving layer with the image printed thereon which is integrated with the functional layer is laminated to the image substrate via the discretely disposed adhesive pieces.

[5-4] Peeling Method

When the substrate is of a hot peel-off type, the substrate is preferably peeled off immediately after the thermocompression bonding and before the temperature lowers. When the substrate is of the hot peel-off type, the substrate is preferably peeled off using a peeling mechanism with a peeling claw or a peeling roll.

When the transfer material is of the cool peel-off type, the substrate can be peeled off even when the temperature lowers. Thus, the peel-off can be manually achieved rather than using a roll or a peel mechanism.

A peeling angle θ for peel-off of the substrate is 0 to 165° and more preferably 90° to 165°. Setting the peeling angle θ within this range allows the ink receiving layer to be appropriately cut off. The conveying angle θ is not limited to the above-described values.

[6] Manufacturing Apparatus

Figure 26:
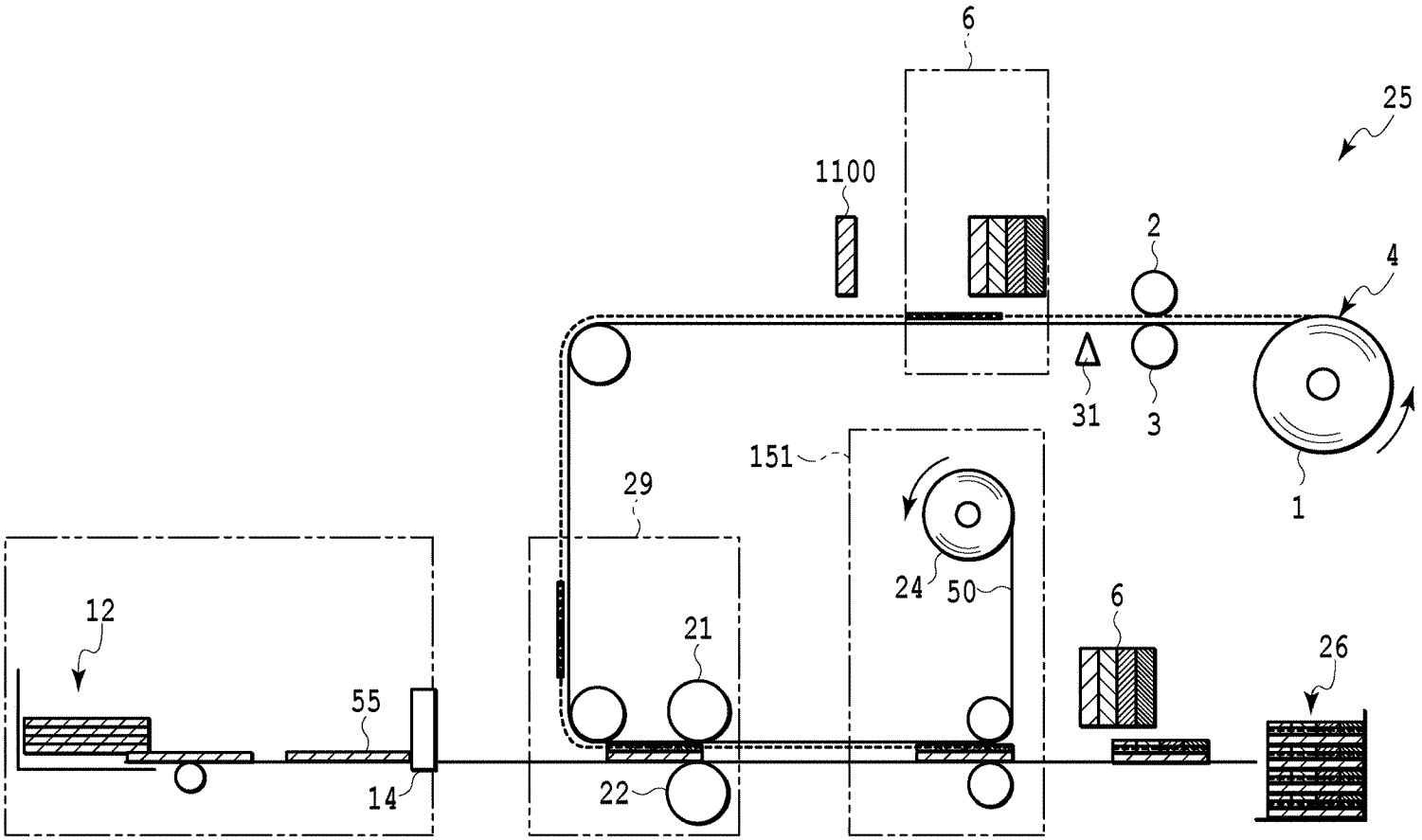
FIG. 26 is a diagram schematically depicting a configuration example of a first manufacturing apparatus.
Figure 27:
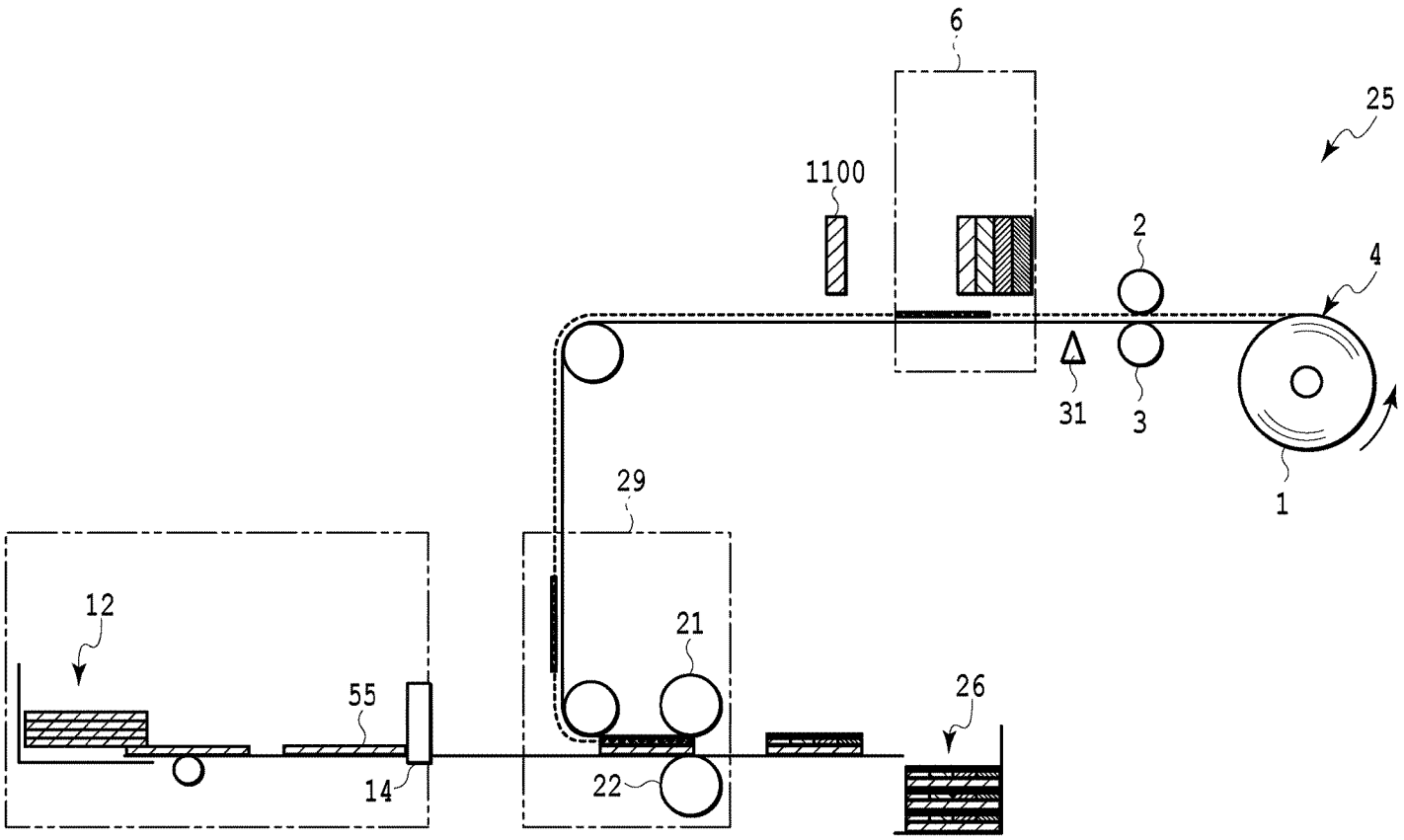
FIG. 27 is a diagram schematically illustrating a configuration example of a second manufacturing apparatus.

FIG. 26 depicts a manufacturing apparatus 25 that manufactures the printed material using the transfer material in which the conveyance layer of the substrate is peeled off. The manufacturing apparatus 25 includes a printing unit 6 that prints images using the ink jet printing system or the like, a transfer unit 29 that transfers the ink receiving layer with an image printed thereon to the image substrate, and a peeling unit 151 that peels off the substrate 50. FIG. 27 depicts the manufacturing apparatus 25 that manufactures the printed material using the transfer material in which the conveyance layer of the substrate is not peeled off. The manufacturing apparatus 25 includes the printing unit 6 that prints images using the ink jet printing system or the like and the transfer unit 29 that transfers the ink receiving layer with an image printed thereon to the image substrate.

The mechanisms of the printing unit 6 and the transfer unit 29 may all be integrally configured or separately independently configured. As an apparatus for printing an image, a well-known small-sized ink jet printer or a large format printer using a pigment ink may be used. As an apparatus for transferring the transfer material to the image substrate, a laminate machine of a well-known two-roll type or four-roll type may be used. Compared to the two-roll type, the four-roll type is preferably used because this type facilitates heat transfer during thermocompression bonding to allow the peeling step to be easily executed.

EXAMPLES

Specific examples of the present invention will be described below. However, the present invention is not limited by the examples described below. In the description below, "pts" and "%" refer to mass standards unless otherwise specified.

Example 1

[Preparation of a Hydrated Alumina Dispersion Liquid]

Into 79.4 pts·wt. pure water, 20 pts·wt. hydrated alumina A (trade name "Disperal HP14" manufactured by SASOL) having a boehmite structure (a pseudo boehmite structure) was added, and 0.4 pts·wt. acetic acid was further added. The mixture was peptized to prepare a 20% hydrated alumina dispersion liquid. Hydrated alumina particulates in the hydrated alumina dispersion liquid had an average particle size of 140 nm.

[Preparation of a Water Solution of Polyvinyl Alcohol]

Aside from the hydrated alumina dispersion liquid, polyvinyl alcohol (trade name "PVA235" manufactured by KURARAY CO., LTD.) was dissolved into ion exchange water to prepare a water solution of polyvinyl alcohol with a solid content concentration of 8%. The polyvinyl alcohol had a weight-average degree of polymerization of 3,500 and a degree of saponification of 87 to 89 mol %.

[Preparation of a Coating Liquid 1 for Ink Receiving layer Formation]

To 100 pts·wt. hydrated alumina dispersion liquid, 27.8 pts·wt. water solution of polyvinyl alcohol was added, and 3.0 pts·wt. polyallylamine was added as cationic resin. The resultant solution was mixed using a static mixer to prepare a coating liquid 1 for ink receiving layer formation. As the polyallylamine, polyallylamine having a weight-average degree of polymerization of 1600 (trade name "PAA-01" manufactured by Nitto Boseki Co., Ltd.) was used.

[Manufacture of a Laminate Sheet]

A coating liquid 1 for ink receiving layer formation was applied to a surface (a thickness of 19 μm) of a PET substrate (trade name "Tetoron G2"; manufactured by Teijin Dupont Films Japan Limited) and then dried. Thus, a laminate sheet was manufactured which served as a component material for the transfer material including the substrate and the ink receiving layer. A die coater was used for the coating, a coating speed was set to 5 m/min, and the amount of coating resulting from drying was set to 15 g/m$^2$. A drying temperature was set to 60° C. The ink receiving layer was 15 μm in thickness.

[Preparation of a Water Solution of the Adhesive 1]

Forty-five pts·wt. ion exchange water was added to 5 pts·wt. SAIVINOL RMA-63 (average particle size: 1 μm; manufactured by SAIDEN CHEMICAL INDUSTRY CO., LTD.) to prepare a water solution of the adhesive 1.

[Manufacture of the Transfer Material 1]

The water solution of the adhesive 1 was applied to the surface of the ink receiving layer of the laminate sheet and then dried to discretely provide the adhesive pieces of adhesive layer on the surface of the ink receiving layer, while leaving the remaining portions of the surface of the ink receiving layer directly exposed. A gravure coater was used to apply the coating liquid, and the coating speed was set to 5 m/min. A drying temperature was set to 60° C. In this case, the number of groove lines in the gravure roll was set to 200. The transfer material 1 was wound into a roll such that the ink receiving layer was located on the outer side of the roll, whereas the substrate was located on the inner side of the roll. The island portions of the adhesive layer were 2 μm in thickness. Transfer materials 10, 13, and 17 described below were manufactured similarly to the transfer material 1.

Figure 6:
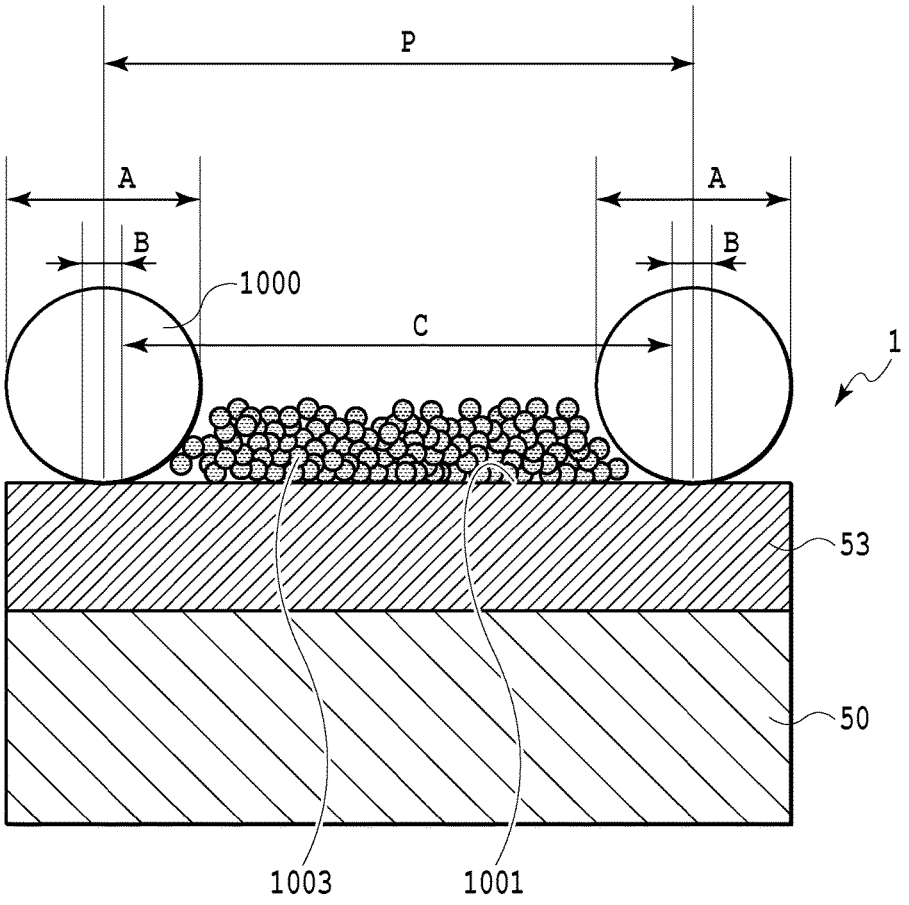
FIG. 6 is a diagram illustrating the transfer material on which ink jet printing has been performed with pigment ink.
Figure 7:
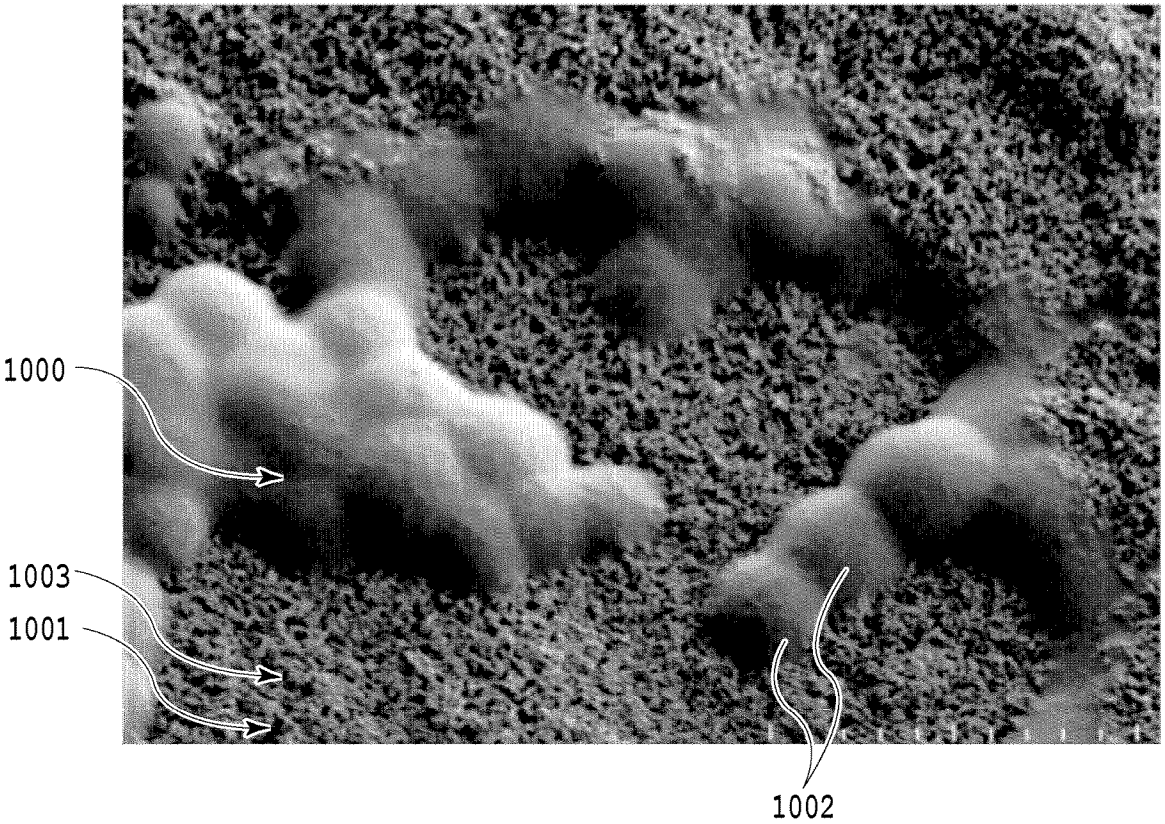
FIG. 7 is an SEM image of the transfer material on which ink jet printing has been performed with pigment ink.

The transfer material 1 was observed in cross section using an SEM, and the area of a part of the adhesive portion in which the adhesive particles contacted the ink receiving layer was measured. At that time, the average value of the particle sizes of 100 adhesive particles contacting the ink receiving layer was calculated, and based on the average particle size, the area of a part of the adhesive portion in which one adhesive particle contacted the ink receiving layer was calculated. Then, based on an SEM projection view of the transfer material as seen from the printing surface side, the number of adhesive particles in the adhesive portion within a measurement range which contacted the ink receiving layer was calculated. The total area of a part of the adhesive portion in which the adhesive contacted the ink receiving layer (an area B in FIG. 6) was determined as a contact area. The area of the exposed portion of the ink receiving layer, having no adhesive on the surface thereof (exposed portion area), was calculated by subtracting the area B from the total area of the measurement range based on the SEM projection view of the transfer material. Based on the SEM projection view of the transfer material as seen from the printing surface side, the area of the adhesive portion as viewed directly from the printing surface side (adhesive portion area) was determined. As a result, the contact area was smaller than the adhesive portion area, and the exposed portion area was 75% of the total area of the ink receiving layer. At least one sea portion was found to be present in one pixel for ink jet printing. The main components of the transfer material 1 are described in Tables 2-1 and 2-2.

The main components of the transfer materials 10, 13, and 17, which are similar to the transfer material 1, are described in Tables 6-1, 6-2, 6-7, 6-8, 8-1 and 8-2. For the transfer materials in the examples described below, the contact area, the exposed portion area, and the adhesive portion area were calculated based on observation using the SEM as is the case with the transfer material 1.

Using the above-described first manufacturing apparatus, a 100% solid image with a print duty of 100% was printed on the transfer material 1 obtained in Example 1 with resin-dispersing pigment ink at a resolution of 1,200 dpi and an ink ejection amount of 4 pl. Subsequently, the transfer material 1 was thermocompression-bonded to the image substrate, and the PET substrate was peeled off to provide the printed material in Example 1. A preparation method for the resin-dispersing pigment ink will be described below. As the printing unit of the manufacturing apparatus, a pigment ink jet printer equipped with a serial head (trade name "PIXUS PRO-1" manufactured by Canon Inc.) was used. The printer was provided with the resin-dispersing pigment ink, and a 100% solid image with a print duty of 100% was printed in a plain paper mode (an ejection amount of 4 pl, a resolution of 1,200 dpi, monochrome printing). As the image substrate, a vinyl chloride card (trade name "C-4002"; manufactured by EVOLIS) was used. Conditions for thermocompression bonding were a temperature of 150° C., a pressure of 3.9 Kg/cm$^2$, and a conveying speed of 50 mm/sec.

[Preparation of Pigment Ink]

<Synthesis of a (Meth) Acrylic Acid Ester-Based Copolymer>

One thousand pts·wt. methylethylketone was fed into a reaction container equipped with a stirring apparatus, a dropping apparatus, a temperature sensor, a reflux apparatus with a nitrogen introducing apparatus at the top thereof. The interior of the reaction container was purged with nitrogen, with the methylethylketone stirred. The interior of the reaction container was elevated to 80° C. with the interior kept in a nitrogen atmosphere, and then 63 pts·wt. methacrylic acid 2-hydroxyethyl, 141 pts·wt. methacrylic acid, 417 pts·wt. styrene, 188 pts·wt. benzyl methacrylate, 25 pts·wt. glycidyl methacrylate, 33 pts·wt. degree-of-polymerization regulator (trade name "BLEMMER TGL" manufactured by NOF CORPORATION), and pts·wt. peroxy-2-ethyl hexane acid-t-butyl were mixed together, the resultant mixture was dropped in four hours. After the dropping, the reaction was allowed to continue at the same temperature for 10 hours to prepare a solution (resin content: 45.4%) of (meth)acrylic acid ester-based copolymer (A-1) with an acid value of 110 mg KOH/g, a glass transition temperature (Tg) of 89° C., and a weight-average molecular weight of 8,000.

<Preparation of an Aqueous-Pigment Dispersion Element 1>

One thousand phthalocyanine-based blue pigment, a solution of (meth) acrylic acid ester-based copolymer (A-1) resulting from the above-described synthesis, a 25% water solution of potassium hydroxide, and water were fed into a mixing tank with a cooling function and mixed together to prepare a mixture. The amount of the (meth) acrylic acid ester-based copolymer (A-1) was used such that the nonvolatile content of the (meth) acrylic acid ester-based copolymer (A-1) is 40% with respect to the phthalocyanine-based blue pigment. The 25% water solution of potassium hydroxide had such an amount as allows the (meth) acrylic acid ester-based copolymer (A-1) to be 100% neutralized. The water had such an amount as set the nonvolatile content of the resultant mixture to 27%. The resultant mixture was passed through a dispersing apparatus filled with zirconia beads each with a diameter of 0.3 mm. The mixture was thus dispersed for four hours using a circulation method. The temperature of the dispersion liquid was maintained at 40° C. or lower.

The dispersion liquid was extracted from the mixing tank, and then, the channel between the mixing tank and the dispersing apparatus was cleaned with 10,000 pts·wt. water. The cleaning solution and the dispersion liquid were mixed together to prepare a diluted dispersion liquid. The resultant diluted dispersion liquid was fed into a distillation apparatus, in which a total amount of methylethylketone and a fraction of the water were distilled away to prepare a concentrated dispersion liquid. The concentrated dispersion liquid was left and cooled down to the room temperature, and then, 2% hydrochloric acid was dropped to the resultant concentrated dispersion liquid, which was simultaneously stirred. The concentrated dispersion liquid was thus adjusted to pH 4.5, and a solid content of the liquid was filtered using a Nutsche filtration apparatus and washed in water. The resultant solid content (cake) was placed in a container, into which water was added. The solid content was re-dispersed using a dispersing stirrer and then adjusted to pH 9.5 using a 25% water solution of potassium hydroxide. Subsequently, a centrifugal separator was used to remove coarse particles at 6,000 G in 30 minutes, and then, the nonvolatile content was regulated to prepare an aqueous cyan pigment dispersion element (pigment content: 14%, acid value: 110).

A process similar to the process for the aqueous cyan pigment dispersion element was executed except that the phthalocyanine blue pigment was changed to a carbon black-based black pigment, a quinacridone-based magenta pigment, or a diazo-based yellow pigment, to prepare an aqueous black pigment dispersion element, an aqueous magenta pigment dispersion element, or an aqueous yellow pigment dispersion element.

<Ink Preparation>

The aqueous pigment dispersion element and components indicated in Table 1 were fed into a container so as to achieve a composition indicated in Table 1 (total: 100 pts·wt.). Such a solution was stirred for 30 minutes or longer using a propeller stirrer. Subsequently, the solution was filtered using a filter with a pore diameter of 0.2 μm (manufactured by NIHON PALL LTD.) to prepare pigment ink. In Table 1, "AE-100" indicates acetylene glycol 10 mol ethylene oxide additive (trade name "ACETYLENOL E100 manufactured by Kawaken Fine Chemicals Co., Ltd.).

TABLE 1

| | Bk | C | M | Y |
|---|---|---|---|---|
| Acid value (mgKOH) | 110 | 110 | 110 | 110 |
| Pigment (pts) | 5.0 | 5.0 | 5.0 | 5.0 |
| Glycerin (pts) | 7 | 7 | 7 | 7 |
| Triethylene glycol (pts) | 5 | 5 | 5 | 5 |
| Ethylene urea | 12 | 12 | 12 | 12 |
| AE-100 (pts) | 0.5 | 0.5 | 0.5 | 0.5 |
| Pure water (pts) | Remaining portion | Remaining portion | Remaining portion | Remaining portion |

Example 2

A printed material in Example 2 was obtained as is the case with Example 1 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

In Example 1 and Example 2, the average particle size and the pore size of the inorganic particulates contained in the ink receiving layer are optimal. Thus, in Example 1 using the pigment ink, the pigment color material is prevented from infiltrating into the ink receiving layer, and thus, the area factor is unlikely to be 100%, resulting in slightly inferior image printing characteristics. However, Example 1 poses no practical problem and the transfer material in Example 1 is excellent in image preservation. On the other hand, in Example 2 using the dye ink, the dye ink infiltrates through the ink receiving layer while spreading substantially isotropically, and thus, the area factor is likely to be 100%, resulting in appropriate image printing characteristics. However, the transfer material in Example 2 is slightly inferior in image preservation.

Example 3

[Preparation of Silica Dispersion Liquid]

Twelve pts·wt. silica particulates (trade name "SNOWTEX MP-4540M"; manufactured by NISSAN CHEMICAL INDUSTRIES LTD.) was added into pure water and the resultant solution was stirred. Thus, a silica dispersion liquid was obtained. The silica particulates in the silica dispersion liquid had an average particle size of 450 nm.

[Preparation of a Coating Liquid 2 for Ink Receiving layer Formation]

To 100 pts·wt. silica dispersion liquid, 27.8 pts·wt. water solution of polyvinyl alcohol was added, and 1.8 pts·wt. polyallylamine was added as cationic resin. The resultant solution was mixed using a static mixer to prepare a coating liquid 2 for ink receiving layer formation. As the polyallylamine, polyallylamine having a weight-average degree of polymerization of 1600 (trade name "PAA-01" manufactured by Nitto Boseki Co., Ltd.) was used.

[Manufacture of the Transfer Material 2]

A transfer material 2 was obtained as is the case with Example 1 except that a coating liquid 2 for ink receiving layer formation was used instead of the coating liquid 1 for ink receiving layer formation.

The transfer material 2 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 75% of the total area of the ink receiving layer. At least one sea portion was found to be present in one pixel for ink jet printing. The main components of the transfer material are described in Tables 2-3 and 2-4.

A printed material in Example 2 was obtained as is the case with Example 1 except that the transfer material 2 was used instead of the transfer material 1.

Example 4

A printed material in Example 4 was obtained as is the case with Example 3 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

Compared to the transfer material in Example 1, the transfer materials in Examples 3 and 4 are configured such that the inorganic particulates contained in the ink receiving layer have a large average particle size and that the ink receiving layer has a large pore size. Thus, in Example 3 using the pigment ink, the pigment color material is likely to infiltrate into the ink receiving layer, making the area factor likely to be 100%. However, the ink receiving layer has a reduced strength, and thus, the amount of binder needs to be increased, reducing an ink absorption ratio. The increased pore size reduces the capillary force of the air gaps in the ink receiving layer, leading to a slightly lower ink absorption speed. However, Example 3 poses no practical problem, and the transfer material in Example 3 is excellent in image preservation due to the use of the pigment ink. On the other hand, in Example 4 using the dye ink, the dye ink infiltrates through the ink receiving layer while spreading substantially isotropically, and thus, the area factor is likely to be 100%, resulting in appropriate image printing characteristics. However, the transfer material in Example 4 is slightly inferior in image preservation.

Example 5

[Preparation of a Resin Particulate Dispersion Liquid]

Twenty pts·wt. acrylic resin particulates (trade name "MP-300"; manufactured by Soken Chemical and Engineering Co., Ltd.) was added into pure water and the resultant solution was stirred. Thus, a resin particulate dispersion liquid was obtained. The resin particulates in the resin particulate dispersion liquid have an average particle size of 100 nm.

[Preparation of Coating Liquid for Ink Receiving Layer Formation 3]

Twenty-seven point eight pts·wt. water solution of polyvinyl alcohol was added to 100 pts·wt. resin particulate dispersion liquid, and 1.8 pts·wt. polyallylamine was further added to the resultant solution. Then, the solution was mixed using the static mixer to prepare a coating liquid for ink receiving layer formation 3. In this case, polyallylamine with a weight-average degree of polymerization of 1,600 (trade name "PAA-01"; manufactured by Nitto Boseki Co., Ltd.) was used.

[Manufacture of the Transfer Material 3]

A transfer material 3 was obtained as is the case with the transfer material 1 except that the coating liquid for ink receiving layer formation 3 was used instead of the coating liquid for ink receiving layer formation 1.

The transfer material 3 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 75% of the total area of the ink receiving layer. The main components of the transfer material 3 are described in Tables 3-1 and 3-2.

A printed material in Example 5 was obtained as is the case with Example 1 except that the transfer material 3 was used instead of the transfer material 1.

Example 6

A printed material in Example 6 was obtained as is the case with Example 5 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

In Examples 5 and 6, the gap-absorbing ink receiving layer was formed of resin particulates. Thus, in Example 5 using the pigment ink, the pigment color material is prevented from infiltrating into the ink receiving layer as is the case with Example 1, and thus, the area factor is unlikely to be 100%, resulting in slightly inferior image printing characteristics. However, Example 1 poses no practical problem. During the transfer based on thermocompression bonding, the ink receiving layer formed of resin particulates is destroyed and the solvent and the water component held inside the ink receiving layer are likely to seep, leading to slightly inappropriate adhesion. However, the transfer material in Example 5 is excellent in image preservation due to the use of the pigment ink.

On the other hand, in Example 6 using the dye ink, the dye ink infiltrates through the ink receiving layer while spreading substantially isotropically, and thus, the area factor is likely to be 100%, resulting in appropriate image printing characteristics. However, during the transfer based on thermocompression bonding, the ink receiving layer formed of resin particulates is destroyed and the solvent and the water component held inside the ink receiving layer are likely to seep, leading to slightly inappropriate adhesion. Furthermore, the transfer material in Example 6 is slightly inferior in image preservation due to the use of the dye ink.

Example 7

[Preparation of a Water Solution of the Adhesive 4]

Twenty pts·wt. ion exchange water was added to 5 pts·wt. SAIVINOLRMA-63 (average particle size: 1 μm) to prepare a water solution of the adhesive 4.

[Manufacture of the Transfer Material 4]

A transfer material 4 was obtained as is the case with Example 1 except that a water solution of the adhesive 4 was used instead of the water solution of the adhesive 1.

The transfer material 4 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 55% of the total area of the ink receiving layer. The results of the observations and the main components are described in Tables 3-3 and 3-4. A printed material in Example 7 was obtained as is the case with Example 1 except that the transfer material 4 was used instead of the transfer material 1.

Example 8

A printed material in Example 8 was obtained as is the case with Example 7 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

Compared to the transfer material in Example 1, the transfer materials in Example 7 and Example 8 are configured such that the area of the directly exposed sea portion is slightly smaller but that the inorganic particulates contained in the ink receiving layer have the optimal average particle size and the ink receiving layer has the optimal pore size. Thus, in Example 7 using the pigment ink, the pigment color material is prevented from infiltrating into the ink receiving layer, and thus, the area factor is unlikely to be 100%, resulting in slightly inferior image printing characteristics. However, Example 7 poses no practical problem. The transfer material in Example 7 is also excellent in image preservation. On the other hand, in Example 8 using the dye ink, the dye ink infiltrates through the ink receiving layer while spreading substantially isotropically, and thus, the area factor is likely to be 100%, resulting in appropriate image printing characteristics. However, the transfer material in Example 8 is slightly inferior in image preservation.

Example 9

[Preparation of a Water Solution of the Adhesive 5]

Ten pts·wt. ion exchange water was added to 5 pts·wt. SAIVINOL RMA-63 (average particle size: 1 μm) to prepare a water solution of the adhesive 5.

[Manufacture of the Transfer Material 5]

A transfer material 5 was obtained as is the case with Example 1 except that a water solution of the adhesive 5 was used instead of the water solution of the adhesive 1.

The transfer material 5 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 45% of the total area of the ink receiving layer. On the surface of the ink receiving layer, no exposed portion (sea portion) was present in some 1-pixel areas for ink jet printing. The results of the observations and the main components are described in Tables 4-1 and 4-2. A printed material in Example 9 was obtained as is the case with Example 1 except that the transfer material 5 was used instead of the transfer material 1.

Example 10

A printed material in Example 10 was obtained as is the case with Example 9 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

The transfer materials in Example 9 and Example 10 are configured such that the directly exposed sea portions have a small area (50% or less). Thus, in Example 9 using the pigment ink, the directly exposed sea portions have a small area, and the pigment color material is prevented from infiltrating into the ink receiving layer, making the area factor unlikely to be 100%. Consequently, the transfer material in Example 9 exhibits slightly inferior image printing characteristics. However, the transfer material in Example 9 is excellent in image preservation due to the use of the pigment ink.

On the other hand, in Example 10 using the dye ink, the dye ink infiltrates through the ink receiving layer while spreading substantially isotropically. However, since the area of contact with the ink receiving layer is large and the directly exposed area is small, the transfer material has an area factor unlikely to be 100%, and exhibits slightly inferior image printing characteristics. Furthermore, the transfer material in Example 10 is slightly inferior in image preservation due to the use of the dye ink.

Example 11

[Preparation of a Water Solution of the Adhesive 6]

Ten pts·wt. ion exchange water was added to 5 pts·wt. SAIVINOL RMA-63 (average particle size: 1 μm) to prepare a water solution of the adhesive 6.

[Manufacture of the Transfer Material 6]

A transfer material 6 was obtained as is the case with Example 1 except that a water solution of the adhesive 6 was used instead of the water solution of the adhesive 1 and that the number of groove lines in the gravure roll was set to 150. The thickness of the adhesive portion was 6 μm.

The transfer material 6 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 75% of the total area of the ink receiving layer. At least one sea portion was found to be present in one pixel for ink jet printing. The main components of the transfer material 6 are described in Tables 4-3 and 4-4. A printed material in Example 11 was obtained as is the case with Example 1 except that the transfer material 6 was used instead of the transfer material 1.

Example 12

A printed material in Example 12 was obtained as is the case with Example 11 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

Compared to the transfer material in Example 1, the transfer materials in Example 11 and Example 12 are configured such that the adhesive layer has a larger height. Since the adhesive layer has a larger height in Example 11 using the pigment ink than in Example 1, the ink slightly inappropriately hangs into the ink receiving layer. However, Example 11 poses no practical problem. The pigment color material is prevented from infiltrating into the ink receiving layer, making the area factor unlikely to be 100%. Consequently, the transfer material in Example 11 exhibits slightly inferior image printing characteristics. However, Example 11 poses no practical problem. The transfer material in Example 11 is also excellent in image preservation. On the other hand, in Example 12 using the dye ink, the ink very slightly inappropriately hangs into the ink receiving layer due to the increased height of the adhesive layer. However, the dye ink infiltrates through the ink receiving layer while spreading substantially isotropically, and thus, the area factor is likely to be 100%, resulting in appropriate image printing characteristics. The transfer material in Example 12 is slightly inferior in image preservation due to the use of the dye ink.

Example 13

[Preparation of a Water Solution of the Adhesive 7]

Ten pts·wt. ion exchange water was added to 5 pts·wt. SUMIKAFLEX 766 manufactured by Dai-ichi Kogyo Seiyaku (an average particle size of 0.5 μm) to prepare a water solution of the adhesive 7.

[Manufacture of the Transfer Material 7]

A transfer material 7 was obtained as is the case with Example 1 except that a water solution of the adhesive 7 was used instead of the water solution of the adhesive 1. The thickness of the adhesive was 1 μm.

The transfer material 7 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 75% of the total area of the ink receiving layer. The main components of the transfer material 7 are described in Tables 4-5 and 4-6. A printed material in Example 13 was obtained as is the case with Example 1 except that the transfer material 7 was used instead of the transfer material 1.

Example 14

A printed material in Example 14 was obtained as is the case with Example 13 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

Compared to the transfer material in Example 1, the transfer materials in Example 13 and Example 14 are configured such that the adhesive layer has a smaller thickness. Thus, since the adhesive layer in Example 13 using the pigment ink is thinner than the adhesive layer in Example 1, the adhesive melted during transfer slightly insufficiently covers the pigment color material. However, Example 13 poses no practical problem. The pigment color material is prevented from infiltrating into the ink receiving layer, making the area factor unlikely to be 100%. Consequently, the transfer material in Example 13 exhibits slightly inferior image printing characteristics. However, Example 13 poses no practical problem, and the transfer material in Example 13 is excellent in image preservation. On the other hand, the transfer material in Example 14 using the dye ink is slightly inferior in image preservation due to the use of the dye ink. However, the dye ink infiltrates through the ink receiving layer while spreading substantially isotropically, and thus, the area factor is likely to be 100%, resulting in appropriate image printing characteristics.

Example 15

[Preparation of a Water Solution of the Adhesive 8]

Ten pts·wt. ion exchange water was added to 5 pts·wt. CHEMIPEARL V300 manufactured by Mitsui Chemicals, Inc. (an average particle size of 6 μm) to prepare a water solution of the adhesive 8.

[Manufacture of the Transfer Material 8]

A transfer material 8 was obtained as is the case with Example 1 except that a water solution of the adhesive 8 was used instead of the water solution of the adhesive 1. The thickness of the adhesive layer was 12.0 μm.

The transfer material 8 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 75% of the total area of the ink receiving layer. At least one sea portion was found to be present in one pixel for ink jet printing. The main components of the transfer material 8 are described in Tables 5-1 and 5-2. A printed material in Example 15 was obtained as is the case with Example 1 except that the transfer material 8 was used instead of the transfer material 1.

Example 16

A printed material in Example 16 was obtained as is the case with Example 15 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

The transfer materials in Example 15 and Example 16 are configured such that the adhesive layer has a larger height. Thus, in Example 15 using the pigment ink, upon hanging into the adhesive portion, the ink is likely to be broken off to remain on the adhesion surface due to the increased height of the adhesive layer. Thus, the transfer material in Example 15 exhibits slightly inferior image printing characteristics and is also inferior in adhesion performance. However, the transfer material in Example 15 is excellent in image preservation. On the other hand, in Example 16 using the dye ink, upon hanging into the adhesive portion, the ink is likely to be broken off to remain on the adhesion surface due to the increased height of the adhesive layer. Thus, the transfer material in Example 16 is slightly inferior in adhesion performance. The transfer material in Example 16 is also inferior in image preservation due to the use of the dye ink. However, the dye ink infiltrates through the ink receiving layer while spreading substantially isotropically, and thus, the transfer material in Example 16 exhibits slightly inferior image printing characteristics. However, Example 16 poses no practical problem.

Example 17

[Preparation of a Water Solution of the Adhesive 9]

Ten pts·wt. ion exchange water was added to 5 pts·wt. SUPERFLEX 500M manufactured by Mitsui Chemicals, Inc. (an average particle size of 0.15 μm) to prepare a water solution of the adhesive 9.

[Manufacture of the Transfer Material 9]

A transfer material 9 was obtained as is the case with Example 1 except that a water solution of the adhesive 9 was used instead of the water solution of the adhesive 1. The thickness of the adhesive layer was 0.3 μm.

The transfer material 9 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 75% of the total area of the ink receiving layer. The main components of the transfer material 9 are described in Tables 5-3 and 5-4. A printed material in Example 17 was obtained as is the case with Example 1 except that the transfer material 9 was used instead of the transfer material 1.

Example 18

A printed material in Example 18 was obtained as is the case with Example 17 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

The transfer materials in Example 17 and Example 18 are configured such that, when the conditions are an ink receiving layer porosity of 80%, a resolution of 1,200 dpi, an ink ejection amount of 4 pl, and an ink color material concentration of 5%, the thickness of the adhesive portion is smaller than three-hundredths of the thickness of the ink receiving layer. In Example 17 using the pigment ink, the pigment of the color material remaining on the surface lies above the height H of the adhesive portion, which is an island portion, preventing the adhesive portion from completely covering the pigment. Thus, the transfer material in Example 17 is slightly inferior in adhesion performance. The pigment is unlikely to infiltrate into the ink receiving layer or to spread through the ink receiving layer, and thus, the area factor is unlikely to be 100%, resulting in slightly inferior image printing characteristics. However, Example 17 poses no practical problem. The transfer material in Example 17 is also excellent in image preservation. On the other hand, in Example 18 using the dye ink, the dye of the color material is unlikely to remain on the surface and is prevented from hindering the adhesion, resulting in appropriate adhesion. The transfer material in Example 18 is slightly inferior in image preservation due to the use of the dye ink. However, the dye ink infiltrates through the ink receiving layer while spreading substantially isotropically, and thus, the area factor is likely to be 100%, resulting in appropriate image printing characteristics.

Example 19

A printed material was obtained as is the case with Example 1 except that, as the image substrate, recycled paper (trade name "GF-R100"; manufactured by Canon Inc.) was used instead of the vinyl chloride card (trade name "C-4002"; manufactured by EVOLIS). The conditions for thermocompression bonding were a temperature of 160° C., a pressure of 3.9 Kg/cm$^2$, and a conveying speed of 50 mm/sec.

Example 20

A printed material in Example 20 was obtained as is the case with Example 19 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

In Example 19 and Example 20, the transfer material is transferred to the image substrate formed of paper. Appropriate adhesion is achieved by forming an island-and-sea-like adhesive layer using an adhesive that adheres firmly to paper. In Example 19 using the pigment ink, the pigment, which serves as a color material, is unlikely to infiltrate into the ink receiving layer and to spread through the ink receiving layer, and thus, the area factor is unlikely to be 100%, resulting in slightly inferior image printing characteristics. However, Example 17 poses no practical problem. The transfer material in Example 19 is excellent in image preservation due to the use of the pigment ink. In Example 20 using the dye ink, the transfer material is slightly inferior in image preservation due to the use of the dye ink. However, the dye ink infiltrates through the ink receiving layer while spreading substantially isotropically, and thus, the area factor is likely to be 100%, resulting in appropriate image printing characteristics.

Example 21

[Preparation of a Water Solution of the Adhesive 11]

Ten pts·wt. ion exchange water was added to 5 pts·wt. Bondic 1940NE manufactured by DIC (an average particle size of 0.62 μm) to prepare a water solution of the adhesive 11.

[Manufacture of the Transfer Material 11]

A transfer material 11 was obtained as is the case with Example 1 except that a water solution of the adhesive 11 was used instead of the water solution of the adhesive 1.

A printed material in Example 21 was obtained as is the case with Example 1 except that a transfer material 11 was used instead of the transfer material 1 and that, as the image substrate, slide glass (trade name "Slide Glass"; manufactured by MUTO PURE CHEMICALS Co., Ltd.) was used instead of the vinyl chloride card "trade name "C-4002"; manufactured by EVOLIS). The conditions for thermocompression bonding were a temperature of 160° C., a pressure of 3.9 Kg/cm$^2$, and a conveying speed of 50 mm/sec.

Example 22

A printed material in Example 22 was obtained as is the case with Example 21 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

In Example 21 and Example 22, the transfer material is transferred to a glass image substrate. Appropriate adhesion is achieved by forming an island-and-sea-like adhesive layer using an adhesive that adheres firmly to glass. In Example 21 using the pigment ink, the pigment, which serves as a color material, is unlikely to infiltrate into the ink receiving layer and to spread through the ink receiving layer, and thus, the area factor is unlikely to be 100%, resulting in slightly inferior image printing characteristics. However, Example 21 poses no practical problem. The transfer material in Example 21 is excellent in image preservation due to the use of the pigment ink. In Example 22 using the dye ink, the transfer material is slightly inferior in image preservation due to the use of the dye ink. However, the dye ink infiltrates through the ink receiving layer while spreading substantially isotropically, and thus, the area factor is likely to be 100%, resulting in appropriate image printing characteristics.

Example 23

[Preparation of a Water Solution of the Adhesive 12]

Ten pts·wt. ion exchange water was added to 5 pts·wt. Vinyblan 2685 manufactured by Nissin Chemical Co., Ltd. (an average particle size of 0.21 μm) to prepare a water solution of the adhesive 12.

[Manufacture of the Transfer Material 12]

A transfer material 12 was obtained as is the case with Example 1 except that a water solution of the adhesive 12 was used instead of the water solution of the adhesive 1 and that coating was performed such that the ink receiving layer was 10 μm in thickness.

A printed material was obtained as is the case with Example 1 except that a transfer material 12 was used instead of the transfer material 1 and that, as the image substrate, a PET card (trade name "PET Card"; manufactured by Godo Giken K.K.) was used instead of the vinyl chloride card "trade name "C-4002"; manufactured by EVOLIS). The conditions for thermocompression bonding were a temperature of 160° C., a pressure of 3.9 Kg/cm$^2$, and a conveying speed of 50 mm/sec.

Example 24

A printed material in Example 24 was obtained as is the case with Example 23 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

In Example 23 and Example 24, the transfer material is transferred to the PET image substrate. Appropriate adhesion is achieved by forming an island-and-sea-like adhesive layer using an adhesive that adheres firmly to PET. In Example 23 using the pigment ink, the pigment, which serves as a color material, is unlikely to infiltrate into the ink receiving layer and to spread through the ink receiving layer, and thus, the area factor is unlikely to be 100%, resulting in slightly inferior image printing characteristics. However, Example 21 poses no practical problem. The transfer material in Example 23 is excellent in image preservation due to the use of the pigment ink. In Example 24 using the dye ink, the transfer material is slightly inferior in image preservation due to the use of the dye ink. However, the dye ink infiltrates through the ink receiving layer while spreading substantially isotropically, and thus, the area factor is likely to be 100%, resulting in appropriate image printing characteristics.

Example 25

A 100% solid image with a print duty of 100% was printed on the transfer material 13 with the pigment ink using the above-described first manufacturing apparatus. A multilayer printed material was obtained as is the case with Example 1 except that, subsequently to the printing of the image, the transfer material 13 was thermocompression-bonded to the ink receiving layer of the printed material 1 in Example 1, and then the PET substrate of the transfer material 13 was peeled off. A 100% solid image with a print duty of 100% was printed on the ink receiving layer of the multilayer printed material to form a printed material in Example 25.

Example 26

A printed material in Example 26 was obtained as is the case with Example 25 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

In Example 25 and Example 26, the multilayer structure was configured by laminating the ink receiving layer of the transfer material to the gap-absorbing ink receiving layer. A transfer material used was obtained by forming the gap-absorbing ink receiving layer on the substrate and discretely providing the adhesive pieces of the adhesive layer on the surface of the ink receiving layer so as to form directly exposed portions on the surface of the ink receiving layer. The use of such a transfer material allows the adhesive layer to be easily melted by thermocompression bonding to fill, with the adhesive, spaces formed between the ink receiving layer on the printed material side and the ink receiving layer on the transfer material side. As described above, the gap-absorbing ink receiving layers can be attached to each other, allowing a multilayer printed material with the multiple ink receiving layers to be produced on the image substrate.

In Example 25 using the pigment ink, the pigment, which serves as a color material, is unlikely to infiltrate into the ink receiving layer or and spread through the ink receiving layer, and thus, the area factor is unlikely to be 100%, resulting in slightly inferior image printing characteristics. However, Example 25 poses no practical problem. The transfer material in Example 25 is excellent in image preservation due to the use of the pigment ink. In Example 26 using the dye ink, the transfer material is slightly inferior in image preservation due to the use of the dye ink. However, the dye ink infiltrates through the ink receiving layer while spreading substantially isotropically, and thus, the area factor is likely to be 100%, resulting in appropriate image printing characteristics.

Example 27

[Synthesis of a Water Solution of PVA 2]

Polyvinyl alcohol (trade name "PVA123", manufactured by KURARAY CO., LTD.) was dissolved into ion exchange water to prepare a water solution of polyvinyl alcohol with a solid content of 8%. The polyvinyl alcohol had a weight-average degree of polymerization of 2,300 and a degree of saponification of 98 to 99 mol %.

[Synthesis of a Coating Liquid for Transparent Sheet Formation]

Nine pts·wt. water solution of acrylic emulsion (JONCRYL 352D manufactured by BASF, Tg: 56° C., solid content concentration: 45%), 1 pts·wt. water solution of urethane emulsion (SUPERFLEX 130 manufactured by DKS Co., Ltd., Tg: 103° C., solid content concentration: 35%), and 0.5 pts·wt. water solution of PVA were added together. The resultant solution was stirred and mixed for five minutes to prepare a coating liquid for transparent sheet formation.

[Manufacture of a Laminate Sheet (a Component Material of the Transfer Material)]

A coating liquid for transparent sheet formation was applied to a surface (a thickness of 19 μm) of a PET substrate (trade name "Tetoron G2"; manufactured by Teijin Dupont Films Japan Limited) and then dried to form a laminate sheet. The die coater was used for the coating, the coating speed was set to 5 m/min, and the amount of coating resulting from drying was set to 5 g/m$^2$. The drying temperature was set to 90° C.

Then, the surface of the transparent sheet of the laminate sheet was coated with the coating liquid for ink receiving layer formation 1 and then dried to form a laminate sheet serving as a component material of the transfer material including the substrate, the transparent protective layer, and the ink receiving layer. The die coater was used for the coating, the coating speed was set to 5 m/min, and the amount of coating resulting from drying was set to 15 g/m$^2$. The drying temperature was set to 100° C. The ink receiving layer was 15 μm in thickness.

[Manufacture of the Transfer Material 14]

A transfer material was manufactured by with applying the water solution of the adhesive 1 to the surface of the ink receiving layer of the laminate sheet and then drying the resultant laminate to discretely provide the adhesive pieces of the adhesive layer on the surface of the ink receiving layer so as to leave the remaining portions of the surface of the ink receiving layer directly exposed. The gravure coater was used to apply the coating liquid, and the coating speed was set to 5 m/min. The drying temperature was set to 60° C. In this case, the number of groove lines in the gravure roll was set to 200. The transfer material was wound into a roll such that the ink receiving layer was located on the outer side of the roll, whereas the substrate was located on the inner side of the roll. The island-like adhesive layer was 2 μm in thickness.

The transfer material 14 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 75% of the total area of the ink receiving layer. At least one sea portion was found to be present in one pixel for ink jet printing. The main components of the transfer material 14 are described in Tables 7-1 and 7-2.

[Printed Material]

A printed material in Example 27 was obtained as is the case with Example 1 except that the transfer material 14 was used instead of the transfer material 1 and that only the PET substrate of the transfer material was peeled off (a part of the substrate was peeled off) after the thermocompression bonding and that the transparent sheet and the ink receiving layer were laminated to the vinyl chloride card.

Example 28

A printed material in Example 28 was obtained as is the case with Example 27 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

The transfer materials in Example 27 and Example 28 are configured such that a part of the substrate is peeled off. After the thermocompression bonding, the PET substrate, which serves as a conveyance layer, is peeled off, and the transparent protective layer is laminated to the printing surface of the ink receiving layer. In Example 27 using the pigment ink, the pigment, which serves as a color material, is unlikely to infiltrate into the ink receiving layer and to spread through the ink receiving layer, and thus, the area factor is unlikely to be 100%, resulting in slightly inferior image printing characteristics. However, Example 27 poses no practical problem. The transfer material in Example 27 is excellent in image preservation due to the use of the pigment ink. In Example 28 using the dye ink, the transfer material is slightly inferior in image preservation due to the use of the dye ink. However, the dye ink infiltrates through the ink receiving layer while spreading substantially isotropically, and thus, the area factor is likely to be 100%, resulting in appropriate image printing characteristics.

Example 29

[Manufacture of a Laminate Sheet (a Component Material of the Transfer Material)]

A surface (a thickness of 50 μm) of an acrylic substrate (trade name "PARAPURE"; manufactured by Kuraray Co., Ltd.) was coated with the coating liquid for ink receiving layer formation 1 and then dried to form a laminate sheet serving as a component material of the transfer material including the substrate and the ink receiving layer. The die coater was used for the coating, the coating speed was set to 5 m/min, and the thickness of coating resulting from drying was set to 15 μm. The drying temperature was set to 90° C.

[Manufacture of the Transfer Material 15]

The surface of the ink receiving layer of the laminate sheet was coated with the water solution of the adhesive 1 and then dried to form a transfer material in which the adhesive layer was formed on the surface of the ink receiving layer. The adhesive layer includes the island portions and the sea portions that are formed by disposing the adhesive pieces on the surface of the ink receiving layer in the form of islands and seas; the island portions are formed of the adhesive, and the sea portions correspond to the exposed portions of the ink receiving layer having no adhesive on the surfaces of the exposed portions. The gravure coater was used to apply the coating liquid, and the coating speed was set to 5 m/min. The drying temperature was set to 60° C. In this case, the number of groove lines in the gravure roll was set to 200. The transfer material was wound into a roll such that the ink receiving layer was located on the outer side of the roll, whereas the substrate was located on the inner side of the roll. The island-like adhesive layer was 2 μm in thickness.

The transfer material 15 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 75% of the total area of the ink receiving layer. At least one sea portion was found to be present in one pixel for ink jet printing. The main components of the transfer material 15 are described in Tables 7-3 and 7-4.

[Printed Material]

In Example 29, the second manufacturing apparatus was used instead of the first manufacturing apparatus, the transfer material 15 was used instead of the transfer material 1 and transferred onto an acrylic plate (trade name "ACRYSUNDAY PLATE"; manufactured by ACRYSUNDAY Co., Ltd.) serving as the image substrate. After the transfer, the acrylic substrate was left, and the substrate and the ink receiving layer were laminated to the image substrate. The printed material in Example 29 was otherwise obtained as is the case with Example 1.

Example 30

A printed material in Example 30 was obtained as is the case with Example 29 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

The transfer materials in Example 29 and Example 30 are configured such that the substrate is not peeled off. When the substrate was left rather than being peeled off and the substrate and the ink receiving layer are laminated to the image substrate as described above, the conveyance layer can serve as a protective layer for the ink receiving layer. In Example 29 using the pigment ink, the pigment, which serves as a color material, is unlikely to infiltrate into the ink receiving layer and to spread through the ink receiving layer, and thus, the area factor is unlikely to be 100%, resulting in slightly inferior image printing characteristics. However, Example 31 poses no practical problem. The transfer material in Example 29 is excellent in image preservation due to the use of the pigment ink. In Example 30 using the dye ink, the transfer material is slightly inferior in image preservation due to the use of the dye ink. However, the dye ink infiltrates through the ink receiving layer while spreading substantially isotropically, and thus, the area factor is likely to be 100%, resulting in appropriate image printing characteristics.

Example 31

[Manufacture of the Transfer Material 16]

A transfer material 16 was obtained as is the case with Example 1 except that, instead of the PET substrate sheet (trade name "Tetoron G2"; manufactured by Teijin Dupont Films Japan Limited), a sheet (trade name "ALPHAN BDH-224"; manufactured by Oji F-Tex Co., Ltd.) was used in which a polypropylene-based adhesive layer was formed on one surface of a polypropylene-based substrate with a thickness of 25 μm and in which a heat seal layer was formed on the other surface of the substrate, and except that the second manufacturing apparatus was used instead of the first manufacturing apparatus.

The transfer material 16 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 75% of the total area of the ink receiving layer. At least one sea portion was found to be present in one pixel for ink jet printing. The main components of the transfer material 16 are described in Tables 7-5 and 7-6.

Using the above-described first manufacturing apparatus, a 100% solid image with a print duty of 100% was printed on the ink jet printing surface of the transfer material 16 with the resin-dispersing pigment ink at a resolution of 1,200 dpi and an ink ejection amount of 4 pl. As the printing unit of the manufacturing apparatus, the pigment ink jet printer equipped with the serial head (trade name "PIXUS PRO-1" manufactured by Canon Inc.) was used. The printer was provided with the resin-dispersing pigment ink, and a 100% solid image with a print duty of 100% was printed in the plain paper mode (an ejection amount of 4 pl, a resolution of 1,200 dpi, monochrome printing). The ink receiving layer and the heat seal layer were attached together to form a package. Thermocompression bonding for manufacturing the package was performed at a temperature of 150° C. and a pressure of 0.5 kg/cm$^2$.

Example 32

A printed material in Example 32 was obtained as is the case with Example 31 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

In the transfer materials in Example 31 and Example 32, the conveyance layer of the substrate is not peeled off, and heat seal layers are provided on the opposite sides of the transfer material. A package can be manufactured by folding back the transfer material of the printed material as described above to attach the ink receiving layer to the heat seal layer provided opposite to the ink receiving layer, via the adhesive particles discretely disposed on the surface of the ink receiving layer. Of course, in other forms, a package may be manufactured in which the ink receiving layers can be attached together, and a package may also be manufactured in which the heat seal layers provided on the opposite sides are attached together. In Example 31 using the pigment ink, the pigment, which serves as a color material, is unlikely to infiltrate into the ink receiving layer and to spread through the ink receiving layer, and thus, the area factor is unlikely to be 100%, resulting in slightly inferior image printing characteristics. However, Example 31 poses no practical problem. The transfer material in Example 31 is excellent in image preservation due to the use of the pigment ink. In Example 32 using the dye ink, the transfer material is slightly inferior in image preservation due to the use of the dye ink. However, the dye ink infiltrates through the ink receiving layer while spreading substantially isotropically, and thus, the area factor is likely to be 100%, resulting in appropriate image printing characteristics.

Example 33

A printed material in Example 33 was obtained as is the case with Example 1 except that a transfer material 17 was used instead of the transfer material 1 and that the second manufacturing apparatus was used instead of the first manufacturing apparatus. After printing of an image, the ink jet printing surface of the transfer material was heated at 110° C. for five minutes.

For the adhesive, the transfer material in Example 33 includes a self-melt adhesive. For the self-melt adhesive, the adhesive provided on the ink receiving layer is melted such that the adjacent adhesive pieces adhere to each other while covering the printing surface subjected to ink jet printing. Consequently, even if the pigment ink is used and the color material of which is likely to remain on the surface, the printing surface subjected to ink jet printing with the pigment ink is protected by the self-melt adhesive. Thus, abrasion resistance of the printed material is enhanced. Furthermore, the pigment, which serves as a color material, is unlikely to infiltrate into the ink receiving layer and to spread through the ink receiving layer, and thus, the area factor is unlikely to be 100%.

Comparative Example 1

[Manufacture of the Transfer Material 18]

A transfer material 18 with no exposed portion (sea portion) on the surface of the ink receiving layer was obtained as is the case with Example 1 except that, instead of the water solution of the adhesive 1, SAIVINOL RMA-63 manufactured by SAIDEN CHEMICAL INDUSTRY CO., LTD. (an average particle size of 1 μm) was used which was not diluted with ion exchange water and except that the adhesive layer was formed on the ink receiving layer to a thickness of 2 μm using the die coater.

The transfer material 18 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The ink receiving layer was entirely covered with the adhesive, and the exposed portion of the ink receiving layer, having no adhesive thereon, was not present on the surface of the ink receiving layer. The results of the observations and the main components are described in Tables 9-1 and 9-2. A printed material in Comparative Example 1 was obtained as is the case with Example 1 except that the transfer material 18 was used instead of the transfer material 1.

Comparative Example 2

A printed material in Comparative Example 2 was obtained as is the case with Comparative Example 1 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl.

Comparative Example 3

[Manufacture of the Transfer Material 19]

A transfer material 19 with a swelling absorbing ink receiving layer was obtained as is the case with Example 1 except that, instead of the coating liquid for ink receiving layer formation, NS-625XC manufactured by TAKAMATSU OIL & FAT CO., LTD. was used.

The transfer material 19 was observed from the printing surface side using the SEM. The following were determined: the area of a part of the adhesive portion contacting the front layer of the gap-absorbing ink receiving layer (contact area), the area of the adhesive portion as viewed directly from the printing surface side (adhesive portion area), and the area of the exposed portion of the ink receiving layer, having no adhesive on the surface thereof (exposed portion area). The contact area was smaller than the adhesive portion area, and the exposed portion area was 75% of the total area of the ink receiving layer. The results of the observations and the main components are described in Tables 9-3 and 9-4. A printed material in Comparative Example 3 was obtained as is the case with Example 1 except that the transfer material 19 was used instead of the transfer material 1.

Comparative Example 4

A printed material in Comparative Example 4 was obtained as is the case with Comparative Example 3 except that, instead of the resin-dispersing pigment ink, dye ink (trade name "BC-341XL"; manufactured by Canon Inc.) was used and that a 100% solid image with a print duty of 100% was printed with magenta ink at a resolution of 1,200 dpi and an ink ejection amount of 4 pl. In Comparative Examples 1, 3, and 4, the adhesion was inappropriate, precluding the transfer material from being transferred to the image substrate. Consequently, image preservation failed to be evaluated.

Comparative Example 5

[Manufacture of the Transfer Material 20]

A transfer material 20 having no island portions formed of the adhesive was obtained as is the case with Example 33 except that the surface of the ink receiving layer of the laminate sheet was not coated with the water solution of the adhesive 1. The main components are described in Tables 10-1 and 10-2. An image was printed as is the case with Example 33 except the transfer material 20 was used instead of the transfer material 1. Then, the ink jet printing surface of the transfer material was heated at 110° C. for five minutes to form a printed material in Comparative Example 5.

<Evaluation>

(Image Characteristics)

The transfer materials in the above-described examples and comparative examples were evaluated for image printing characteristics (image characteristics). The image characteristics were evaluated by comprehensively considering the ink absorptivity and the void level (image density) of the transfer materials. For the ink absorptivity and the void level (image density), the worst evaluation results are described in Tables 10-1 and 10-2.

(Ink Absorptivity)

The transfer materials in the above-described examples and comparative examples were evaluated for the ink absorptivity. Specifically, paper was laid on the image printing surface one second after an image was printed on the transfer material. Shift, to the paper, of unabsorbed ink that had not been absorbed by the transfer material was visually checked, and the ink absorptivity was evaluated based on the following criteria.

⊙: The rate of ink that shifted to the paper is less than 50.

○: The rate of ink that shifted to the paper is equal to or higher than 5% and less than 10%.

Δ: The rate of ink that shifted to the paper is equal to or higher than 10% and less than 20%.

x: The rate of ink that shifted to the paper is equal to or higher than 20%.

(Void Level (Image Density))

The transfer materials in the above-described examples and comparative examples were evaluated for the level of voids in the image. Specifically, a solid image was printed on the printing surface of the transfer material. Then, the portion of the transfer material on which the solid image had been printed was observed from the side opposite to the printing surface using a microscope, to evaluate the void level based on the following criteria.

⊙: The area factor is 95% or more.

○: The area factor is equal to or higher than 70% and lower than 95%.

Δ: The area factor is equal to or higher than 50% and lower than 70%.

x: The area factor is lower than 50%.

(Adhesion Characteristics)

The transfer materials in the above-described examples and comparative examples were evaluated for the adhesion. The adhesion was evaluated by thermocompression-bonding and attaching the transfer material to the image substrate, and the evaluation was performed based on the criteria described below. For Examples 31 and 32, the adhesion between the ink receiving layer on the front surface of the transfer material and the heat seal layer on the back surface of the transfer material was evaluated based on the criteria described below. For Example 33 and Comparative Example 5, the surface state of the printing surface subjected to ink jet printing was observed using the microscope and evaluated based on the criteria described below. The results of the evaluation are described in Tables 8-1, 8-2, 10-1, and 10-2.

○: The transfer material is appropriately transferred (attached) to the image substrate or the printing surface is completely covered with the adhesive.

Δ: The transfer material partly fails to be transferred (attached) to the image substrate, or not all of the printing surface is covered with the adhesive.

x: The transfer material completely fails to be transferred (attached) to the image substrate or the printing surface is not covered with the adhesive.

(Image Preservation)

Image preservation was evaluated by comprehensively considering migration resistance, water resistance, and light resistance. For the migration resistance, the water resistance, and the light resistance, the worst evaluation results are described in Tables 9-1 to 10-2.

(Migration Resistance)

Migration tests were conducted on the printed materials in the above-described examples and comparative examples. The printed materials were left in a high-temperature and high-humidity environment (30° C. and 80% RH) for 72 hours. Then, the printed materials were visually checked for image bleeding (migration) to evaluate image preservation (migration resistance) based on the following criteria.

○: No image bleeding occurs.

Δ: The image partly (slightly) bleeds.

x: The image bleeds.

(Water Resistance)

Water resistance tests were conducted on the above-described examples and comparative examples. The printed materials were immersed in pure water and left for 48 hours. Then, the image printed on each of the printed materials was visually checked for bleeding to evaluate image preservation (water resistance) based on the following criteria.

○: No image bleeding occurs.

Δ: The image partly (slightly) bleeds.

x: The image bleeds.

(Light Resistance)

Light resistance tests were conducted on the printed materials in the above-described examples and comparative examples. The printed materials were fed into an Atlas fadeometer (conditions: an irradiation intensity of 39 W/m$^2$ at a wavelength of 340 nm, a temperature of 45° C., and a humidity of 50%). One hundred hours later, the optical density of the image on each of the printed materials were measured using an optical reflective densitometer (trade name "RD-918"; manufactured by GretagMacbeth). A residual OD rate was calculated in accordance with the following Equation for evaluation.

$$\text{Residual } OD \text{ rate} = (OD \text{ after test}/OD \text{ before test}) \times 100\%$$

○: The residual OD rate is equal to or higher than 90%.

Δ: The residual OD rate is equal to or higher than 60% and lower than 90%.

x: The residual OD rate is lower than 60%.

(Abrasion Resistance)

The printed materials in Example 20 and Comparative Example 4 described above were evaluated for abrasion resistance. The printing surface of each of the printed materials was rubbed 50 times using cleaning paper with a 200-g load imposed thereon. Abrasion of the printed image and the transfer state of a printed portion (solid image) to the cleaning paper were visually checked to evaluate abrasion resistance based on the following criteria. The results of the evaluation are described in Tables 6-1, 6-2, 9-3, and 9-4.

○: The image is not abraded and none of the printed image adheres to the cleaning paper.

x: The image is slightly abraded.

TABLE 2-1

| | | Example 1 Example 2 Transfer material 1 |
|---|---|---|
| Surface state | | Islands and seas |
| Ink receiving layer | | Gap absorbing type |
| Island and sea | Relation between area (S1) of part of adhesive portion that contacts ink receiving layer and area (S2) of adhesive portion as directly viewed | S1 < S2 |
| | Area ratio of directly exposed portion (%) | 75 |
| Adhesion layer | Adhesive material | SAIVINOL RMA-63 (particles, dried at 60° C.) |
| | Adhesive Average particle size | 1 μm |
| | Adhesive layer thickness | 2 μm |

TABLE 2-2

| | | Example 1 Transfer material 1 | Example 2 Transfer material 1 |
|---|---|---|---|
| Ink receiving layer | Inorganic particulates | HP-14 | |
| | Water-soluble resin | PVA235 | |
| | Others | — | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | ○ | ○ |
| | Image preservation (Migration/water resistance/light resistance) | ○ | Δ |

TABLE 2-3

| | | Example 3 Transfer material 2 | Example 4 Transfer material 2 |
|---|---|---|---|
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | SAIVINOL RMA-63 (particles, dried at 60° C.) | |
| | Adhesive Average particle size | 1 μm | |
| | Adhesive layer thickness | 2 μm | |

TABLE 2-4

| | | Example 3 Transfer material 2 | Example 4 Transfer material 2 |
|---|---|---|---|
| Ink receiving layer | Inorganic particulates | SNOWTEX MP4540M | |
| | Water-soluble resin | PVA235 | |
| | Others | — | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | ○ | ○ |
| | Image preservation (Migration/water resistance/light resistance) | ○ | Δ |

TABLE 3-1

| | | Example 5 | Example 6 |
|---|---|---|---|
| | | Transfer material 3 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | SAIVINOL RMA-63 (particles, dried at 60° C.) | |
| | Adhesive Average particle size | 1 μm | |
| | Adhesive layer thickness | 2 μm | |

TABLE 3-2

| | | Example 5 | Example 6 |
|---|---|---|---|
| | | Transfer material 3 | |
| Ink receiving layer | Inorganic particulates | — | |
| | Water-soluble resin | PVA235 | |
| | Others | MP-300 | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | Δ | Δ |
| | Image preservation (Migration/water resistance/light resistance) | ○ | Δ |

TABLE 3-3

| | | Example 7 | Example 8 |
|---|---|---|---|
| | | Transfer material 4 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 55 | |
| Adhesion layer | Adhesive material | SAIVINOL RMA-63 (particles, dried at 60° C.) | |
| | Adhesive Average particle size | 1 μm | |
| | Adhesive layer thickness | 2 μm | |

TABLE 3-4

| | | Example 7 | Example 8 |
|---|---|---|---|
| | | Transfer material 4 | |
| Ink receiving layer | Inorganic particulates | HP-14 | |
| | Water-soluble resin | PVA235 | |
| | Others | — | |

TABLE 3-4-continued

| | | Example 7 | Example 8 |
|---|---|---|---|
| | | Transfer material 4 | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | ○ | ○ |
| | Image preservation (Migration/water resistance/light resistance) | ○ | Δ |

TABLE 4-1

| | | Example 9 | Example 10 |
|---|---|---|---|
| | | Transfer material 5 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 45 | |
| Adhesion layer | Adhesive material | SAIVINOL RMA-63 (particles, dried at 60° C.) | |
| | Adhesive Average particle size | 1 μm | |
| | Adhesive portion thickness | 2 μm | |

TABLE 4-2

| | | Example 9 | Example 10 |
|---|---|---|---|
| | | Transfer material 5 | |
| Ink receiving layer | Inorganic particulates | HP-14 | |
| | Water-soluble resin | PVA235 | |
| | Others | — | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | Δ | Δ |
| | Adhesion | ○ | ○ |
| | Image preservation (Migration/water resistance/light resistance) | ○ | Δ |

TABLE 4-3

| | Example 11 | Example 12 |
|---|---|---|
| | Transfer material 6 | |
| Surface state | Islands and seas | |
| Ink receiving layer | Gap absorbing type | |

TABLE 4-3-continued

| | | Example 11 | Example 12 |
|---|---|---|---|
| | | Transfer material 6 | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | SAIVINOL RMA-63 (particles) | |
| | Adhesive Average particle size | 3 μm | |
| | Adhesive portion thickness | 6 μm | |

TABLE 4-4

| | | Example 11 | Example 12 |
|---|---|---|---|
| | | Transfer material 6 | |
| Ink receiving layer | Inorganic particulates | HP-14 | |
| | Water-soluble resin | PVA235 | |
| | Others | — | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | ○ | ○ |
| | Image preservation (Migration/water resistance/light resistance) | ○ | Δ |

TABLE 4-5

| | | Example 13 | Example 14 |
|---|---|---|---|
| | | Transfer material 7 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | SUMIKAFLEX 755 (particles) | |
| | Adhesive Average particle size | 0.5 μm | |
| | Adhesive portion thickness | 1 μm | |

TABLE 4-6

| | | Example 13 | Example 14 |
|---|---|---|---|
| | | Transfer material 7 | |
| Ink receiving layer | Inorganic particulates | HP-14 | |
| | Water-soluble resin | PVA235 | |
| | Others | — | |
| | Ink receiving layer thickness | 15 μm | |

TABLE 4-6-continued

| | | Example 13 | Example 14 |
|---|---|---|---|
| | | Transfer material 7 | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | ○ | ○ |
| | Image preservation (Migration/water resistance/light resistance) | ○ | Δ |

TABLE 5-1

| | | Example 15 | Example 16 |
|---|---|---|---|
| | | Transfer material 8 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | CHEMIPEARL V300 (particles) | |
| | Adhesive Average particle size | 6 μm | |
| | Adhesive layer thickness | 12 μm | |

TABLE 5-2

| | | Example 15 | Example 16 |
|---|---|---|---|
| | | Transfer material 8 | |
| Ink receiving layer | Inorganic particulates | HP-14 | |
| | Water-soluble resin | PVA235 | |
| | Others | — | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | Δ | ○ |
| | Adhesion | Δ | Δ |
| | Image preservation (Migration/water resistance/light resistance) | ○ | Δ |

TABLE 5-3

| | | Example 17 | Example 18 |
|---|---|---|---|
| | | Transfer material 9 | |
| Surface state | | Islands and seas | |
| Ink receiving layer | | Gap absorbing type | |
| Island and sea | Relation between area (S1) of part of adhesive portion that contacts ink receiving layer | S1 < S2 | |

TABLE 5-3-continued

| | | Example 17 | Example 18 |
|---|---|---|---|
| | | Transfer material 9 | |
| | and area (S2) of adhesive portion as directly viewed | | |
| | Area ratio of directly exposed portion (%) | 75 | |
| Adhesion layer | Adhesive material | SUPERFLEX 500M (particles) | |
| | Adhesive Average particle size | 0.15 μm | |
| | Adhesive layer thickness | 0.3 μm | |

TABLE 5-4

| | | Example 17 | Example 18 |
|---|---|---|---|
| | | Transfer material 9 | |
| Ink receiving layer | Inorganic particulates | HP-14 | |
| | Water-soluble resin | PVA235 | |
| | Others | — | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | Δ | ○ |
| | Image preservation (Migration/water resistance/light resistance) | ○ | Δ |

TABLE 6-1

| | | Example 19 | Example 20 |
|---|---|---|---|
| | | Transfer material 10 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | SAIVINOL RMA-63 (particles) | |
| | Adhesive Average particle size | 1 μm | |
| | Adhesive layer thickness | 2 μm | |

TABLE 6-2

| | | Example 19 | Example 20 |
|---|---|---|---|
| | | Transfer material 10 | |
| Ink receiving layer | Inorganic particulates | HP-14 | |
| | Water-soluble resin | PVA235 | |
| | Others | — | |
| | Ink receiving layer thickness | 15 μm | |
| Printing | Ink | Resin dispersing pigment | Dye |

TABLE 6-2-continued

| | | Example 19 | Example 20 |
|---|---|---|---|
| | | Transfer material 10 | |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | ○ | ○ |
| | Image preservation (Migration/water resistance/light resistance) | ○ | Δ |

TABLE 6-3

| | | Example 21 | Example 22 |
|---|---|---|---|
| | | Transfer material 11 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | Bondic 1940NE (particles) | |
| | Adhesive Average particle size | 0.62 μm | |
| | Adhesive layer thickness | 1.24 μm | |

TABLE 6-4

| | | Example 21 | Example 22 |
|---|---|---|---|
| | | Transfer material 11 | |
| Ink receiving layer | Inorganic particulates | HP-14 | |
| | Water-soluble resin | PVA235 | |
| | Others | — | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | ○ | ○ |
| | Image preservation (Migration/water resistance/light resistance) | ○ | Δ |

TABLE 6-5

| | | Example 23 | Example 24 |
|---|---|---|---|
| | | Transfer material 12 | |
| Surface state | | Islands and seas | |
| Ink receiving layer | | Gap absorbing type | |
| Island and sea | Relation between area (S1) of part of adhesive portion that contacts ink receiving layer and area (S2) of adhesive | S1 < S2 | |

TABLE 6-5-continued

| | | Example 23 | Example 24 |
|---|---|---|---|
| | | Transfer material 12 | |
| | portion as directly viewed | | |
| | Area ratio of directly exposed portion (%) | 75 | |
| Adhesion layer | Adhesive material | Vinyblan 2585 (particles) | |
| | Adhesive | 0.21 μm | |
| | Average particle size | | |
| | Adhesive layer thickness | 0.42 μm | |

TABLE 6-6

| | | Example 23 | Example 24 |
|---|---|---|---|
| | | Transfer material 12 | |
| Ink receiving layer | Inorganic particulates | HP-14 | |
| | Water-soluble resin | PVA235 | |
| | Others | — | |
| | Ink receiving layer thickness | 10 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | ○ | ○ |
| | Image preservation (Migration/water resistance/light resistance) | ○ | Δ |

TABLE 6-7

| | | Example 25 | Example 26 |
|---|---|---|---|
| | | Transfer material 13 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | SAIVINOL RMA-63 (particles) | |
| | Adhesive | 1 μm | |
| | Average particle size | | |
| | Adhesive layer thickness | 2 μm | |

TABLE 6-8

| | | Example 25 | Example 26 |
|---|---|---|---|
| | | Transfer material 13 | |
| Ink receiving layer | Inorganic particulates | HP-14 | |
| | Water-soluble resin | PVA235 | |
| | Others | — | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |

TABLE 6-8-continued

| | | Example 25 | Example 26 |
|---|---|---|---|
| | | Transfer material 13 | |
| Evaluation | Image characteristics (Absorption, concentration, and voids) | ○ | ⊙ |
| | Adhesion | ○ | ○ |
| | Image preservation (Migration/water resistance/light resistance) | ○ | Δ |

TABLE 7-1

| | | Example 27 | Example 28 |
|---|---|---|---|
| | | Transfer material 14 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | SAIVINOL RMA-63 (particles) | |
| | Adhesive | 1 μm | |
| | Average particle size | | |
| | Adhesive portion thickness | 2 μm | |

TABLE 7-2

| | | Example 27 | Example 28 |
|---|---|---|---|
| | | Transfer material 14 | |
| Ink receiving layer | Inorganic particulates | HP-14 | |
| | Water-soluble resin | PVA235 | |
| | Others | — | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ○ | ⊙ |
| | Adhesion | ○ | ○ |
| | Image preservation (Migration/water resistance/light resistance) | ○ | Δ |

TABLE 7-3

| | | Example 29 | Example 30 |
|---|---|---|---|
| | | Transfer material 15 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | SAIVINOL RMA-6 (particles) | |

TABLE 7-3-continued

| | | Example 29 | Example 30 |
|---|---|---|---|
| | | Transfer material 15 | |
| | Adhesive | 1 μm | |
| | Average particle size | | |
| | Adhesive portion thickness | 2 μm | |

TABLE 7-4

| | | Example 29 | Example 30 |
|---|---|---|---|
| | | Transfer material 15 | |
| Ink receiving layer | Inorganic particulates | HP-14 | |
| | Water-soluble resin | PVA235 | |
| | Others | — | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ⊙ | ⊙ |
| | Adhesion | ○ | ○ |
| | Image preservation (Migration/water resistance/light resistance) | ○ | Δ |

TABLE 7-5

| | | Example 31 | Example 32 |
|---|---|---|---|
| | | Transfer material 16 | |
| Surface state | | Islands and seas | |
| Ink receiving layer | | Gap absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | SAIVINOL RMA-63 (particles) | |
| | Adhesive | 1 μm | |
| | Average particle size | | |
| | Adhesive portion thickness | 2 μm | |

TABLE 7-6

| | | Example 31 | Example 32 |
|---|---|---|---|
| | | Transfer material 16 | |
| Ink receiving layer | Inorganic particulates | 1200 dpi | |
| | Water-soluble resin | 4 pl | |
| | Others | 20μ | |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | ⊙ | ⊙ |

TABLE 7-6-continued

| | | Example 31 | Example 32 |
|---|---|---|---|
| | | Transfer material 16 | |
| | Adhesion | ○ | ○ |
| | Image preservation (Migration/water resistance/light resistance) | ○ | Δ |

TABLE 8-1

| | | Example 33 Transfer material 17 |
|---|---|---|
| Surface state | | Islands and seas |
| Ink receiving layer | | Gap absorbing type |
| Island and sea | Relation between area (S1) of part of adhesive portion that contacts ink receiving layer and area (S2) of adhesive portion as directly viewed | S1 < S2 |
| | Area ratio of directly exposed portion (%) | 75 |
| Adhesion layer | Adhesive material | SAIVINOL RMA-63 (particles) |
| | Adhesive | 1 μm |
| | Average particle size | |
| | Adhesive layer thickness | 2 μm |

TABLE 8-2

| | | Example 33 Transfer material 17 |
|---|---|---|
| Ink receiving layer | Inorganic particulates | HP-14 |
| | Water-soluble resin | PVA235 |
| | Others | — |
| | Ink receiving layer thickness | 15 μm |
| Printing | Ink | Resin dispersing pigment |
| | Resolution | 1200 dpi |
| | Ejection amount | 4 pl |
| | Ink landing diameter | 20μ |
| Evaluation | Image characteristics (Absorption, concentration, and voids) | ○ |
| | Adhesion | ○ |
| | Image preservation (abrasion resistance) | ○ |

TABLE 9-1

| | | Comparative Example 1 | Comparative Example 2 |
|---|---|---|---|
| | | Transfer material 18 | |
| Surface state | | Only islands | |
| Ink receiving layer | | Gap absorbing type | |
| Island and sea | Relation between area (S1) of part of adhesive portion that contacts ink receiving layer and area (S2) of adhesive portion as directly viewed | | |
| | Area ratio of directly exposed portion (%) | | |

TABLE 9-1-continued

| | | Comparative Example 1 | Comparative Example 2 |
|---|---|---|---|
| | | Transfer material 18 | |
| Adhesion layer | Adhesive material | SAIVINOL RMA-63 (particles) | |
| | Adhesive | 1 μm | |
| | Average particle size | | |
| | Adhesive layer thickness | 2 μm | |

TABLE 9-2

| | | Comparative Example 1 | Comparative Example 2 |
|---|---|---|---|
| | | Transfer material 18 | |
| Ink receiving layer | Inorganic particulates | HP-14 | |
| | Water-soluble resin | PVA235 | |
| | Others | — | — |
| | Ink receiving layer thickness | 15 μm | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | x | x |
| | Adhesion | x | Δ |
| | Image preservation (Migration/water resistance/light resistance) | — | Δ |

TABLE 9-3

| | | Comparative Example 3 | Comparative Example 4 |
|---|---|---|---|
| | | Transfer material 19 | |
| Surface state | | Islands and seas | |
| Ink receiving layer | | Swelling absorbing type | |
| Island and sea | Relation between area (S1) of part of adhesive portion that contacts ink receiving layer and area (S2) of adhesive portion as directly viewed | S1 < S2 | |
| | Area ratio of directly exposed portion (%) | 75 | |
| Adhesion layer | Adhesive material | SAIVINOL RMA-63 (particles) | |
| | Adhesive | 1 μm | |
| | Average particle size | | |
| | Adhesive layer thickness | 2 μm | |

TABLE 9-4

| | | Comparative Example 3 | Comparative Example 4 |
|---|---|---|---|
| | | Transfer material 19 | |
| Ink receiving layer | Inorganic particulates | — | |
| | Water-soluble resin | NS-625XC | |
| | Others | — | — |
| | Ink receiving layer thickness | 15 μm | |

TABLE 9-4-continued

| | | Comparative Example 3 | Comparative Example 4 |
|---|---|---|---|
| | | Transfer material 19 | |
| Printing | Ink | Resin dispersing pigment | Dye |
| | Resolution | 1200 dpi | |
| | Ejection amount | 4 pl | |
| | Ink landing diameter | 20μ | |
| Evaluation | Image characteristics (Absorption, concentration, and voids) | x | x |
| | Adhesion | x | x |
| | Image preservation (Migration/water resistance/light resistance) | — | — |

TABLE 10-1

| | | Comparative Example 5 Transfer material 20 |
|---|---|---|
| Surface state | | Only seas |
| Ink receiving layer | | Gap absorbing type |
| Island and sea | Relation between area (S1) of part of adhesive portion that contacts ink receiving layer and area (S2) of adhesive portion as directly viewed | |
| | Area ratio of directly exposed portion (%) | |
| Adhesion layer | Adhesive material | |
| | Adhesive | |
| | Average particle size | |
| | Adhesive layer thickness | |

TABLE 10-2

| | | Comparative Example 5 Transfer material 20 |
|---|---|---|
| Gap absorbing type | Inorganic particulates | HP-14 |
| | Water-soluble resin | PVA235 |
| | Others | — |
| | Ink receiving layer thickness | 15 μm |
| Printing | Ink | Resin dispersing pigment |
| | Resolution | 1200 dpi |
| | Ejection amount | 4 pl |
| | Ink landing diameter | 20μ |
| Evaluation | Image characteristics (Absorption, concentration, and voids) | ○ |
| | Adhesion | x |
| | Image preservation (abrasion resistance) | x |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-013711 filed Jan. 27, 2016, which is hereby incorporated by reference wherein in its entirety.

What is claimed is:

1. A transfer material comprising:

(a) a substrate;

(b), an ink receiving layer provided on the substrate; and (c) an adhesive layer provided on a surface of the ink receiving layer, wherein the ink receiving layer is of a gap-absorbing type and comprises inorganic particulates and a water-soluble resin, wherein an amount of the water-soluble resin is 3.3 to 20 pts·wt. relative to 100 pts·wt. of the inorganic particulates, wherein the adhesive layer includes a plurality of adhesive portions discretely provided on the surface of the ink receiving layer, wherein the surface of the ink receiving layer has (i) portions that contact the adhesive portions and (ii) exposed portions that do not contact the adhesive portions, wherein the adhesive portions are aggregates of adhesive particles, and wherein the transfer material can be printed with an image by causing an ink to land on the exposed portions and the adhesive portions.

2. The transfer material according to claim 1, wherein an area of the exposed portions on the surface of the ink receiving layer accounts for 50% or more of a total area of the ink receiving layer.

3. The transfer material according to claim 1, wherein an area of a part of each adhesive portion that contacts the ink receiving layer is smaller than a projection area of the adhesive portion as projected from a thickness direction of the adhesive layer.

4. A printed material in which an image substrate and the ink receiving layer with the image printed thereon with ink are laminated, wherein the ink receiving layer is transferred from the transfer material according to claim 1.

5. A manufacturing method for a printed material, the manufacturing method comprising:

a printing step of printing the image by applying ink from the adhesive layer side to the transfer material according to claim 1; and a transfer step of transferring a surface of the transfer material with the image printed thereon to an image substrate.

6. The manufacturing method according to claim 5, wherein, in the printing step, ink is applied using an ink jet printing system.

7. The manufacturing method according to claim 5, further comprising:

a peeling step of peeling off the substrate after the transfer step.

* * * * *